US006336067B1

(12) United States Patent
Watanabe et al.

(10) Patent No.: US 6,336,067 B1
(45) Date of Patent: Jan. 1, 2002

(54) ELECTRONIC CONTROL SYSTEM AND CONTROL DEVICE FOR CONSTRUCTION MACHINE

(75) Inventors: Hiroshi Watanabe, Ushiku; Hiroshi Ogura, Ryugasaki, both of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/509,935

(22) Filed: Apr. 3, 2000

(30) Foreign Application Priority Data

Aug. 12, 1998 (SE) ..... 10-228359
Aug. 28, 1998 (SE) ..... 10-243308

(51) Int. Cl.[7] ..... E02F 9/20; G05B 15/02
(52) U.S. Cl. ..... 701/50; 37/414
(58) Field of Search ..... 701/50; 37/414

(56) References Cited

U.S. PATENT DOCUMENTS 4,811,561 A * 3/1989 Edwards et al. ..... 60/368
5,347,448 A * 9/1994 Nam ..... 364/167.11
5,884,206 A * 3/1999 Kim ..... 701/50
5,978,720 A * 11/1999 Hieronymus et al. ..... 701/29
6,167,337 A * 12/2000 Haack et al. ..... 701/50

FOREIGN PATENT DOCUMENTS

JP 63-197144 8/1988
JP 8-28911 3/1996
JP 10-183690 7/1996
JP 9-158771 6/1997

OTHER PUBLICATIONS

SAE Paper 9416796 "Development of Intelligent Hydraulic Excavator", Hyper GX Series, 1994.

* cited by examiner

*Primary Examiner*—Michael J. Zanelli
(74) *Attorney, Agent, or Firm*—Mattingly, Stanger & Malur, P.C.

(57) ABSTRACT

A hydraulic excavator 1 comprises a prime mover 14, an excavating device 7, a hydraulic pump 18 rotationally driven by the prime mover, actuators 11, 12, 13 for driving the working device, and control levers 27, 27, 29 for operating control valves 24, 25, 26 for controlling a hydraulic fluid supplied from the hydraulic pump to the actuators. Control units 17, 23, 33, 37 and a display unit 38 are provided on the hydraulic excavator, the control units being associated with the prime mover, the excavating device, the hydraulic pump and the control levers. The control units and the display unit are interconnected via a common communication line 39 to transmit and receive data among them. The control units each include minimum processing means capable of performing computation by using an initial value and executing least necessary processing by itself when no data is transmitted via the communication line. In an electronic control system for a construction machine including a plurality of control units interconnected via a common communication line, therefore, system change including addition, exclusion and replacement of one or more control units can be easily realized.

17 Claims, 52 Drawing Sheets

FIG.10

MESSAGE DEFINITION TABLE

| | ID | TRANSMISSION/ RECEPTION | CYCLE | DATA NAME |
|---|---|---|---|---|
| ENGINE CONTROL | 51 | TRANSMISSION | 50ms | $N_e$ |
| | 52 | TRANSMISSION | 50ms | $N_r$ |

FIG.11

MESSAGE TRANSMISSION MANAGEMENT TABLE

| ID | CYCLE | COUNTER |
|---|---|---|
| 51 | 50ms | 0 |
| 52 | 50ms | 0 |

FIG.12

MESSAGE DEFINITION TABLE

| | ID | TRANSMISSION/ RECEPTION | CYCLE | DATA NAME | ( ) ← INITIAL VALUE |
|---|---|---|---|---|---|
| PUMP CONTROL | 41 | TRANSMISSION | 8ms | $\theta$ | |
| | 42 | TRANSMISSION | 8ms | $P_d$ | |
| | 31 | RECEPTION | — | $X_1$ | ($X_{FULL}$) MAXIMUM INPUT AMOUNT |
| | 32 | RECEPTION | — | $X_2$ | ($X_{FULL}$) MAXIMUM INPUT AMOUNT |
| | 33 | RECEPTION | — | $X_3$ | ($X_{FULL}$) MAXIMUM INPUT AMOUNT |
| | 51 | RECEPTION | — | $N_e$ | ($N_{MAX}$) MAXIMUM VALUE |
| | 52 | RECEPTION | — | $N_r$ | ($N_{MAX}$) MAXIMUM VALUE |

FIG.13

MESSAGE TRANSMISSION MANAGEMENT TABLE

| ID | CYCLE | COUNTER |
|---|---|---|
| 41 | 8ms | 0 |
| 42 | 8ms | 0 |

FIG.14

MESSAGE DEFINITION TABLE ( ) ← INITIAL VALUE

LEVER CONTROL SYSTEM

| ID | TRANSMISSION/ RECEPTION | CYCLE | DATA NAME | |
|---|---|---|---|---|
| 31 | TRANSMISSION | 10ms | $X_1$ | |
| 32 | TRANSMISSION | 10ms | $X_2$ | |
| 33 | TRANSMISSION | 10ms | $X_3$ | |
| 12 | RECEPTION | — | $C_{auto}$ | (OFF) |
| 21 | RECEPTION | — | $Y_\alpha$ | (0) |
| 22 | RECEPTION | — | $Y_\beta$ | (0) |
| 23 | RECEPTION | — | $Y_\gamma$ | (0) |

FIG.15

MESSAGE TRANSMISSION MANAGEMENT TABLE

| ID | CYCLE | COUNTER |
|---|---|---|
| 31 | 10ms | 0 |
| 32 | 10ms | 0 |
| 33 | 10ms | 0 |

FIG.16

FRONT CONTROL COMPUTATION

MESSAGE DEFINITION TABLE ( ) ← INITIAL VALUE

| ID | TRANSMISSION/ RECEPTION | CYCLE | DATA NAME | |
|---|---|---|---|---|
| 21 | TRANSMISSION | 10ms | $Y_\alpha$ | |
| 22 | TRANSMISSION | 10ms | $Y_\beta$ | |
| 23 | TRANSMISSION | 10ms | $Y_\gamma$ | |
| 24 | TRANSMISSION | 100ms | h | |
| 11 | RECEPTION | — | $h_r$ | ( $h_{out}$ ) NUMERICAL VALUE OUTSIDE RANGE |
| 12 | RECEPTION | — | $C_{auto}$ | (OFF) |
| 31 | RECEPTION | — | $X_1$ | (0) |
| 32 | RECEPTION | — | $X_2$ | (0) |
| 33 | RECEPTION | — | $X_3$ | (0) |
| 41 | RECEPTION | — | $\theta$ | ( $\theta_{MAX}$ ) MAXIMUM VALUE |
| 42 | RECEPTION | — | $P_d$ | ( $P_{normal}$ ) AVERAGE VALUE FOR NORMAL EXCAVATION (e.g., $200^K$ ) |
| 51 | RECEPTION | — | $N_e$ | ( $N_{MAX}$ ) MAXIMUM VALUE |

FIG.17

MESSAGE TRANSMISSION MANAGEMENT TABLE

| ID | CYCLE | COUNTER |
|---|---|---|
| 21 | 10ms | 0 |
| 22 | 10ms | 0 |
| 23 | 10ms | 0 |
| 24 | 100ms | 0 |

FIG.18

MESSAGE DEFINITION TABLE

DISPLAY SYSTEM

| ID | TRANSMISSION/ RECEPTION | CYCLE | DATA NAME | |
|---|---|---|---|---|
| | | | | ( ) ← INITIAL VALUE |
| 11 | TRANSMISSION | 100ms | $h_r$ | |
| 12 | TRANSMISSION | 100ms | $C_{auto}$ | |
| 31 | RECEPTION | — | h | ( $h_{out}$ ) NUMERICAL VALUE OUTSIDE RANGE |

FIG.19

MESSAGE TRANSMISSION MANAGEMENT TABLE

| ID | CYCLE | COUNTER |
|---|---|---|
| 11 | 100ms | 0 |
| 12 | 100ms | 0 |

FIG.30

| COMMUNICATION DATA | | | | CONTROL UNIT | | | | |
|---|---|---|---|---|---|---|---|---|
| | | | | DISPLAY SYSTEM | EXCAVATING DEVICE CONTROL SYSTEM | OPERATING SYSTEM | HYDRAULIC POWER CONTROL SYSTEM | PRIME MOVER CONTROL SYSTEM |
| ID | DATA NAME | SYMBOL | TRANS-MISSION CYCLE | DISPLAY UNIT 38 | CONTROL UNIT 37 | CONTROL UNIT 33 | CONTROL UNIT 23 | CONTROL UNIT 17 |
| 11 | TARGET LOCUS | $h_r$ | 100ms | ○ | ● | | | |
| 12 | AUTOMATIC OPERATION COMMAND | $C_{auto}$ | 100ms | ○ | ● | ● | | |
| 21 | DRIVING COMMAND | $Y_\beta$ | 10ms | | ○ | ● | | |
| 22 | DRIVING COMMAND | $Y_\alpha$ | 10ms | | ○ | ● | | |
| 23 | DRIVING COMMAND | $Y_\gamma$ | 10ms | | ○ | ● | | |
| 24 | EXCAVATING DEVICE POSITION (DEPTH) | h | 100ms | ● | ○ | | | |
| 31 | OPERATION SIGNAL | $X_1$ | 10ms | | ● | ○ | ● | |
| 32 | OPERATION SIGNAL | $X_2$ | 10ms | | ● | ○ | ● | |
| 33 | OPERATION SIGNAL | $X_3$ | 10ms | | ● | ○ | ● | |
| 41 | PUMP TILTING ANGLE | $\theta$ | 8ms | | ● | | ○ | |
| 42 | PUMP DELIVERY PRESSURE | Pd | 8ms | | ● | | ○ | |
| 51 | ENGINE REVOLUTION SPEED | Ne | 50ms | | ● | | ● | ○ |
| 52 | TARGET ENGINE REVOLUTION SPEED | Nr | 50ms | | | | ● | ○ |

○ : TRANSMISSION ● : RECEPTION

FIG.42

| CAN DATA ID | CONTENTS | SIZE |
|---|---|---|
| 1 | LEVER INPUT ; BOOM RAISING | 2 BYTES |
| 2 | LEVER INPUT ; BOOM LOWRING | 2 BYTES |
| 3 | LEVER INPUT ; ARM DUMPING | 2 BYTES |
| 4 | LEVER INPUT ; BOOM CROWDING | 2 BYTES |
| 5 | LEVER INPUT ; BUCKET DUMPING | 2 BYTES |
| 6 | LEVER INPUT ; BUCKET CROWDING | 2 BYTES |
| 7 | LEVER INPUT ; LEFTWARD SWING | 2 BYTES |
| 8 | LEVER INPUT ; RIGHTWARD SWING | 2 BYTES |
| 9 | OUTPUT COMMAND VALUE ; BOOM RAISING | 1 BYTE |
| 10 | OUTPUT COMMAND VALUE ; BOOM LOWRING | 1 BYTE |
| 11 | OUTPUT COMMAND VALUE ; ARM DUMPING | 1 BYTE |
| 12 | OUTPUT COMMAND VALUE ; ARM CROWDING | 1 BYTE |
| 13 | OUTPUT COMMAND VALUE ; BUCKET DUMPING | 1 BYTE |
| 14 | OUTPUT COMMAND VALUE ; BUCKET CROWDING | 1 BYTE |
| 15 | OUTPUT COMMAND VALUE ; LEFTWARD SWING | 1 BYTE |
| 16 | OUTPUT COMMAND VALUE ; RIGHTWARD SWING | 1 BYTE |
| 17 | BOOM ANGLE | 2 BYTES |
| 18 | ARM ANGLE | 2 BYTES |
| 19 | PUMP DELIVERY PRESSURE | 1 BYTE |
| 20 | SETTING VALUE | 2 BYTES |

FIG.43

| MESSAGE No. | CONSTITUENT DATA (ID No.) | TRANSMISSION/ RECEPTION | TRNSMISSION CYCLE |
|---|---|---|---|
| 1 | 1, 2, 3, 4 | RECEPTION | — |
| 2 | 5, 6, 7, 8 | RECEPTION | — |
| 3 | 9, 10, 11, 12, 13, 14, 15, 16 | TRANSMISSION | 5ms |
| 4 | 17, 18 | — | — |
| 5 | 19 | — | — |
| 6 | 20 | — | — |

FIG.44

| MESSAGE No. | TRANSACTION CYCLE (ms) | COUNTER |
|---|---|---|
| 1 | — | |
| 2 | — | |
| 3 | 5 | |
| 4 | — | |
| 5 | — | |
| 6 | — | |

FIG.45

| MESSAGE No. | CONSTITUENT DATA ( ID No. ) | TRANSMISSION/ RECEPTION | TRNSMISSION CYCLE |
|---|---|---|---|
| 1 | 1, 2, 3, 4 | TRANSMISSION | 5ms |
| 2 | 5, 6, 7, 8 | TRANSMISSION | 5ms |
| 3 | 9, 10, 11, 12, 13, 14, 15, 16 | RECEPTION | — |
| 4 | 17, 18 | — | — |
| 5 | 19 | — | — |
| 6 | 20 | — | — |

FIG.46

| MESSAGE No. | TRANSACTION CYCLE (ms) | COUNTER |
|---|---|---|
| 1 | 5 | |
| 2 | 5 | |
| 3 | — | |
| 4 | — | |
| 5 | — | |
| 6 | — | |

FIG.53

| MESSAGE No. | CONSTITUENT DATA ( ID No. ) | TRANSMISSION/ RECEPTION | TRNSMISSION CYCLE |
|---|---|---|---|
| 1 | 1, 2, 3, 4 | RECEPTION | — |
| 2 | 5, 6, 7, 8 | RECEPTION | — |
| 3 | 9, 10, 11, 12, 13, 14, 15, 16 | TRANSMISSION | 5ms |
| 4 | 17, 18 | TRANSMISSION | 5ms |
| 5 | 19 | — | — |
| 6 | 20 | RECEPTION | — |

FIG.54

| MESSAGE No. | TRANSACTION CYCLE (ms) | COUNTER |
|---|---|---|
| 1 | — | |
| 2 | — | |
| 3 | 5 | |
| 4 | 5 | |
| 5 | — | |
| 6 | — | |

FIG.55

| MESSAGE No. | CONSTITUENT DATA ( ID No. ) | TRANSMISSION/ RECEPTION | TRNSMISSION CYCLE |
|---|---|---|---|
| 1 | 1, 2, 3, 4 | RECEPTION | — |
| 2 | 5, 6, 7, 8 | RECEPTION | — |
| 3 | 9, 10, 11, 12, 13, 14, 15, 16 | RECEPTION | — |
| 4 | 17, 18 | RECEPTION | — |
| 5 | 19 | TRANSMISSION | 10 |
| 6 | 20 | — | — |

FIG.56

| MESSAGE No. | TRANSACTION CYCLE (ms) | COUNTER |
|---|---|---|
| 1 | — | |
| 2 | — | |
| 3 | — | |
| 4 | — | |
| 5 | 10 | |
| 6 | — | |

FIG.57

| MESSAGE No. | CONSTITUENT DATA ( ID No. ) | TRANSMISSION/ RECEPTION | TRNSMISSION CYCLE |
|---|---|---|---|
| 1 | 1, 2, 3, 4 | RECEPTION | — |
| 2 | 5, 6, 7, 8 | RECEPTION | — |
| 3 | 9, 10, 11, 12, 13, 14, 15, 16 | RECEPTION | — |
| 4 | 17, 18 | RECEPTION | — |
| 5 | 19 | RECEPTION | — |
| 6 | 20 | TRANSMISSION | 50 |

FIG.58

| MESSAGE No. | TRANSACTION CYCLE (ms) | COUNTER |
|---|---|---|
| 1 | — | |
| 2 | — | |
| 3 | — | |
| 4 | — | |
| 5 | — | |
| 6 | 50 | |

FLAG CONFIGURATION IN SECOND CONTROL UNIT 123A

FLAG CONFIGURATION IN DISPLAY/ SETTING UNIT 138A

ELECTRONIC CONTROL SYSTEM AND CONTROL DEVICE FOR CONSTRUCTION MACHINE

TECHNICAL FIELD

The present invention relates to a control unit for a construction machine, and more particularly to an electronic control system for a construction machine which includes a plurality of control units for controlling a prime mover, hydraulic equipment, a working device, a display unit, etc., and which interconnects the plurality of control units via a common communication line for transmission and reception of data.

BACKGROUND ART

Recently, with the advancement of electronic control incorporated in construction machines, particularly in a hydraulic excavator as a typical example thereof, the amount of computation to be processed by a control unit has increased more and more because of various kinds of computation required for the electronic control. The increased amount of computation necessitates the use of a high-performance microcomputer, and hence pushes up a cost. Also, the number of input/output signals is increased, which results in an increased number of wire harnesses. To overcome such a problem, dispersion of control units has been studied. In dispersion of control units, control functions of a hydraulic excavator are divided in units of function, control units are provided one for each of the unit functions, and the control units are interconnected via a network for performing control.

For example, JP, B, 7-113854 discloses an electronic control system for a hydraulic excavator wherein control units are provided one for each device, the control units for the respective devices are connected to a master controller via a common communication line, and integration of the overall system is maintained by the master controller.

Also, JP, B, 8-28911 discloses an electronic control system for a construction machine wherein control units are provided one for each device, and the control units are interconnected via a multi-transfer serial communication circuit to construct a network capable of two-way communication. This system is easily expandable.

Further, SAE Paper 941796 Development of Intelligent Hydraulic Excavator—HYPER GX Series (published in 1994) discloses an electronic control system for a hydraulic excavator wherein control units are provided one for each device, and the control units are interconnected via a network. The network is divided into a low-speed network and a high-speed network to ensure reliability of high-speed communication data and realize a cost reduction of the overall system.

DISCLOSURE OF THE INVENTION

In a hydraulic excavator as a typical example of construction machines, as mentioned above, electronic control has been advanced and various improvements have been achieved in points of control performance and production cost.

On the other hand, customer needs for hydraulic excavators have become diversified, for example, ranging from a demand for high-performance functions to a demand for an inexpensive machine.

In the electronic control system disclosed in JP, B, 7-113854, to satisfy the above customer needs, software of the master controller must be developed and changed, and the master controller must be replaced for each need. Moreover, with replacement of the master controller, software of the control unit provided for each device and connected to the master controller must be developed and changed, and the resultant software must be substituted for that of the existing control unit. Particularly, when high-performance functions are demanded, e.g., when automatic control functions such as operating area limitation and locus control are to be added to an excavating device of a hydraulic excavator, the kinds of software installed in the control units are increased. As a result, the number of steps for development and the development cost or management cost are increased.

On the contrary, when high-performance functions of a hydraulic excavator are not needed, software of the master controller and the control units must also be developed and changed correspondingly, and the resultant software must be substituted for the existing software. Therefore, the number of steps required for software development and the development cost are increased.

In the electronic control systems disclosed in JP, B, 8-28911 and SAE Paper 941796, the control units for the respective devices are interconnected via the network, and all signals to be transmitted and received among the control units can be transferred using the network. Accordingly, even when a number of signals are transmitted and received, it is not required to increase the number of signal lines. Also, even when a control unit having a new function is added to the system, there is no need of increasing the number of signal lines. Those electronic control systems are thus flexibly adaptable for system expansion.

In the case of adding a control unit for system expansion, there is no need of increasing the number of signal lines, but each control unit must be itself adapted for an increase in the number of signals (data) to be transmitted and received. In other words, the existing control units must be replaced and hence the cost is pushed up. Further, in the case of requiring not so high-performance functions and desiring to reduce the number of control units, each control unit must also be adapted for a decrease in the number of signals (data) to be transmitted and received. Such a case therefore similarly requires replacement of the existing control units. Further, in the case of replacing one of a plurality of control units by another unit upon change of a hydraulic system or a control system, if a particular one of the plurality of control units executes processing using a received signal and a control unit transmitting the received signal is replaced and excluded from the system, the particular control unit must also be replaced.

Additionally, when a multiplicity of control units transfer data among them via a network, the network would be too crowded to utilize necessary data on demand unless communication frequency is held at an optimum level. This results in a deterioration of the control performance of the control units.

A first object of the present invention is to provide an electronic control system and a control unit for a construction machine including a plurality of control units interconnected via a common communication line, wherein additional connection of a control unit to the common communication line and disconnection of any control unit from the common communication line can be performed without changing software in the existing control units and replacing the control units themselves, and system change including addition, exclusion and replacement of one ore more control units can be easily realized.

A second object of the present invention is to provide an electronic control system for a construction machine including a plurality of control units interconnected via a common communication line, wherein data communication frequency over a network is held at an optimum level and the control performance of the control units is avoided from deteriorating.

(1) To achieve the above first object, the present invention provides an electronic control system for a construction machine comprising a prime mover, a working device, and a hydraulic system for generating liquid pressure power by the prime mover and driving the working device, the construction machine further comprising a plurality of control units, the plurality of control units being interconnected via a common communication line to transmit and receive data, wherein at least one of the plurality of control units includes minimum processing means capable of executing least necessary processing by itself when no data is transmitted via the communication line.

With that feature of providing the minimum processing means in at least one control unit, in the case of reducing the number of control units, the least necessary processing can be performed by the minimum processing means even when no data is transmitted via the communication line. There is hence no need of changing software and replacing the control units. This also similarly applies to the case where a control unit transmitting the relevant data is excluded as a result of partial replacement of a plurality of control units. Further, by designing software of the control units in anticipation of expansion of the system beforehand, need of changing software and replacing the control units can also be eliminated even for addition of a control unit. Therefore, one or more control units can be additionally connected to the common communication line or can be disconnected from the common communication line without changing software in the existing control units or replacing the control units themselves. It is hence possible to easily realize system change including addition, exclusion and replacement of one or more control units, and to hold down an increase of the development cost.

(2) Also, to achieve the above first object, the present invention provides an electronic control system for a construction machine comprising a prime mover, a working device, a hydraulic pump rotationally driven by the prime mover, actuators for driving the working device, control valves for controlling a hydraulic fluid supplied from the hydraulic pump to the actuators, and operating means for operating the control valves, the construction machine further comprising a plurality of control units, the plurality of control units being interconnected via a common communication line to transmit and receive data, wherein at least one of the plurality of control units includes minimum processing means capable of executing least necessary processing by itself when no data is transmitted via the communication line.

With that feature of dividing a control unit for a construction machine into a plurality of control units and interconnecting the plurality of control units via a common communication line to transmit and receive data, it is only required to modify, add or exclude the control unit at the least necessary level when manufacturing machines having different customer-demanded functions. Therefore, a system can be changed with the least necessary development cost and the least necessary number of development steps. Also, since the control units are divided for each function, the system is more convenient from the viewpoint of management and the management cost can be reduced.

In addition, with the feature of providing the minimum processing means in at least one control unit, as described in above (1), when one or more control units are added, excluded or replaced, there is no need of changing software and replacing the other control units. Thus, system change including addition, exclusion and replacement of one or more control units can be easily realized.

(3) In above (2), preferably, the plurality of control units include at least two of a control unit for controlling the prime mover, a control unit for controlling the working device, a control unit for controlling the hydraulic pump, a control unit for operating the control valves through the operating means, and a control unit for performing display and/or input in relation to the control units.

With that feature, system change including addition, exclusion and replacement of one or more control units can be easily realized, as described in above (2), for the control unit for controlling the prime mover, the control unit for controlling the working device, the control unit for controlling the hydraulic pump, the control unit for operating the control valves through the operating means, and the control unit for performing display and/or input in relation to the control units.

(4) In above (1) or (2), preferably, the minimum processing means has an initial value set therein for each data to be received via the communication line for fulfilling the least necessary function of each control unit, and performs computational processing by using the initial value when no data is transmitted via the communication line.

With that feature, when no data is transmitted via the communication line, the minimum processing means performs computational processing by using the initial value, and therefore the control unit can execute the least necessary processing by itself.

(5) Further, to achieve the above second object, in the electronic control system of above (1) or (2) according to the present invention, the plurality of control units each have an optimum transmission time interval set therein for each data to be transmitted to another control unit via the communication line, and transmits the data at the set time interval.

With that feature of setting an optimum transmission time interval for each data to be transmitted on the transmitting side and transmitting the data at the set time interval, the control unit can transmit data depending on a varying speed of the data or the cycle required for the control unit on the receiving side, and the amount of data flowing over the common communication line can be minimized within the necessary range. As a result, the common communication line can be utilized efficiently and the control performance is avoided from being affected by a lowering of the communication efficiency. In addition, even with an increase in the number of control units, the system is less susceptible to such a trouble as disabling communication due to excessive traffic on the common communication line.

(6) In above (5), preferably, the transmission time interval preset for each data to be transmitted is set depending a varying speed of the data or the cycle required for the control unit receiving the data.

With that feature, as described in above (5), the amount of data flowing over the common communication line can be minimized within the necessary range, and the common communication line can be utilized efficiently.

(7) In above (1) or (2) or (5), preferably, the plurality of control units each set a specific ID for each data to be transmitted or received via the communication line, and each have include communication means for transmitting data, which is to be transmitted via the communication line, with a specific ID assigned thereto, and for receiving only necessary item of data received via the communication line by identifying the necessary data based on a specific ID assigned thereto.

With that feature, in spite of various data flowing over the common communication line, each control unit can receive only necessary data. Further, each control unit can receive necessary information at a cycle required from the control point of view in a combination with the above feature (5), and hence the control performance is avoided from being affected by a lowering of the communication efficiency.

(8) Also, to achieve the above first object, the present invention provides a control unit for a construction machine comprising a prime mover, a working device, and a hydraulic system for generating liquid pressure power by the prime mover and driving the working device, the control unit being provided in the construction machine and connected to another control unit via a common communication line to transmit and receive data, wherein the control unit includes minimum processing means capable of executing least necessary processing by itself when no data is transmitted via the communication line.

With that feature, as described in above (1), when one or more of the control units provided in the construction machine are added, excluded or replaced, there is no need of changing software and replacing the other control units. Thus, system change including addition, exclusion and replacement of one or more control units can be easily realized.

(9) In above (8), preferably, the minimum processing means has an initial value set therein for each data to be received via the communication line, and performs computational processing by using the initial value when no data is transmitted via the communication line.

With that feature, as described in above (4), the minimum processing means performs computational processing by using the initial value, and therefore the control unit can execute the least necessary processing by itself.

(10) Further, to achieve the above first object, the present invention provides an electronic control system for a construction machine comprising a prime mover, a working device, and a hydraulic system for generating liquid pressure power by the prime mover and driving the working device, the construction machine further comprising a plurality of control units, the plurality of control units being interconnected via a common communication line to transmit and receive data, wherein at least one of the plurality of control units comprises first processing means for performing computational processing without using data transmitted from another control unit, second processing means for performing computational processing by using data transmitted from the another control unit, detecting means for detecting whether or not the another control unit is connected to the common communication line, and processing changeover means for executing the computational processing in the first processing means when connection of the another control unit is not detected by the detecting means, and for executing the computational processing in the second processing means when connection of the another control unit is detected by the detecting means.

With that feature of providing the first processing means, the second processing means, the detecting means and the processing changeover means in at least one control unit, when another control unit is connected to the common communication line, this fact is detected by the detecting means and the processing changeover means executes the computational processing in the second processing means. Also, when another control unit is disconnected from the common communication line, this fact is detected by the detecting means and the processing changeover means executes the computational processing in the first processing means. Therefore, one or more control units can be disconnected from the common communication line or displaced without changing software in the existing control units or replacing the control units themselves.

On the other hand, when another control unit is not connected to the common communication line, this fact is detected by the detecting means and the processing changeover means executes the computational processing in the first processing means. Also, when another control unit is additionally connected to the common communication line to increase the number of control units, this fact is detected by the detecting means and the processing changeover means executes the computational processing in the second processing means. Therefore, one or more control units can be additionally connected to the common communication line without changing software in the existing control units or replacing the control units themselves.

Thus, additional connection of a control unit to the common communication line and disconnection of any control unit from the common communication line can be performed without changing software in the existing control units and replacing the control units themselves. As a result, system change including addition, exclusion and replacement of one or more control units can be easily realized, and an increase of the development cost can be held down.

(11) Still further, to achieve the above first object, the present invention provides an electronic control system for a construction machine comprising a prime mover, a working device, a hydraulic pump, actuators for driving the working device, control valves for controlling a hydraulic fluid supplied from the hydraulic pump to the actuators, and operating means for operating the control valves, the construction machine further comprising a plurality of control units, the plurality of control units being interconnected via a common communication line to transmit and receive data, wherein at least one of the plurality of control units comprises first processing means for performing computational processing without using data transmitted from another control unit, second processing means for performing computational processing by using data transmitted from the another control unit, detecting means for detecting whether or not the another control unit is connected to the common communication line, and processing changeover means for executing the computational processing in the first processing means when connection of the another control unit is not detected by the detecting means, and for executing the computational processing in the second processing means when connection of the another control unit is detected by the detecting means.

With that feature of dividing a control unit for a construction machine into a plurality of control units and interconnecting the plurality of control units via a common communication line to transmit and receive data, it is only required to modify, add or exclude the control unit at the least necessary level when manufacturing machines having different customer-demanded functions. Therefore, a system can be changed with the least necessary development cost and the least necessary number of development steps. Also, since the control units are divided for each function, the system is more convenient from the viewpoint of management and the management cost can be reduced.

In addition, with the feature of providing the first processing means, the second processing means, the detecting means and the processing changeover means in at least one control unit, as described in above (10), system change including addition, exclusion and replacement of one or more control units can be easily realized.

(12) In above (11), preferably, the plurality of control units include at least two of a control unit for controlling the prime mover, a control unit for controlling the working device, a control unit for controlling the hydraulic pump, a control unit for operating the control valves through the operating means, and a control unit for performing display and/or input in relation to the control units.

With that feature, system change including addition, exclusion and replacement of one or more control units can be easily realized, as described in above (11), for the control unit for controlling the prime mover, the control unit for controlling the working device, the control unit for controlling the hydraulic pump, the control unit for operating the control valves through the operating means, and the control unit for performing display and/or input in relation to the control units.

(13) In above (10) or (11), preferably, the detecting means detects whether or not the another control unit is connected, depending on whether or not data is received from the another control unit.

With that feature, whether or not another control unit is connected can be detected by software processing.

(14) In above (10) or (11), preferably, the detecting means changes the status of a flag depending on whether for not data is received from the another control unit, and the processing changeover means determines based on the status of the flag whether or not the another control unit is connected, and changes over the computational processing to be executed.

With that feature, whether or not another control unit is connected can be detected by software processing, and the computational processing to be executed can be changed over.

(15) In above (10) or (11), preferably, the another control unit exists in plural number, each data transmitted from the plurality of other control units is assigned with a specific identifiers, and the detecting means detects whether or not the plurality of other control units are connected, depending on whether or not data is received from the plurality of other control units, and also detects based on the identifier of received data which one of the plurality of other control units is connected.

With that feature, even in the case where the another control unit exists in plural number and the second processing means performs computational processing by using data transmitted from the plurality of other control units, the detecting means can detect whether the plurality of control units are connected for each control unit, the processing changeover means can appropriately change over the computational processing, and the second processing means can execute the appropriate computational processing.

(16) Still further, to achieve the above first object, the present invention provides a control unit for a construction machine comprising a prime mover, a working device, and a hydraulic system for generating liquid pressure power by the prime mover and driving the working device, the control unit being provided in the construction machine and connected to another control unit via a common communication line to transmit and receive data, wherein the control unit comprises first processing means for performing computational processing without using the transmitted data, second processing means for performing computational processing by using the transmitted data, detecting means for detecting whether or not the another control unit is connected to the common communication line, and processing changeover means for executing the computational processing in the first processing means when connection of the another control unit is not detected by the detecting means, and for executing the computational processing in the second processing means when connection of the another control unit is detected by the detecting means.

With that feature, as described in above (10), when one or more of the control units provided in the construction machine are added, excluded or replaced, there is no need of changing software and replacing the other control units. Thus, system change including addition, exclusion and replacement of one or more control units can be easily realized.

(17) In above (16), preferably, the detecting means detects whether or not the another control unit is connected, depending on whether or not data is received from the another control unit.

With that feature, as described in above (13), whether or not another control unit is connected can be detected by software processing.

BRIEF DESCRIPTION OF THE DRAWINGS

FIG. 10 shows a message definition table used in the first control unit.

FIG. 11 shows a message transmission management table created during initialization after start-up of the first control unit.

FIG. 12 shows a message definition table used in the second control unit.

FIG. 13 shows a message transmission management table created during initialization after start-up of the second control unit.

FIG. 14 shows a message definition table used in the third control unit.

FIG. 15 shows a message transmission management table created during initialization after start-up of the third control unit.

FIG. 16 shows a message definition table used in the fourth control unit.

FIG. 17 shows a message transmission management table created during initialization after start-up of the fourth control unit.

FIG. 18 shows a message definition table used in the display unit.

FIG. 19 shows a message transmission management table created during initialization after start-up of the display unit.

FIG. 30 is a table listing the relationships in transmission and reception of the communication data among the first to fourth control units and the display unit, including transmission cycles.

FIG. 42 shows one example of a data definition table used in common to the respective control units.

FIG. 43 shows a message definition table used in the fourth control unit.

FIG. 44 shows a transmission time management table created in the fourth control unit.

FIG. 45 shows a message definition table used in the third control unit.

FIG. 46 shows a transmission time management table created in the third control unit.

FIG. 53 shows a message definition table used in the fourth control unit.

FIG. 54 shows a transmission time management table created in the fourth control unit.

FIG. 55 shows a message definition table used in the second control unit.

FIG. 56 shows a transmission time management table created in the second control unit.

FIG. 57 shows a message definition table used in the display/setting unit.

FIG. 58 shows a transmission time management table created in the display/setting unit.

BEST MODE FOR CARRYING OUT THE INVENTION

Embodiments of the present invention will be described below with reference to the drawings.

Figure 1:
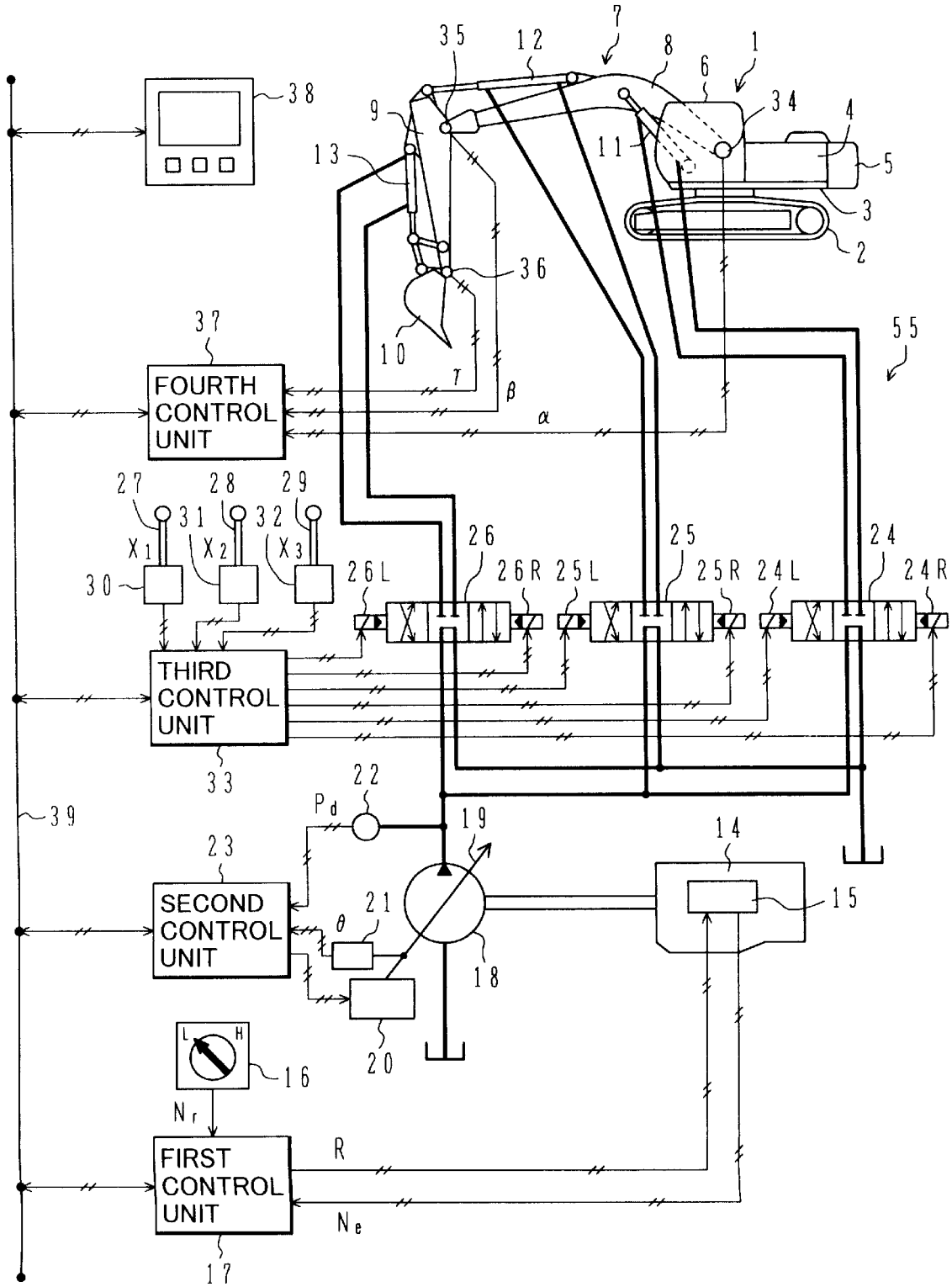
FIG. 1 is a diagram showing an electronic control system for a hydraulic excavator according to a first embodiment of the present invention, along with the hydraulic excavator and a hydraulic system thereof.

FIG. 1 is a diagram showing an electronic control system for a hydraulic excavator according to a first embodiment of the present invention, along with the hydraulic excavator and a hydraulic system thereof. In FIG. 1, numeral 1 denotes a hydraulic excavator. The hydraulic excavator 1 comprises a track body 2, a swing body 3 swingably mounted on the track body 2, an accommodating room 4 formed on the swing body 3 to accommodate a prime mover 14 and hydraulic equipment such as a hydraulic pump 18 (described later), a counterweight 5 provided at the back of the swing body 3, a cab 6 provided in a front portion of the swing body 3 on the left side, and an excavating device 7 provided in the front portion of the swing body 3 at the center thereof.

The excavating device 7 is made up of a boom 8 provided on the swing body 3 to be able to turn upward and downward, an arm 9 rotatably provided to a fore end of the boom 8, a bucket 10 rotatably provided to a fore end of the arm 9, a boom operating hydraulic cylinder 11 for turning the boom 8 upward and downward, an arm operating cylinder 12 for rotating the arm 9, and a bucket operating cylinder 13 for rotating the bucket 10.

The prime mover 14 is disposed in the accommodating room 4 as described above, and includes an electronic governor device 15 for maintaining the revolution speed of the prime mover 14 within a certain range. A target revolution speed Nr of the prime mover 14 is set by a target revolution speed setting unit 16.

Numeral 17 denotes a first control unit provided in a control system for the prime mover 14 and controlling the prime mover 14. The first control unit 17 performs the predetermined computation based on the target revolution speed Nr from the target revolution speed setting unit 16 and an actual revolution speed Ne detected by the governor device 15, and outputs a control signal R to the governor device 15 so that the actual revolution speed Ne coincides with the target revolution speed Nr. Details of the first control unit 17 will be described later.

The hydraulic pump 18 is disposed in the accommodating room 4 as described above, and is rotatably driven by the prime mover 14. Also, the hydraulic pump 18 is a variable displacement pump and includes a swash plate 19 for changing a delivery rate of the pump. A delivery rate regulator 20 is coupled to the swash plate 19. Additionally, there are provided a swash-plate position sensor 21 for detecting a tilting position of the swash plate 19 and a pressure sensor 22 for detecting a delivery pressure of the hydraulic pump Numeral 23 denotes a second control unit provided in a control system for the hydraulic pump 18 and controlling the hydraulic pump 18. The second control unit 23 performs the predetermined computation based on a delivery pressure Pd of the hydraulic pump 18 detected by the pressure sensor 22 and a tilting position θ of the swash plate 19 detected by the swash-plate position sensor 21, and outputs a control signal for the swash plate 19 to the delivery rate regulator 20 for the hydraulic pump 18. Details of the second control unit 23 will be described later.

The boom operating hydraulic cylinder 11, the arm operating cylinder 12 and the bucket operating cylinder 13 constitute a hydraulic system 55 in cooperation with the hydraulic pump 18, control valves 24, 25, 26, etc. The hydraulic cylinders 11, 12, 13 are connected to the hydraulic pump 18 through the control valves 24, 25, 26, respectively. Flow rates and directions of a hydraulic fluid supplied from the hydraulic pump 18 to the respective cylinders 11, 12, 13 are adjusted by the control valves 24, 25, 26. The control valves 24, 25, 26 are disposed in the accommodating room 4. Control levers 27, 28, 29 are provided in association with the control valves 24, 25, 26, and lever operating units 30, 31, 32 are coupled to the control levers 27, 28, 29, respectively. The lever operating units 30, 31, 32 output electrical signals corresponding to respective input amounts by which the control levers 27, 28, 29 are operated.

Numeral 33 denotes a third control unit provided in an operating system for shifting the control valves 24, 25, 26 with the control levers 27, 28, 29. The third control unit 33 performs the predetermined computational processing based on the electrical signals from the lever operating units 30, 31, 32, and outputs control signals to shifting sectors 24L, 24R, 25L, 25R, 26L, 26R of the control valves 24, 25, 26. Details of the third control unit 33 will be described later.

The excavating device 7 is provided with a boom rotational angle sensor 34 for detecting a rotational angle of the boom 8, an arm rotational angle sensor 35 for detecting a rotational angle of the arm 9, and a bucket rotational angle sensor 36 for detecting a rotational angle of the bucket 10.

Numeral 37 denotes a fourth control unit provided in a control system for the excavating device 7 and controlling the excavating device 7. The fourth control unit 37 performs the predetermined computational processing based on respective rotational angle signals α, βγ from the rotational angle sensors 34, 35, 36, and provides control driving commands Yα, Yβ, Yγ to the control unit 33. Details of the fourth control unit 37 will be described later.

Numeral 38 denotes a display unit constituting a fifth control unit. The display unit 38 instructs a target working locus of the excavating device 7 to the fourth control unit 37, and obtains information from the other control units 17, 23, 33, 37 to display the information.

The first to fourth control units 17, 23, 33, 37 and the display unit 38 are interconnected by a common communication line 39, and transmit and receive data among them via the communication line 39.

In this way, the prime mover 14 is controlled by the first control unit 17 through the governor device 15 so that the actual revolution speed Ne coincides with the target revolution speed Nr from the target revolution speed setting unit 16.

The delivery rate of the hydraulic pump 18 is controlled through the delivery rate regulator 20 in accordance with the control signal created by the second control unit 23 based on the signals from the pressure sensor 22 and the swash-plate position sensor 21.

The shift positions of the control valves 24, 25, 26 are controlled by the third control unit 33 in accordance with respective operation signals X1, X2, X3 from the control levers 27, 28, 29, thereby controlling the flow rates and directions of the hydraulic fluid supplied through the respective control valves.

The working locus of the excavating device 7 is controlled through the third control unit 33 in accordance with the control driving commands (working locus signals) Yα, Yβ, Yγ which are outputted from the fourth control unit 37 based on the rotational angle signals α, β, γ from the rotational angle sensors 34, 35, 36. On that occasion, the third control unit 33 modifies the operation signals X1, X2, X3 from the control levers 27, 28, 29 in accordance with the control driving signals from the fourth control unit 37, and controls the control valves 24, 25, 26 for controlling the operation of the excavating device 7.

The display unit 38 instructs the target working locus of the excavating device 7 to the fourth control unit 37, and obtains information from the first to fourth control units 17, 23, 33, 37 to display the information.

Figure 2:
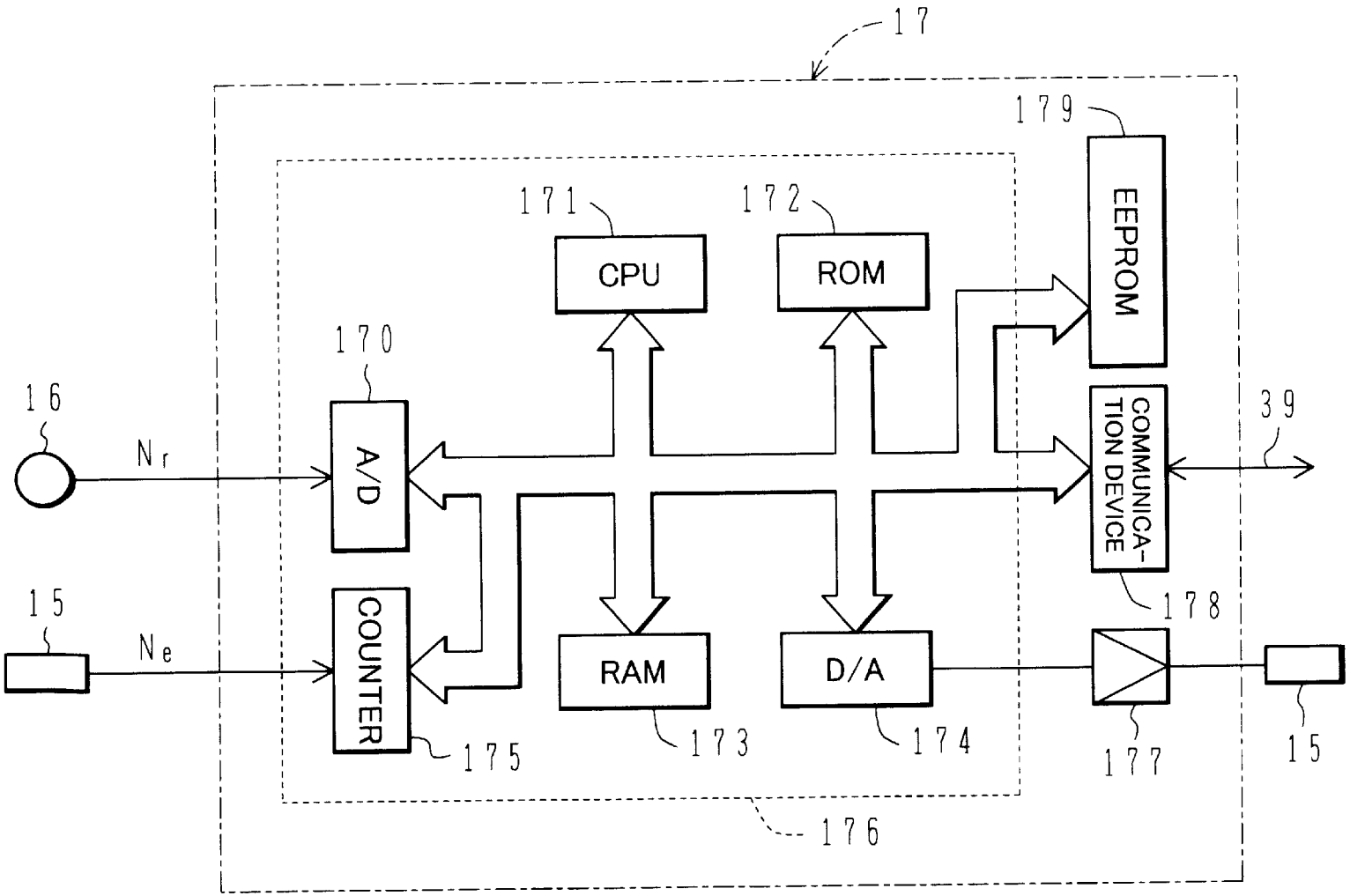
FIG. 2 is a diagram showing the configuration of a first control unit shown in FIG. 1.

FIG. 2 shows the configuration of the first control unit 17. In FIG. 2, the same numerals as those in FIG. 1 denote the same components. The first control unit 17 comprises a single-chip microcomputer 176 including an A/D converter 170 for receiving a target revolution speed signal Nr from the target revolution speed setting unit 16 and converting it into a digital signal; a counter 175 for receiving, in the form of pulse signals, the actual revolution speed Ne of the prome mover 14 provided from the governor device 15; a central processing unit (CPU) 171; a Read Only Memory (ROM) 172 for storing a program of control procedures and constants necessary for the control; a Random Access Memory (RAM) 173 for temporarily storing computation results and numerical values in the course of computation; and a D/A converter 174 for converting a digital signal into an analog signal. The first control unit 17 further comprises an amplifier 177 for outputting a signal from the D/A converter 174 to the governor device 15, a communication device 178 connected to the common communication line 39 for controlling communication to and from the other control units 23, 33, 37 and the display unit 38, and a nonvolatile memory (EEPROM (Electrically Erasable Programmable Read Only Memory)) 179 for storing control parameters, etc.

Figure 3:
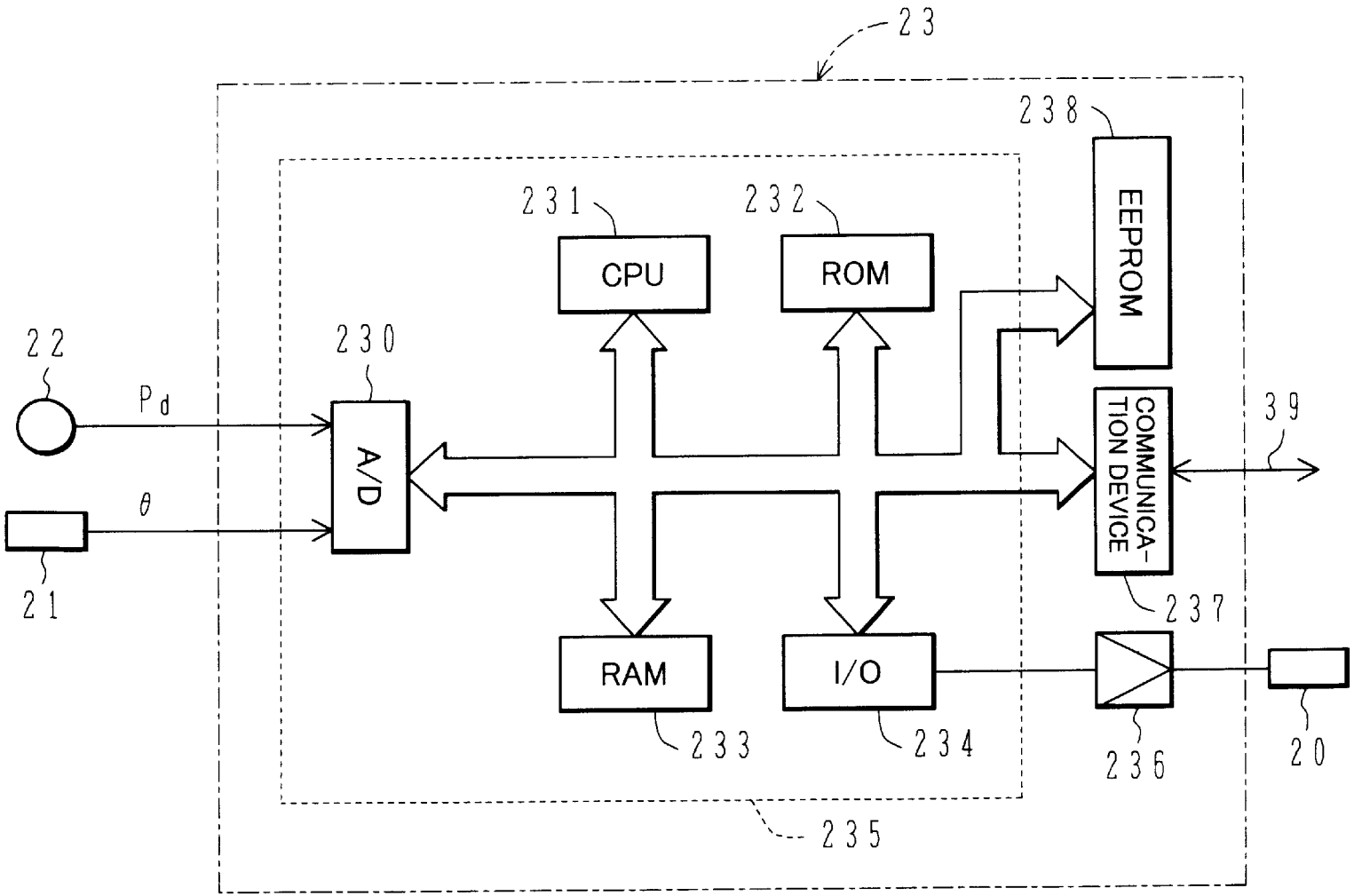
FIG. 3 is a diagram showing the configuration of a second control unit shown in FIG. 1.

FIG. 3 shows the configuration of the second control unit 23. In FIG. 3, the same numerals as those in FIG. 1 denote the same components. The second control unit 23 comprises a single-chip microcomputer 235 including an A/D converter 230 for receiving a pressure signal Pd from the pressure sensor 22 and a swash-plate position signal θ from the swash-plate position sensor 21, and converting them into digital signals; a central processing unit (CPU) 231; a Read Only Memory (ROM) 232 for storing a program of control procedures and constants necessary for the control; a Random Access Memory (RAM) 233 for temporarily storing computation results and numerical values in the course of computation; and an output interface (I/O) 234. The second control unit 23 further comprises an amplifier 236 for outputting a signal for driving the swash plate 19 of the hydraulic pump 18 to the swash-plate position regulator 20, a communication device 237 connected to the common communication line 39 for controlling communication to and from the other control units 17, 33, 37 and the display unit 38, and a nonvolatile memory (EEPROM) 238 for storing control parameters, etc.

Figure 4:
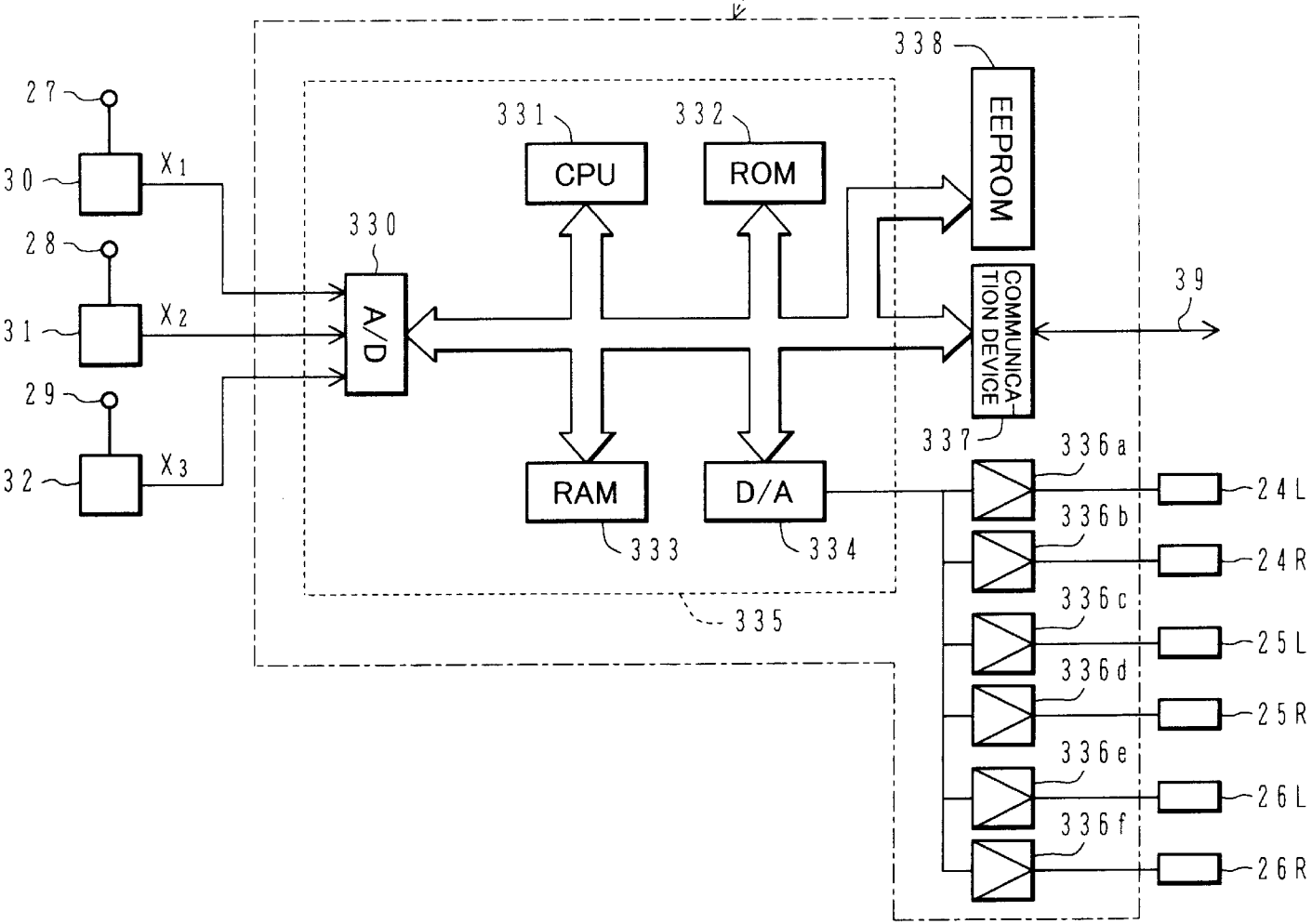
FIG. 4 is a diagram showing the configuration of a third control unit shown in FIG. 1.

FIG. 4 shows the configuration of the third control unit 33. In FIG. 4, the same numerals as those in FIG. 1 denote the same components. The third control unit 33 comprises a single-chip microcomputer 335 including an A/D converter 330 for converting the operation signals X1, X2, X3 from the lever operating units 30, 31, 32 associated with the control levers 27, 28, 29 into digital signals; a central processing unit (CPU) 331; a Read Only Memory (ROM) 332 for storing a program of control procedures and constants necessary for the control; a Random Access Memory (RAM) 333 for temporarily storing computation results and numerical values in the course of computation; and a D/A converter 334 for converting a digital signal into an analog signal. The third control unit 33 further comprises amplifiers 336*a*–337*f* for outputting signals from the D/A converter 334 to the shifting sectors 24L, 24R, 25L, 25R, 26L, 26R of the control valves 24, 25, 26, a communication device 337 connected to the common communication line 39 for controlling communication to and from the other control units 17, 23, 37 and the display unit 38, and a nonvolatile memory (EEPROM) 338 for storing control parameters, etc.

Figure 5:
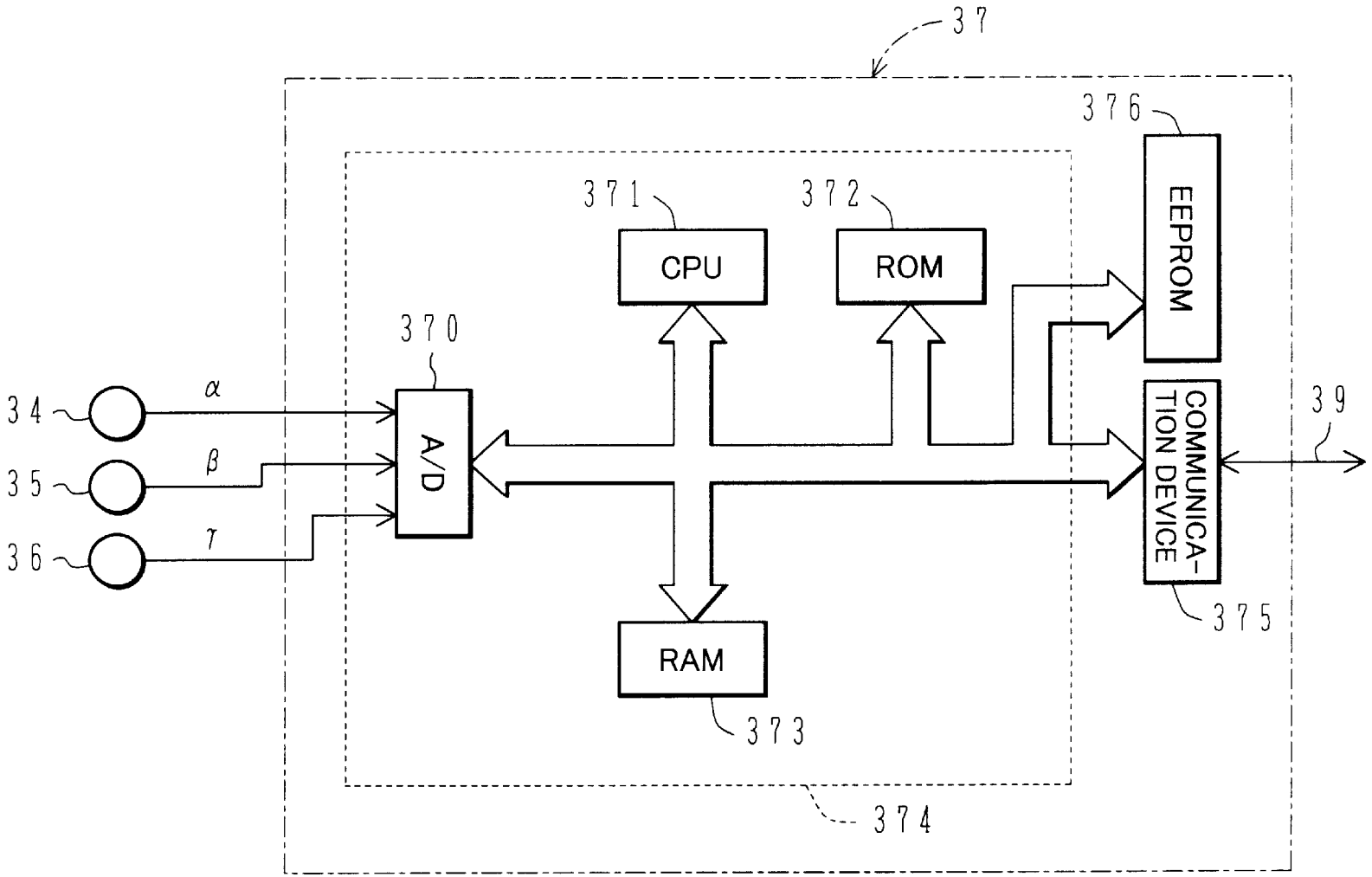
FIG. 5 is a diagram showing the configuration of a fourth control unit shown in FIG. 1.

FIG. 5 shows the configuration of the fourth control unit 37. In FIG. 5, the same numerals as those in FIG. 1 denote the same components. The fourth control unit 37 comprises a single-chip microcomputer 374 including an A/D converter 370 for receiving the angle signal α from the boom rotational angle sensor 34, the angle signal β from the arm rotational angle sensors 35 and the angle signal γ from the bucket rotational angle sensor 36, and converting them into digital signals; a central processing unit (CPU) 371; a Read Only Memory (ROM) 372 for storing a program of control procedures and constants necessary for the control; a Random Access Memory (RAM) 373 for temporarily storing computation results and numerical values in the course of computation. The fourth control unit 37 further comprises a communication device 375 connected to the common communication line 39 for controlling communication to and from the other control units 17, 23, 33 and the display unit 38, and a nonvolatile memory (EEPROM) 376 for storing control parameters, etc.

Figure 6:
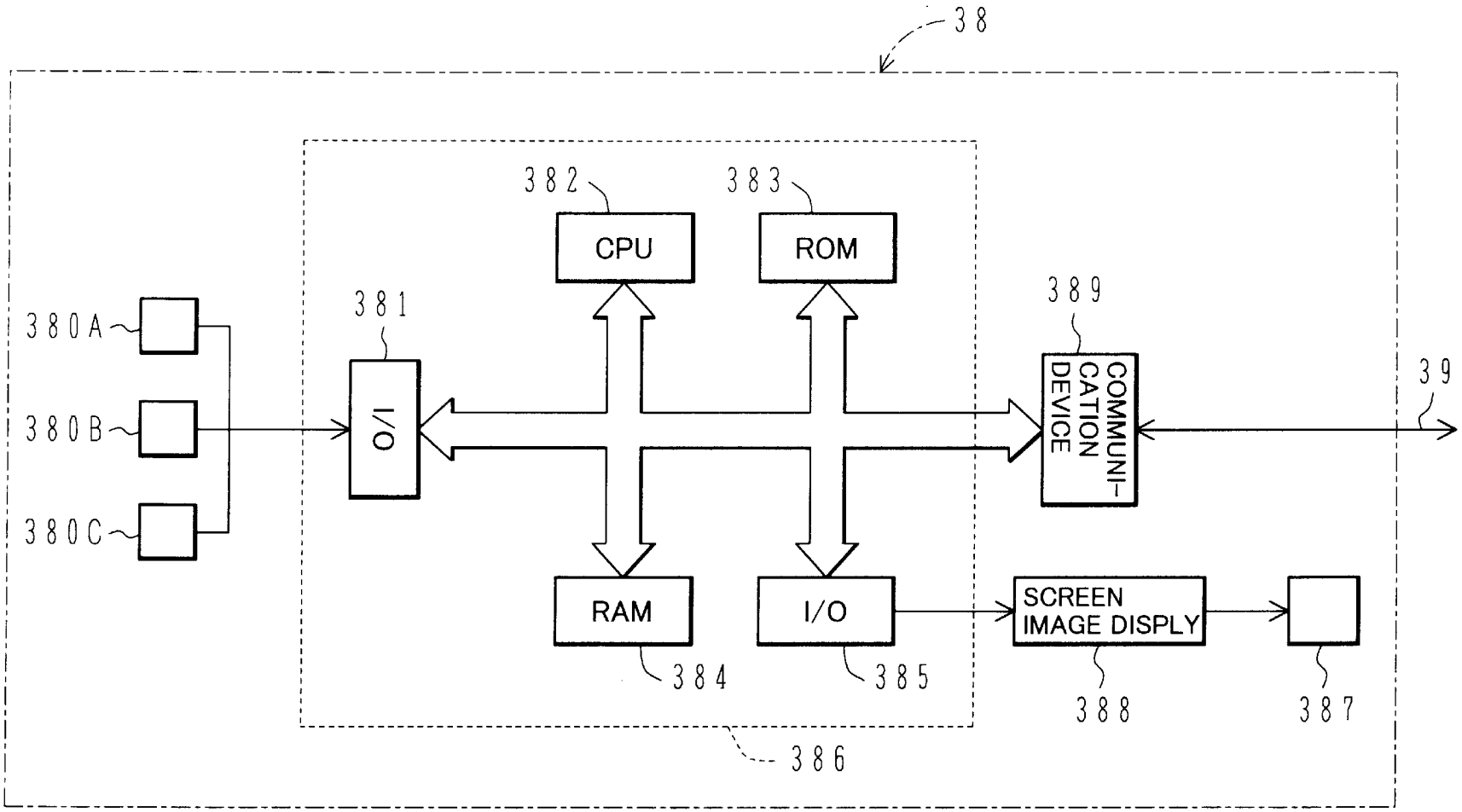
FIG. 6 is a diagram showing the configuration of a display unit shown in FIG. 1.

FIG. 6 shows the configuration of the display unit 38 constituting the fifth control unit. In FIG. 6, the same numerals as those in FIG. 1 denote the same components. The display unit 38 comprises input devices 380A, 380B, 380C, e.g., switches or keys, for changing over particulars displayed, and a single-chip microcomputer 386 including an interface (I/O) 381 for receiving signals from the input devices 380A, 380B, 380C; a central processing unit (CPU) 382; a Read Only Memory (ROM) 383 for storing a program of control procedures and constants necessary for the control; a Random Access Memory (RAM) 384 for temporarily storing computation results and numerical values in the course of computation; and an output interface (I/O) 385. The display unit 38 further comprises a display section 387 constituted by an LCD, for example, and displaying information thereon, a screen image display controller 388 for receiving a display command supplied from the CPU 382 to the display section 387 and sending data to the display section 387, and a communication device 389 connected to the common communication line 39 for controlling communication to and from the other control units 17, 23, 33, 37.

Figure 7:
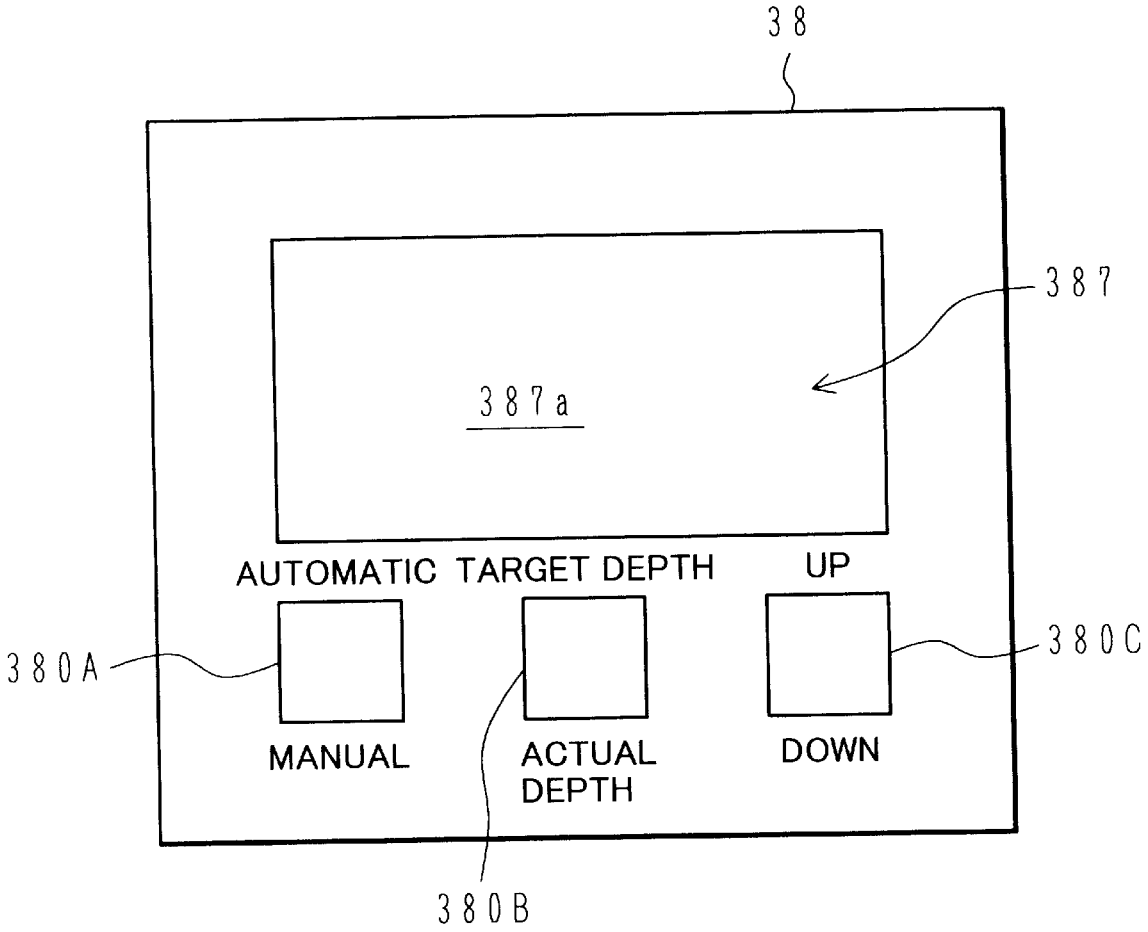
FIG. 7 is a diagram showing a display section of the display unit shown in FIG. 1.

FIG. 7 shows the construction of the display unit 38 shown in FIG. 6. In FIG. 7, the same numerals as those in FIG. 6 denote the same components. The input device 380A is to change over an ON/OFF state of automatic operation, and is constituted by a switch. The input device 380C is to set a target locus of the excavating device 7, and is constituted by a switch.

Where an excavation depth, for example, is instructed as the target locus, the input device 380C serves as an UP/DOWN switch for setting the target excavation depth. The switch 380C may be implemented in various forms depending on how the target locus is instructed. In that exemplary case, the switch 380B is changed over to display, on a display screen 387*a* of the display section 387, the target excavation depth when the target locus is set, and an actual excavation depth of the excavating device 7 otherwise.

Figure 8:
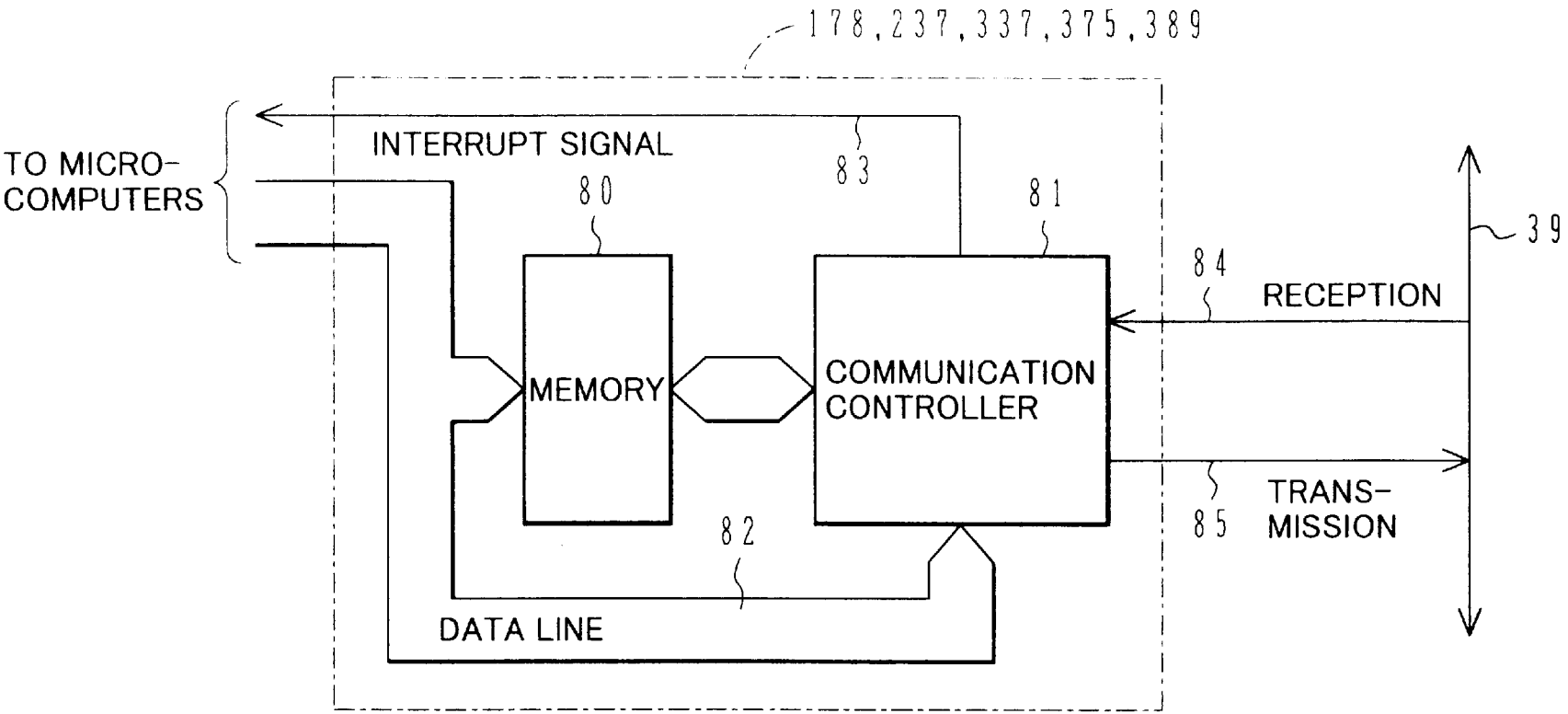
FIG. 8 is a diagram showing the configuration of a communication device used in each of the first to fourth control units and the display unit shown in FIG. 1.

FIG. 8 shows one example of the configuration of each of the communication devices 178, 237, 337, 375, 389. In FIG. 8, the same numerals as those in FIGS. 1–6 denote the same components. Each of the communication devices 178, 237, 337, 375, 389 is made up of a memory 80 having a storage location to manage data using the same number as an ID number (described later) added to the data; a communication controller 81; a data line 82 connected to the single-chip microcomputer 176, 235, 335, 374, 386 of the control unit 17, 23, 33, 37 and the display unit 38; an interrupt signal line 83 for sending a reception interrupt signal from the communication controller 81 to the single-chip microcomputer 176, 235, 335, 374, 386; and a reception line 84 and a transmission line 85 for connecting the communication controller 81 to the common communication line 39.

Details of the data transmitting and receiving function of the single-chip microcomputers and the communication devices in the first to fourth control units 17, 23, 33, 37 and the display unit 38 will be described with reference to FIGS. 9–23.

Figure 9:
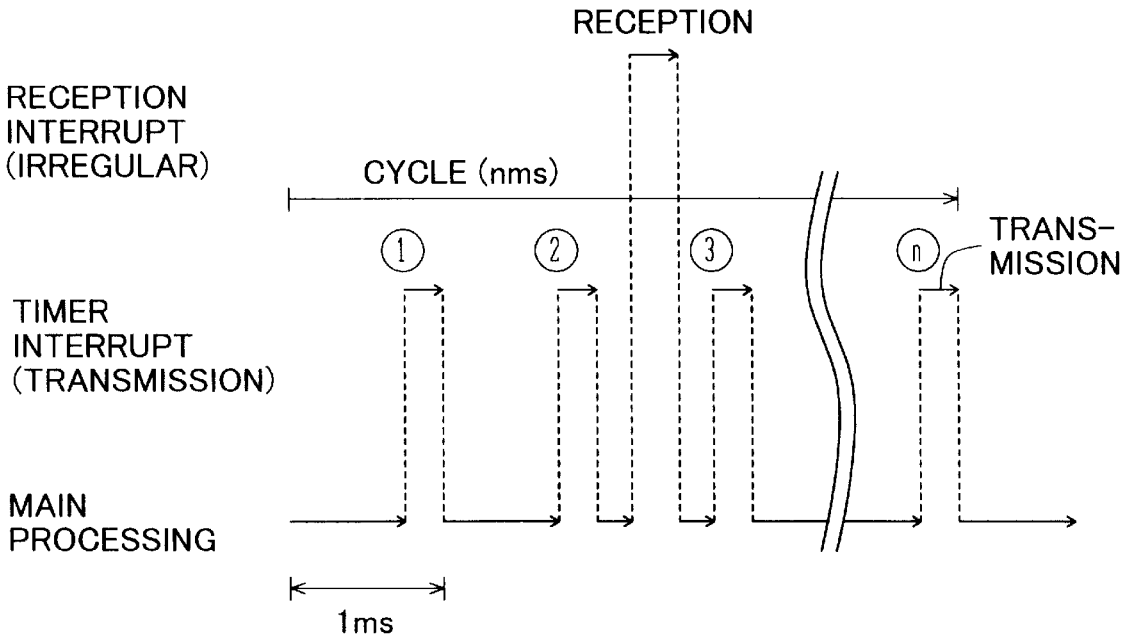
FIG. 9 is a timing chart showing the relationship between main processing and both timer interrupt processing and reception interrupt processing which are performed by a single-chip microcomputer in each of the control units and the display unit shown in FIGS. 2–7.
Figure 20:
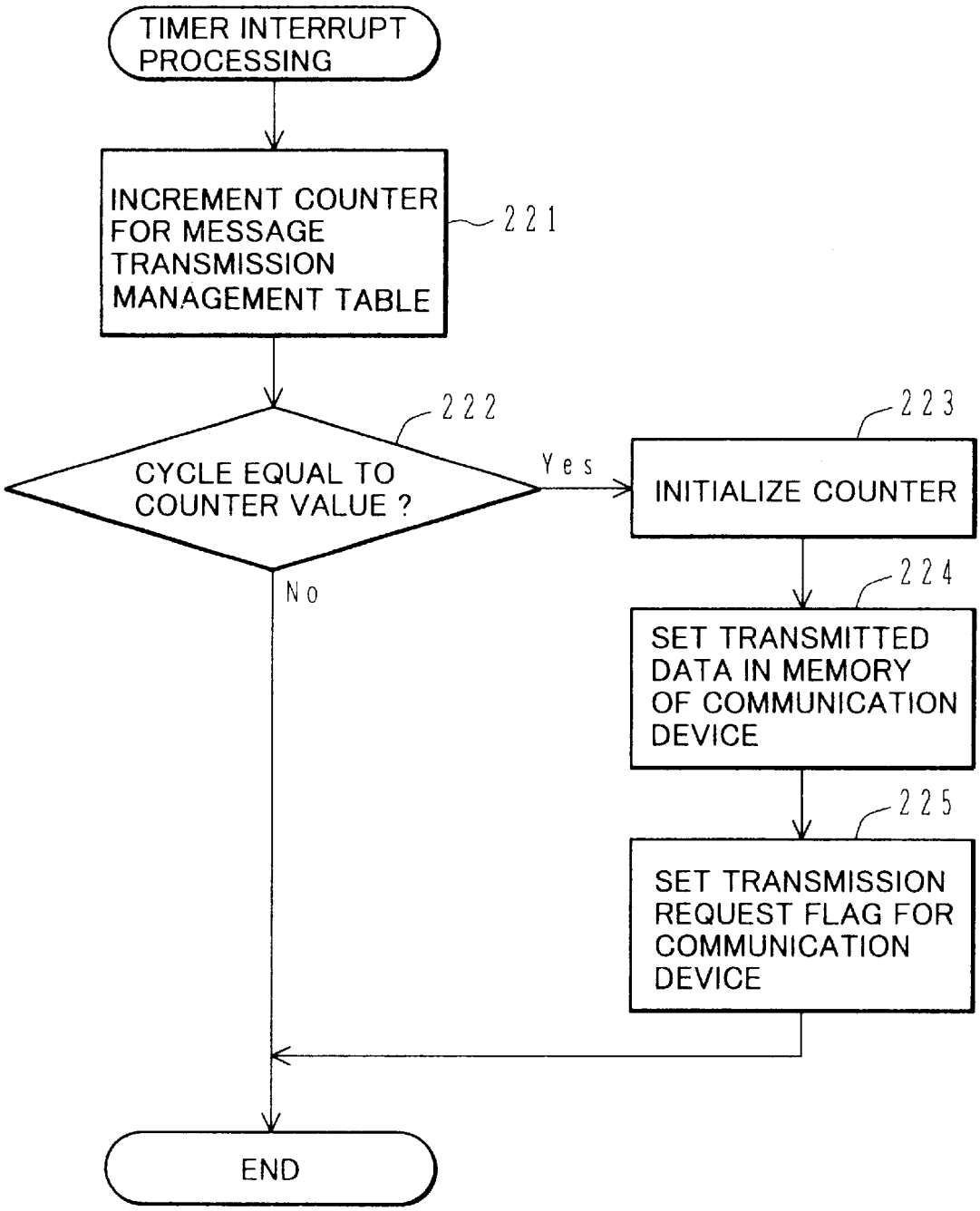
FIG. 20 is a flowchart for explaining the timer interrupt processing (transmission processing) performed by the single-chip microcomputer in each of the first to fourth control units and the display unit.
Figure 21:
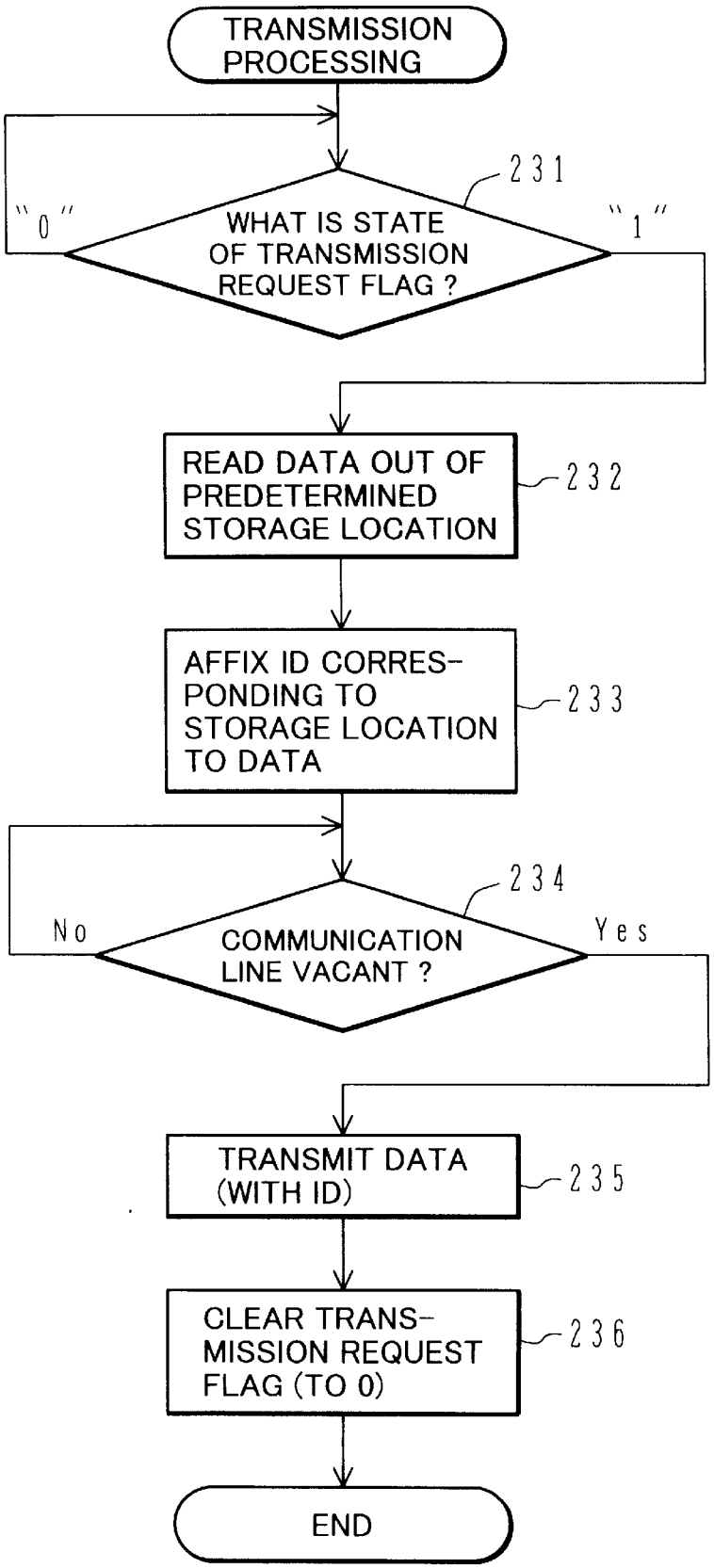
FIG. 21 is a flowchart for explaining transmission processing performed by the communication device in each of the first to fourth control units and the display unit.
Figure 22:
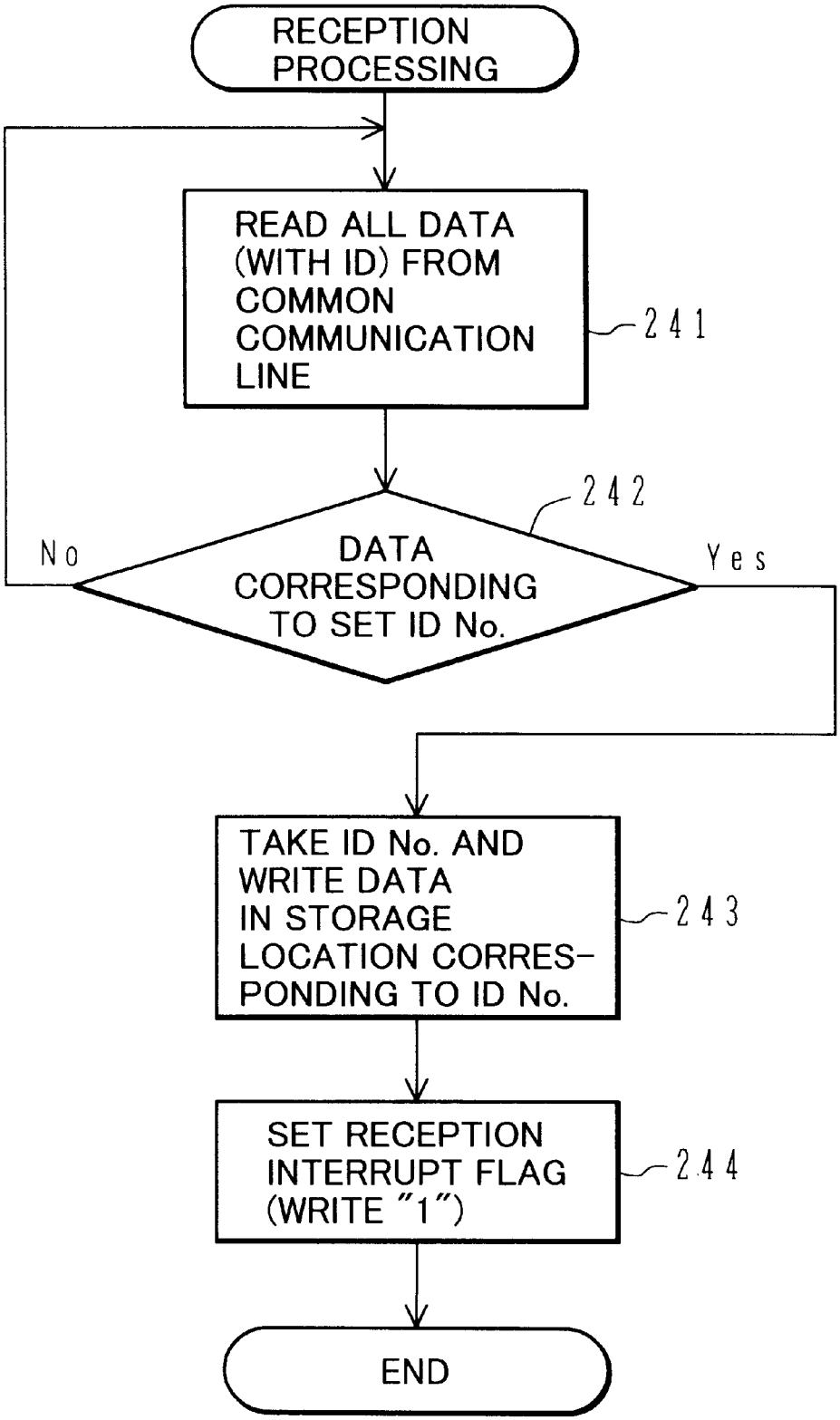
FIG. 22 is a flowchart for explaining reception processing performed by the communication device in each of the first to fourth control units and the display unit.

FIG. 9 shows a software timing chart of computational processing performed by each of the single-chip microcomputers 176, 235, 335, 374, 386 in the first to fourth control units 17, 23, 33, 37 and the display unit 38. Each of the single-chip microcomputers 176, 235, 335, 374, 386 generates a timer interrupt at intervals of a certain time, e.g., 1 ms, using a timer (not shown) to interrupt main processing, and starts up a timer interrupt processing program. Also, when any of the communication devices 178, 237, 337, 375, 389 generates a reception interrupt signal, the corresponding single-chip microcomputer interrupts the main processing and starts up a reception interrupt processing program.

FIGS. 10–19 show a message definition table and a message transmission management table prepared in the first to fourth control units 17, 23, 33, 37 and the display unit 38 for transmitting a message to the other control units at intervals of a certain time and receiving a necessary message when messages are transmitted from the other control units. In these tables, a group of data to be transmitted or received is referred to as a "message".

First, in the first control unit 17, the ROM 172 stores a message definition table in which whether to transmit or receive the message and a transmission cycle are described as shown in FIG. 10. Also, based on the message definition table, a message transmission management table, in which the transmission cycle of the transmitted message and the counter are described as shown in FIG. 11, is created during initialization after start-up.

Then, in the second control unit 23, the ROM 232 stores a message definition table in which whether to transmit or receive the message and a transmission cycle are described as shown in FIG. 12. Also, based on the message definition table, a message transmission management table, in which the transmission cycle of the transmitted message and the counter are described as shown in FIG. 13, is created during initialization after start-up.

Further, in the third control unit 33, the ROM 332 stores a message definition table in which whether to transmit or receive the message and a transmission cycle are described as shown in FIG. 14. Also, based on the message definition table, a message transmission management table, in which the transmission cycle of the transmitted message and the counter are described as shown in FIG. 15, is created during initialization after start-up.

Further, in the fourth control unit 37, the ROM 372 stores a message definition table in which whether to transmit or receive the message and a transmission cycle are described as shown in FIG. 16. Also, based on the message definition table, a message transmission management table, in which the transmission cycle of the transmitted message and the counter are described as shown in FIG. 17, is created during initialization after start-up.

Further, in the display unit 38, the ROM 383 stores a message definition table in which whether to transmit or receive the message and a transmission cycle are described as shown in FIG. 18. Also, based on the message definition table, a message transmission management table, in which the transmission cycle of the transmitted message and the counter are described as shown in FIG. 19, is created during initialization after start-up.

In the above message definition tables and message transmission management tables, each transmitted or received message (data) is assigned with a specific ID number for management. The ID number is used by the control unit on the receiving side for identifying the message (data).

Also, in the above message definition tables, the transmission cycle (transmission time interval) of the transmitted message is set depending a varying speed of respective data or the cycle required for the control unit receiving the data (as described later).

The operation in the case of transmitting data will be described, taking the second control unit 23 as an example.

During initialization after start-up, the second control unit 23 creates the message transmission management table shown in FIG. 13 from the message definition table shown in FIG. 12. The second control unit 23 generates a timer interrupt at intervals of a certain time using the timer as described above, and starts up a timer interrupt processing program shown in FIG. 20. The timer interrupt processing program executes the following procedures.

First, the counter in the transmission management table shown in FIG. 13 is incremented upon each timer interrupt (step 221). It is then determined whether the counter value has become equal to the number n of timer interrupts corresponding to the transmission cycle in the transmission management table shown in FIG. 13 (step 222). Where the time interval for timer interrupts is set to 1 ms as described above, n=cycle is held. It is therefore just required to determine in step 222 whether the counter value has become equal to the transmission cycle. Because the cycle is "8" in the example of the transmission management table shown in FIG. 13, it is determined whether the counter value has become "8". If the counter value has become equal to the transmission cycle, the counter is initialized (step 223), and data (θ and Pd) to be transmitted is transferred from the RAM 233 shown in FIG. 3 to the memory 80 in the communication device 237 and then written in the storage location corresponding to the ID number of the data in the memory 80 (step 224). Next, a transmission request flag in the communication controller 81 of the communication device 237 is turned to "1" (set) (step 225), thereby ending the processing.

The communication device 237 converts the data, on which the transmission request flag has been set, into time-serial data and outputs the time-serial data to the common communication line 39 for supplying the data to the other control units. The operation of the communication device 238 on that occasion will be described with reference to a flowchart of FIG. 21.

First, the communication controller 81 determines the state of the transmission request flag (step 231). If the transmission request flag is turned to "1" (set), i.e., if transmission is instructed from the microcomputer side, the communication controller 81 reads data out of a storage location at which the transmission request flag is set (step 232), and affixes an ID number corresponding to the storage location to the data (step 233). Then, the communication controller 81 determines whether the common communication line 39 is vacant. If the communication line 39 is vacant, the communication controller 81 transmits the data affixed with the ID number to the common communication line 39 via the transmission line 85 (step 235). Thereafter, the communication controller 81 clears the transmission request flag (to 0), thereby indicating the end of transmission (step 236).

The data transmission processing is completed through the above-described procedures.

While the above processing has been described in connection with the second control unit 23, the other control units and the display unit can also transmit data at respective set cycles in a similar manner as described above.

The operation in the case of receiving data will be described, taking the second control unit 23 likewise as an example.

The controller 81 of the communication device 237 receives data from the common communication line 39 and takes in only necessary items of the received data. The details will be described with reference to the flowchart of FIG. 22.

When receiving data, the communication controller 81 first receives all of data once (step 241). Then, the ID numbers affixed to the received data are compared with the ID numbers set by the single-chip microcomputer 235 beforehand (step 242), and if both the ID numbers coincide with each other, the data is written in a storage location of the memory 80 corresponding to that ID number (step 243). At the same time, the communication controller 81 transmits an interrupt signal to the single-chip microcomputer 235 via the interrupt signal line 83 for notifying the fact that the data has been received, and turns a reception interrupt flag to "1" (step 244).

Figure 23:
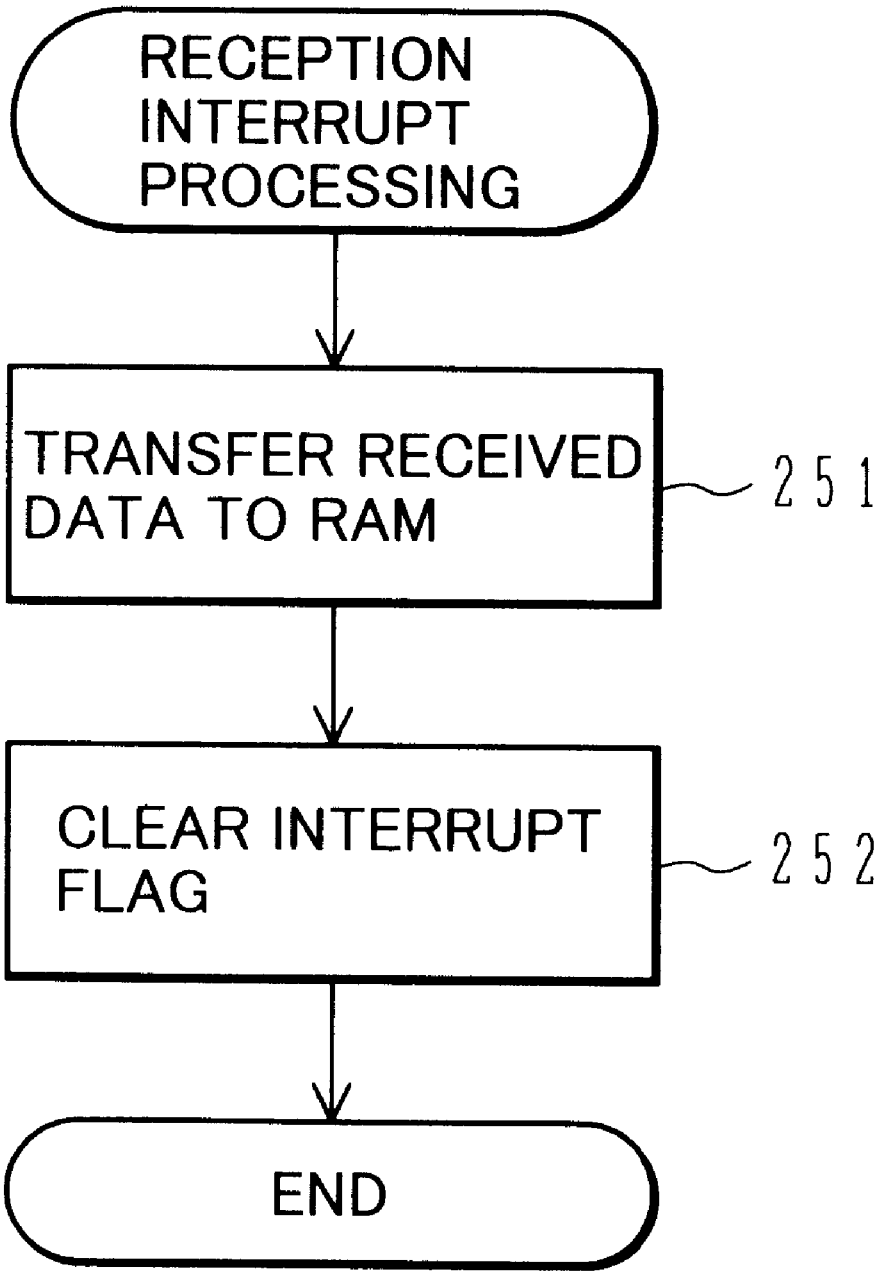
FIG. 23 is a flowchart for explaining the reception interrupt processing performed by the single-chip microcomputer in each of the first to fourth control units and the display unit.

When the reception interrupt is received from the communication device 237 and the reception interrupt flag is set, the microcomputer 235 automatically starts a reception interrupt processing program shown in FIG. 23. The reception interrupt processing program executes the following procedures.

First, the microcomputer 235 transfers the received data, which has been written in the memory 80 of the communication device 237, to the RAM 233 (step 251). Then, the microcomputer 235 clears the reception interrupt flag (writes "0" as a flag level) in the communication device 237 (step 252).

With the above-described processing of transferring the received data to the RAM 233, it becomes possible to execute a control program as the main processing (described later) by utilizing the received data.

The above data receiving processing is also performed in the other control units 17, 33, 37 and the display unit 38 through similar procedures.

Incidentally, the communicating method is not limited to the above-described one, and the communication devices 178, 237, 337, 375, 389 can also be implemented with any other suitable method. Further, the function of the communication controller 81 can also be realized using software in the microcomputer in accordance with an ordinary serial communicating method.

In each of the message definition tables shown in FIGS. 10, 12, 14, 16 and 18, the transmission cycle (transmission time interval) of the transmitted message is decided in consideration of the cycle required for the message from the control point of view, or a varying speed of data or a frequency of variation thereof.

In FIG. 10, for example, because the actual revolution speed Ne and the target revolution speed Nr of the prime mover 14 transmitted by the first control unit 17 has a relatively low frequency of variation, the transmission cycle is set to 50 ms.

In FIG. 12, because the delivery pressure signal Pd and the swash-plate position signal θ for the hydraulic pump 18 transmitted by the second control unit 23 has a relatively high varying speed, the transmission cycle is set to 8 ms.

In FIG. 14, because the operation signals X1, X2, X3 transmitted by the third control unit 33 have a relatively high varying speed, and because a period of about 10 ms is required for control computation for the excavating device 7 performed in the fourth control unit 37 or computation of the target swash-plate tilting angle θr of the hydraulic pump 18 performed in the second control unit 23, the transmission cycle for each of the operation signals X1, X2, X3 is set to about 10 ms.

In FIG. 16, because the control driving commands Yα, Yβ, Yγ transmitted by the fourth control unit 37 has a relatively high varying speed, and because a period of about 10 ms is required for computation to modify the operation signals X1, X2, X3 which is performed in the third control unit 33, the transmission cycle for each of the control driving commands Yα, Yβ, Yγ is set to about 10 ms. Also, because the actual depth h is a numerical value displayed on the display unit 38 and is not required to be adapted for a so quick change, the transmission cycle for the actual depth h is set to about 100 ms.

In FIG. 18, because a target locus hr of the excavating device 7 transmitted from the display unit 38 to the fourth control unit 37 and employed In the fourth control unit 37 is hardly changed once set, a period of about 100 ms is sufficient for transmitting the target locus hr and therefore the transmission cycle is set to such a value. Also, because an automatic operation command $C_{auto}$ transmitted from the display unit 38 to the third control unit 33 and the fourth control unit 37 is also hardly changed, the transmission cycle for the automatic operation command $C_{auto}$ is set to about 100 ms.

In each of the message definition tables shown in FIGS. 10, 12, 14, 16 and 18, ( ) added on the right side of a row of each received message represents an initial value for use in starting up the control unit. In the present invention, the initial value is appropriately set so that each control unit can perform computational processing using the set initial value and fulfill the least necessary function. As a result, each control unit can always have a minimum processing function to eliminate or minimize change of software when the number of control units is increased or decreased, thereby enabling the control units to be easily increased or decreased in number. A value with which the control unit can fulfill the least necessary function is varied depending on the types of control units, and hence the initial value is set to a different value for each of the control units in spite of the message (data) having the same name.

More specifically, in FIG. 12, initial values of the operation signals X1, X2, X3 and the actual revolution speed Ne and the target revolution speed Nr of the prime mover 14, which are received by the second control unit 23, are set as follows when these message are not received, so that the hydraulic pump 18 delivers the hydraulic fluid at a maximum flow rate under horsepower control using the delivery pressure signal Pd:

X1=XFULL (maximum input amount)

X2=XFULL (maximum input amount)

X3=XFULL (maximum input amount)

Ne=NMAX (maximum revolution speed)

Nr=NMAX (maximum revolution speed)

Also, in FIG. 14, the automatic operation command $C_{auto}$ and the control driving commands Yα, Yβ, Yγ, which are received by the third control unit 33, are set as follows when these message are not received, so that the control valves 24, 25, 26 can be driven by manual operation of the control levers 27, 28, 29:

$C_{auto}$=OFF

Yα=0

Yβ=0

Yγ=0

Further, in FIG. 16, the target locus hr of the excavating device 7, the automatic operation command $C_{auto}$, the operation signals X1, X2, X3, the delivery pressure signal Pd and the swash-plate position signal θ for the hydraulic pump 18, and the actual revolution speed Ne of the prime mover 14, which are received by the fourth control unit 37, are set as follows when these message are not received, so that working locus control of the excavating device 7 is not performed:

hr=$h_{out}$ (numerical value outside the reachable region of the excavating device 7)

$C_{auto}$=OFF

X1=0

X2=0

X3=0

θ=θMAX (maximum tilting angle)

Pd=$P_{normal}$ (average delivery pressure for ordinary excavation, e.g., 200 Kg/cm$^2$)

Ne=NMAX (maximum revolution speed)

Still further, in FIG. 18, the actual depth h received by the display unit 38 is set as follows when this message is not received, so that nothing is displayed on the display screen 387*a*:

h=$h_{out}$ (numerical value outside the reachable region of the excavating device 7)

The above-described initial values are each stored in the ROM or EEPROM of the corresponding control unit.

The control operation of main processing in the single-chip microcomputers 176, 235, 335, 374, 386 and the first to fourth control units 17, 23, 33, 37 and the display unit 38 will be next described.

First, the control operation of the first control unit 17 performed for the prime mover 14 will be described with reference to a flowchart of FIG. 24.

Figure 24:
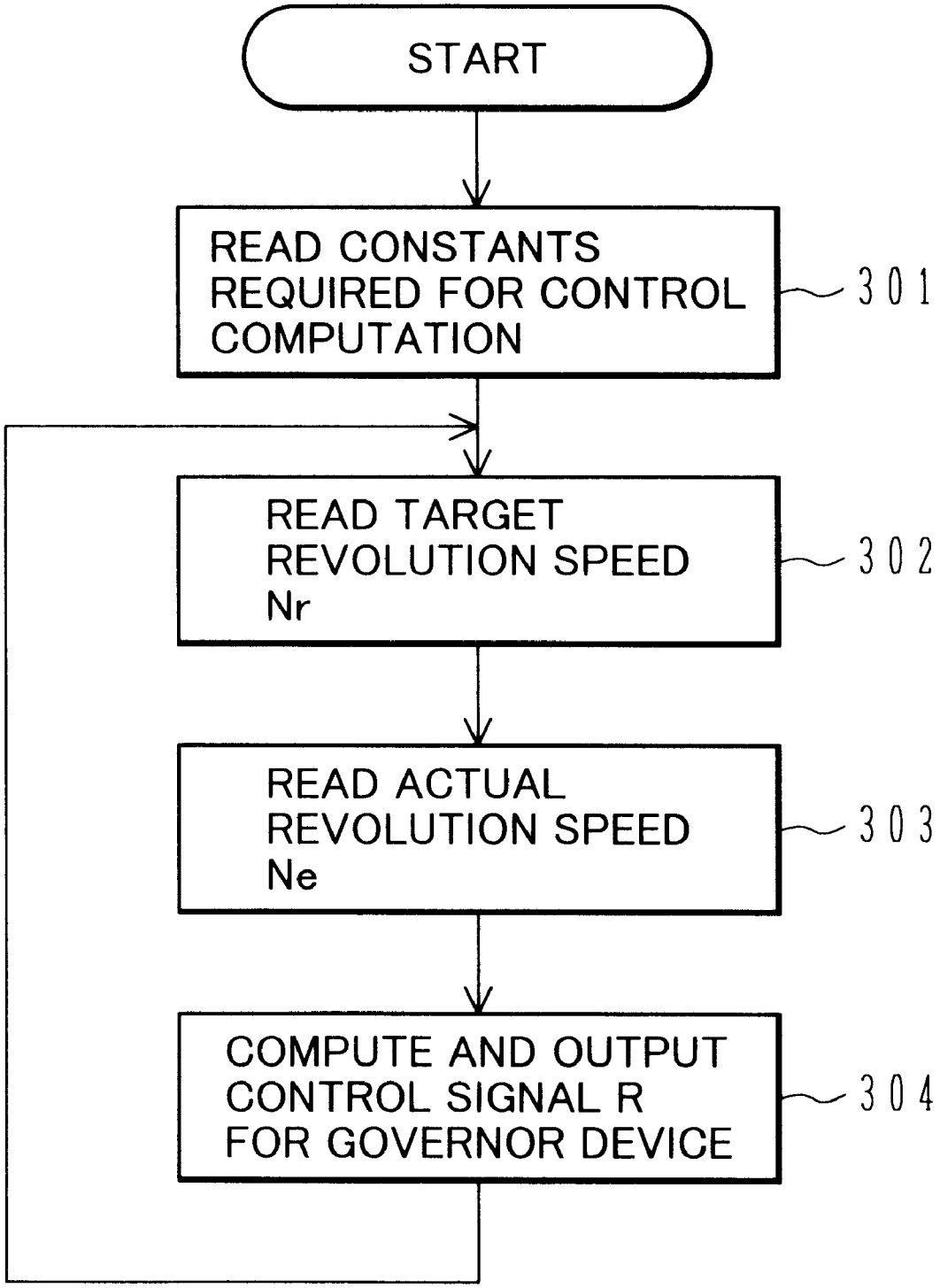
FIG. 24 is a flowchart for explaining the main processing (control operation) in the first control unit.

In FIG. 24, the first control unit 17 first reads constants required for control computation from the ROM 172 or the EEPROM 179 shown in FIG. 2 (step 301). Then, the first control unit 17 reads the target revolution speed Nr from the target revolution speed setting unit 16 through the A/D converter 170 (step 302). Then, the first control unit 17 receives the actual revolution speed Ne of the prime mover 14 from the governor device 15 through the counter 175 (step 303). Then, the first control unit 17 computes the control signal R so that the actual revolution speed Ne coincides with the target revolution speed Nr, and outputs the control signal R to the governor device 15 through the D/A converter 174 and the amplifier 177 shown in FIG. 2, thereby controlling the revolution speed of the prime mover 14 to be coincident with the target revolution speed Nr (step 304). Thereafter, the first control unit 17 returns to step 302 and repeats the above-described processing.

During the above-described processing, the target revolution speed Nr and the actual revolution speed Ne of the prime mover 14, which are read by the first control unit 17, are transmitted to the control units 23, 33, 37 and the display unit 38 via the common communication line 39 in accordance with the transmitting method described above.

Next, the control operation of the second control unit 23 performed for the hydraulic pump 18 will be described with reference to a flowchart of FIG. 25.

Figure 25:
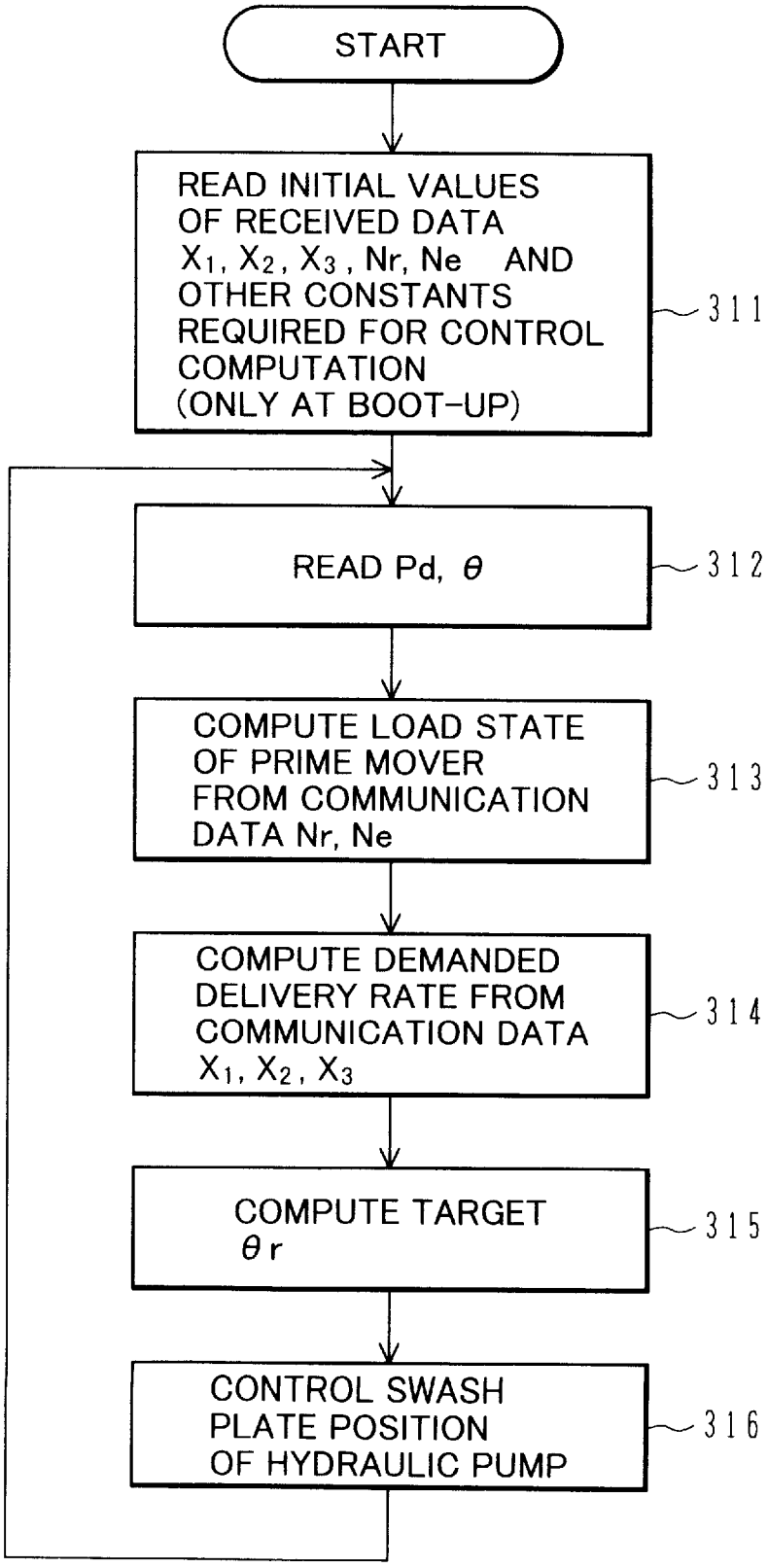
FIG. 25 is a flowchart for explaining the main processing (control operation) in the second control unit.

In FIG. 25, the second control unit 23 first reads the initial values of the received data X1, X2, X3, Nr, Ne and other constants required for control computation, which are used in the second control unit 23, from the ROM 232 or the EEPROM 238 shown in FIG. 3 (step 311). Then, the second control unit 23 reads the pressure signal Pd from the pressure sensor 22 and the swash-plate position signal θ from the swash-plate position sensor 21 through the A/D converter 230 (step 312). Then, the second control unit 23 computes a load status of the prime mover 14 using the target revolution speed Nr and the actual revolution speed Ne which are data received from the first control unit 17 (step 313). Then, the second control unit 23 computes a delivery rate of the hydraulic fluid demanded by the hydraulic pump 18 based on the control-lever operation signals X1, X2, X3 which are data received from the third control unit 33 (step 314).

Then, based on the demanded delivery rate of the hydraulic pump 18 computed in step 314, the second control unit 23 computes a deliverable rate of the hydraulic pump 18 from both the load status of the prime mover 14 computed in step 313 and the pressure signal Pd from the pressure sensor 22 read in step 312, and calculates a target swash-plate tilting signal θr from the computed deliverable rate (step 315). Then, the second control unit 23 computes a control signal so that the swash-plate position signal θ coincides with the target swash-plate tilting signal θr, and outputs the control signal to the delivery rate regulator 20 through the interface (I/O) 234 and the amplifier 236 shown in FIG. 3, thereby controlling the tilting position of the swash plate 19 of the hydraulic pump 18 (step 316). Thereafter, the second control unit 23 returns to step 312 and repeats the above-described processing.

During the above-described processing, the pressure signal Pd and the swash-plate position signal θ for the hydraulic pump 18, which are read by the second control unit 23, are transmitted to the control units 17, 33, 37 and the display unit 38 via the common communication line 39 in accordance with the transmitting method described above.

Also, the target revolution speed Nr and the actual revolution speed Ne used for computing the load status of the prime mover 14 in step 313 and the control-lever operation signals X1, X2, X3 used for computing the demanded delivery rate of the hydraulic pump 18 in step 314 are received via the common communication line 39 in accordance with the receiving method described above.

Here, the target revolution speed Nr and the actual revolution speed Ne are data transmitted from the first control unit 17, and the control-lever operation signals X1, X2, X3 are data transmitted from the third control unit 33. If a system is constructed with exclusion of at least one of the first control unit 17 and the third control unit, the second control unit 23 performs the computation in steps 313 and 314 using the above-described initial values read in step 311 in place of data to be received from the control unit having been excluded, and therefore can fulfill the least necessary processing function. In other words, steps 311, 313, 314 function as a minimum processing means that is able to execute the least necessary processing by itself, when no data is transmitted via the transmission line 39.

Next, the control operation of the third control unit 33 performed for the control levers 27, 28, 29 will be described with reference to a flowchart of FIG. 26.

Figure 26:
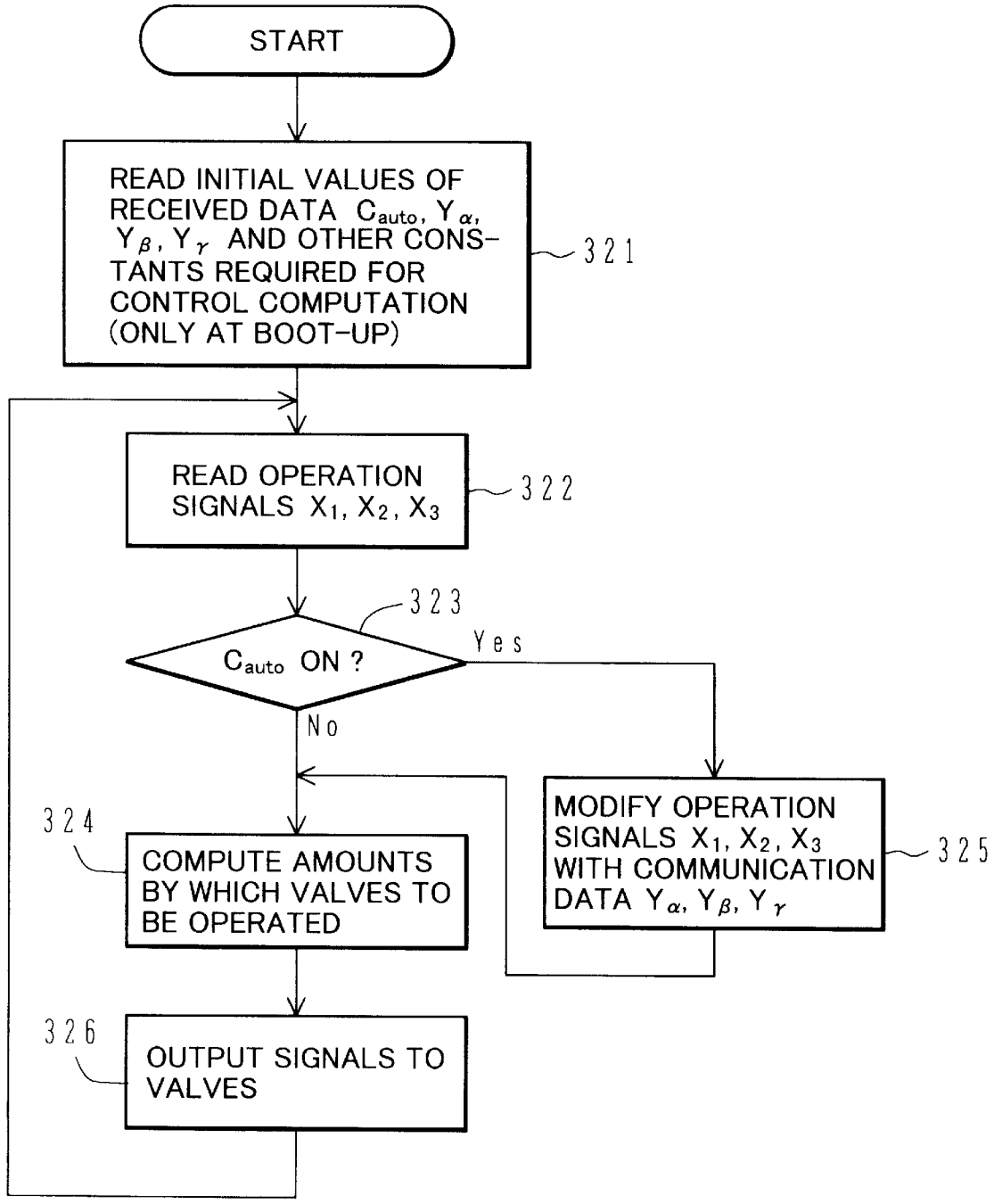
FIG. 26 is a flowchart for explaining the main processing (control operation) in the third control unit.

In FIG. 26, the third control unit 33 first reads the initial values of the received data $C_{auto}$, Yα, Yβ, Yγ and other constants required for control computation, which are used in the third control unit 33, from the ROM 332 or the EEPROM 338 shown in FIG. 4 (step 321). Then, the third control unit 33 reads the operation signals X1, X2, X3 from the lever operating units 30, 31, 32 through the A/D converter 330 (step 322). Then, the third control unit 33 determines whether the automatic operation command $C_{auto}$, which is data received from the display unit 38, is turned on (step 323). If it Is determined that $C_{auto}$ is turned off, the processing goes to step 324, and if it is determined that $C_{auto}$ is turned on, the processing goes to step 325. In step 325, because the automatic operation is instructed, the third control unit 33 modifies the operation signals X1, X2, X3 using the control driving commands Yα, Yβ, Yγ for the excavating device 7 which are data received from the fourth control unit 37.

In step 324, the third control unit 33 computes valve shift amounts by which the control valves are to be shifted in accordance with operation signals. by using the operation signals X1, X2, X3 read in step 322 as they are because the automatic operation is not instructed when $C_{auto}$ is turned off, and by using the operation signals X1, X2, X3 modified in step 325 when $C_{auto}$ is turned on. Then, the third control unit 33 outputs signals corresponding to the valve shift amounts to the control valves 24, 25, 26 through the D/A converter 334 and the amplifier 336 shown in FIG. 4. Thereafter, the third control unit 33 returns to step 322 and repeats the above-described processing.

During the above-described processing, the operation signals X1, X2, X3 read by the third control unit 33 are transmitted to the control units 17, 23, 37 and the display unit 38 via the common communication line 39 in accordance with the transmitting method described above.

Also, the automatic operation command $C_{auto}$ used for determining in step 323 whether the automatic operation is instructed and the control driving commands Yα, Yβ, Yγ used for modifying the operation signals X1, X2, X3 in step 325 are received via the common communication line 39 in accordance with the receiving method described above.

Here, the automatic operation command $C_{auto}$ is data transmitted from the display unit 38, and the control driving commands Yα, Yβ, Yγ are data transmitted from the fourth control unit 37. If a system is constructed with exclusion of at least one of the display unit 38 and the fourth control unit 37, the third control unit 33 performs the determination and computation in steps 323 and 325 using the above-described initial values read in step 321 in place of data to be received from the control unit having been excluded, and therefore can fulfill the least necessary processing function. In other words, steps 321, 323, 325 function as a minimum processing means that is able to execute the least necessary processing by itself, when no data is transmitted via the transmission line 39.

Next, the control operation of the fourth control unit 37 performed for locus control of the excavating device 7 will be described with reference to a flowchart of FIG. 27.

Figure 27:
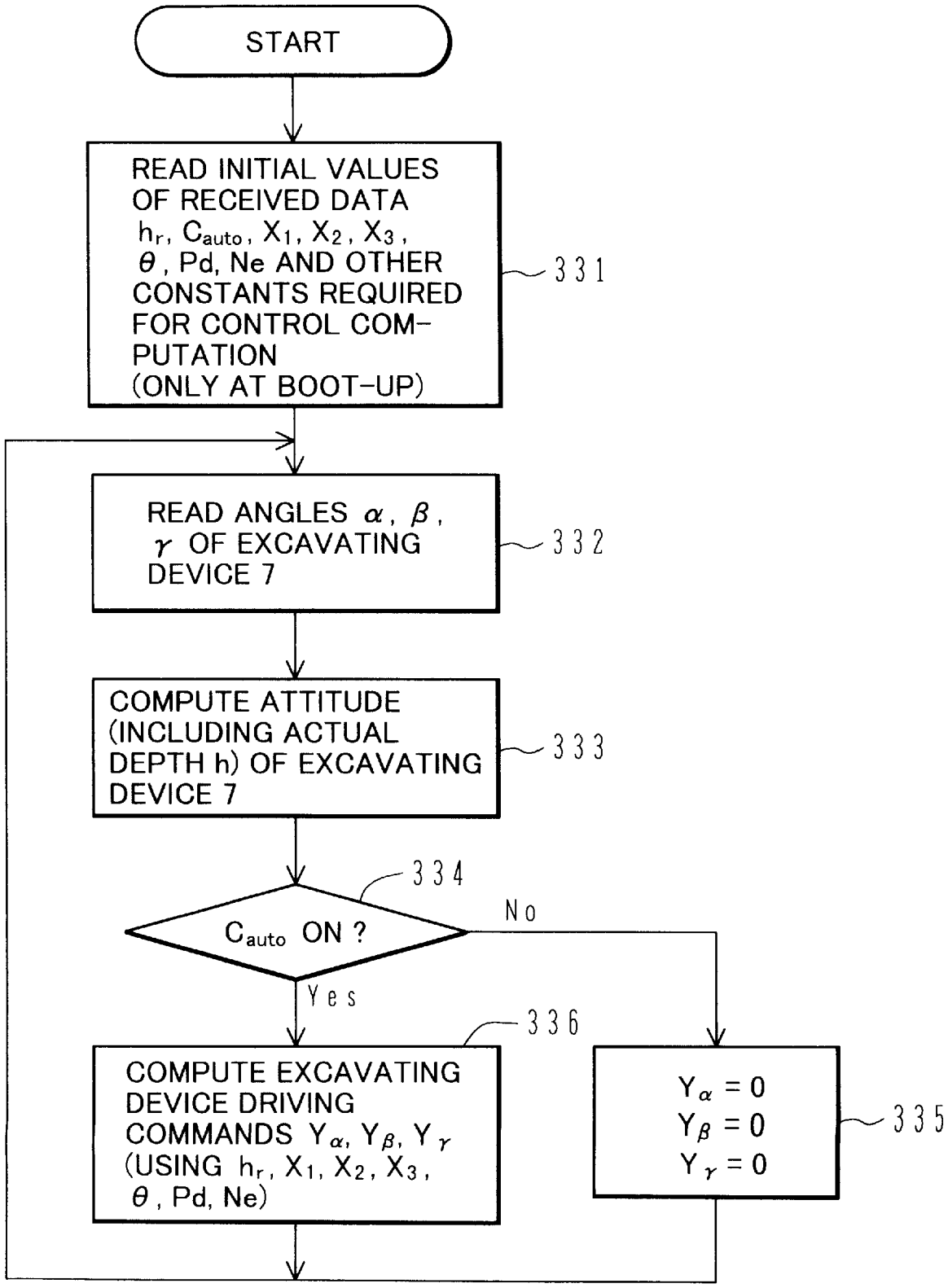
FIG. 27 is a flowchart for explaining the main processing (control operation) in the fourth control unit.

In FIG. 27, the fourth control unit 37 first reads the initial values of the received data hr, $C_{auto}$, X1, X2, X3, θ, Pd, Ne and other constants including dimension data of the excavating device 7 required for computing an attitude of the excavating device 7, which are used in the fourth control unit 37, from the ROM 372 or the EEPROM 376 shown in FIG. 5 (step 331). Then, the fourth control unit 37 reads the boom angle signal α from the boom angle sensor 34, the arm angle signal β from the arm angle sensors 35 and the bucket angle signal γ from the bucket angle sensor 36 through the A/D converter 370 (step 332). Then, the fourth control unit 37 computes an attitude of the excavating device 7 using the dimensions of the components of the excavating device 7 and the angle signals α, β, γ (step 333). This attitude computation includes computation of the excavation depth (bucket end position) h at that time.

Then, the fourth control unit 37 determines whether the automatic operation command $C_{auto}$, which is data received from the display unit 38, is turned on (step 334). If it is determined that $C_{auto}$ is turned off, the processing goes to step 335, and if it is determined that $C_{auto}$ is turned on, the processing goes to step 336.

In step 336, because the automatic operation is instructed, the fourth control unit 37 computes the control driving commands Yα, Yβ, Yγ for the excavating device components (the boom 8, the arm 9 and the bucket 10) to move the excavating device 7 to the target locus hr by using the target locus hr which is data received from the display unit 38, the operation signals X1, X2, X3 which are data received from the third control unit 33, and the attitude of the excavating device 7 computed in step 333. On this occasion. more precise control can be achieved by referring to the deliverable flow rate of the hydraulic pump 18 at that time based on such data as the actual revolution speed Ne of the prime mover 14 which is data received from the first control unit 17, and the delivery pressure signal Pd and the swash-plate position signal θ for the hydraulic pump 18 which are data received from the second control unit 23.

In step 335, because the automatic operation is not instructed, the control driving commands Yα, Yβ, Yγ used in the above process are not required, and hence the control driving commands Yα, Yβ, Yγ are each set to 0. Thereafter, the fourth control unit 37 returns to step 332 and repeats the above-described processing.

During the above-described processing, the control driving commands Yα, Yβ, Yγ and the actual excavation depth h, which are computed in the fourth control unit 37, are transmitted to the control units 17, 23, 33 and the display unit 38 via the common communication line 39 in accordance with the transmitting method described above.

Also, the automatic operation command $C_{auto}$ used for determining in step 334 whether the automatic operation is instructed, and the target locus hr, the operation signals X1, X2, X3, the actual revolution speed Ne of the prime mover 14, and the delivery pressure signal Pd and the swash-plate position signal θ for the hydraulic pump 18, which are used for computing the control driving commands Yα, Yβ, Yγ, are received via the common communication line 39 in accordance with the receiving method described above.

Here, the automatic operation command $C_{auto}$ and the target locus hr are data transmitted from the display unit 38, and the operation signals X1, X2, X3 are data transmitted from the third control unit 33. The actual revolution speed Ne of the prime mover 14 is data transmitted from the first control unit 17, and the delivery pressure signal Pd and the swash-plate position signal θ for the hydraulic pump 18 are data transmitted from the third control unit 23. If a system is constructed with exclusion of at least one of the first control unit 17 and the second control unit 23, the fourth control unit 37 performs the computation in step 336 using the above-described initial values read in step 331 in place of data to be received from the control unit having been excluded, and therefore can fulfill the least necessary processing function. In other words, steps 331, 336 function as a minimum processing means that is able to execute the least necessary processing by itself, when no data is transmitted via the transmission line 39.

Next, the control operation of the display unit 38 will be described with reference to a flowchart of FIG. 28.

Figure 28:
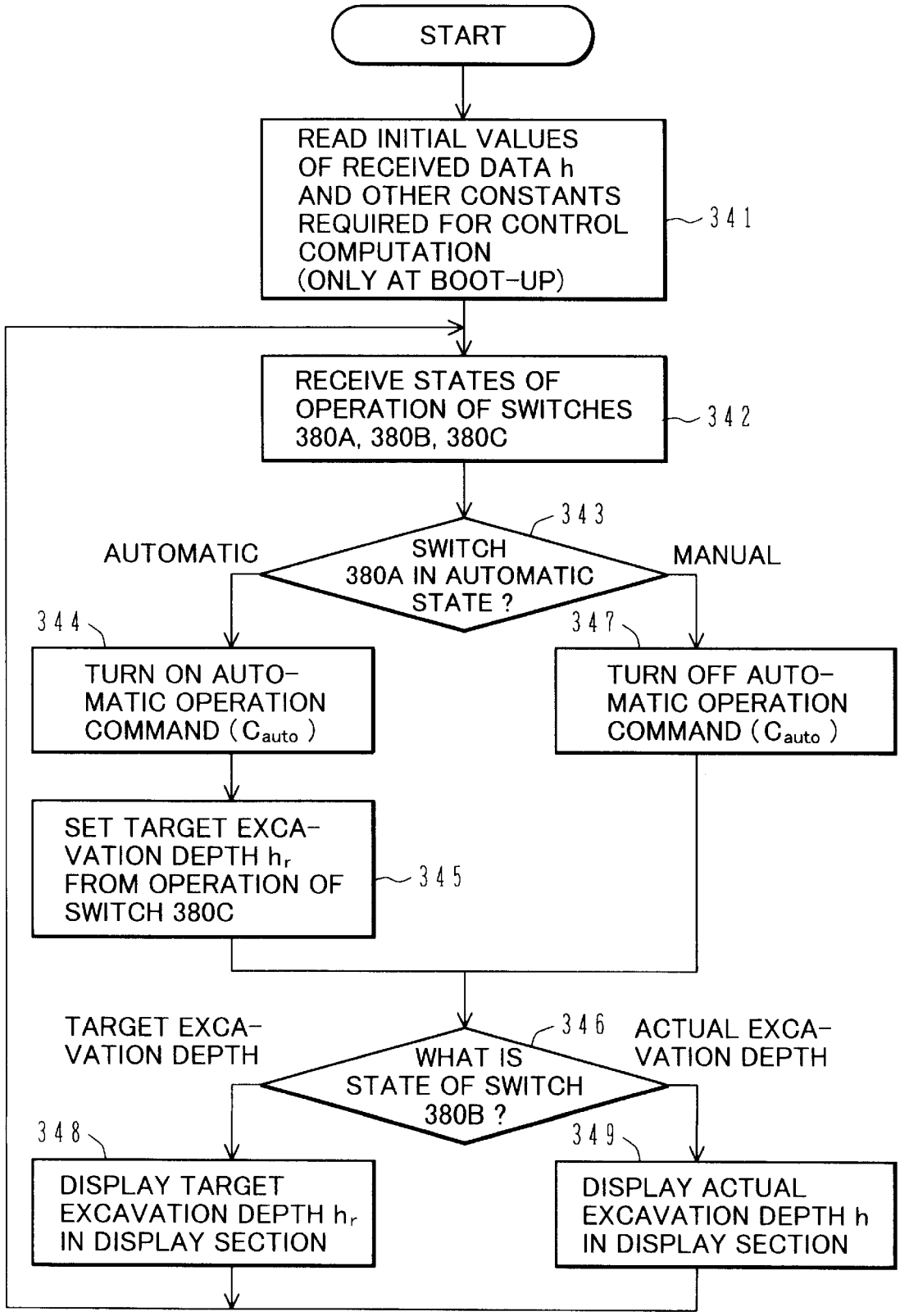
FIG. 28 is a flowchart for explaining the main processing (control operation) in the first control unit.

In FIG. 28, the display unit 38 first reads the initial value of the received data h and other constants required for control computation, which are used in the display unit, from the ROM 383 shown in FIG. 6 (step 341). Then, the display unit 38 receives states of operation of the switches 380A, 380B, 380C shown in FIG. 7 via the I/O 381 shown in FIG. 6 (step 342). Then, the display unit 38 determines based on an input from the switch 380A whether the switch 380A instructs an automatic or manual mode (step 343). If the automatic mode is instructed, the display unit 38 goes to step 344 and turns on the automatic operation command $C_{auto}$. Then, the display unit 38 determines a state of operation of the switch 380C and sets the target excavation depth hr (step 345), followed by going to step 346. If the manual mode is determined in step 343, the display unit 38 goes to step 347 and turns off the automatic operation command $C_{auto}$, followed by going to step 346.

Then, the display unit 38 determines the state of the display changeover switch 380B in step 346. If it is determined that the target excavation depth hr is instructed, the display unit 38 goes to step 348 and displays the target excavation depth hr on the display screen 397*a* of the display section 387. If it is determined in step 346 that the actual excavation depth h is instructed, the display unit 38 goes to step 349 and displays the actual excavation depth h, which is data received from the fourth control unit, on the display screen 397*a*. Thereafter, the display unit 38 returns to step 342 and repeats the above-described processing.

During the above-described processing, the set automatic operation command $C_{auto}$ and target excavation depth hr are transmitted to the control units 17, 23, 33, 37 via the common communication line 39 in accordance with the transmitting method described above.

Also, the actual excavation depth h, which is displayed in step 349, is received via the common communication line 39 in accordance with the receiving method described above.

Here, the actual excavation depth h is data transmitted from the fourth control unit 37. If a system is constructed with exclusion of the fourth control unit 37, the display unit 38 performs the display processing in step 349 using the above-described initial value read in step 341 in place of the actual excavation depth h, and therefore can fulfill the least necessary processing function. In other words, steps 341, 349 function as a minimum processing means that is able to execute the least necessary processing by itself, when no data is transmitted via the transmission line 39.

Figure 29:
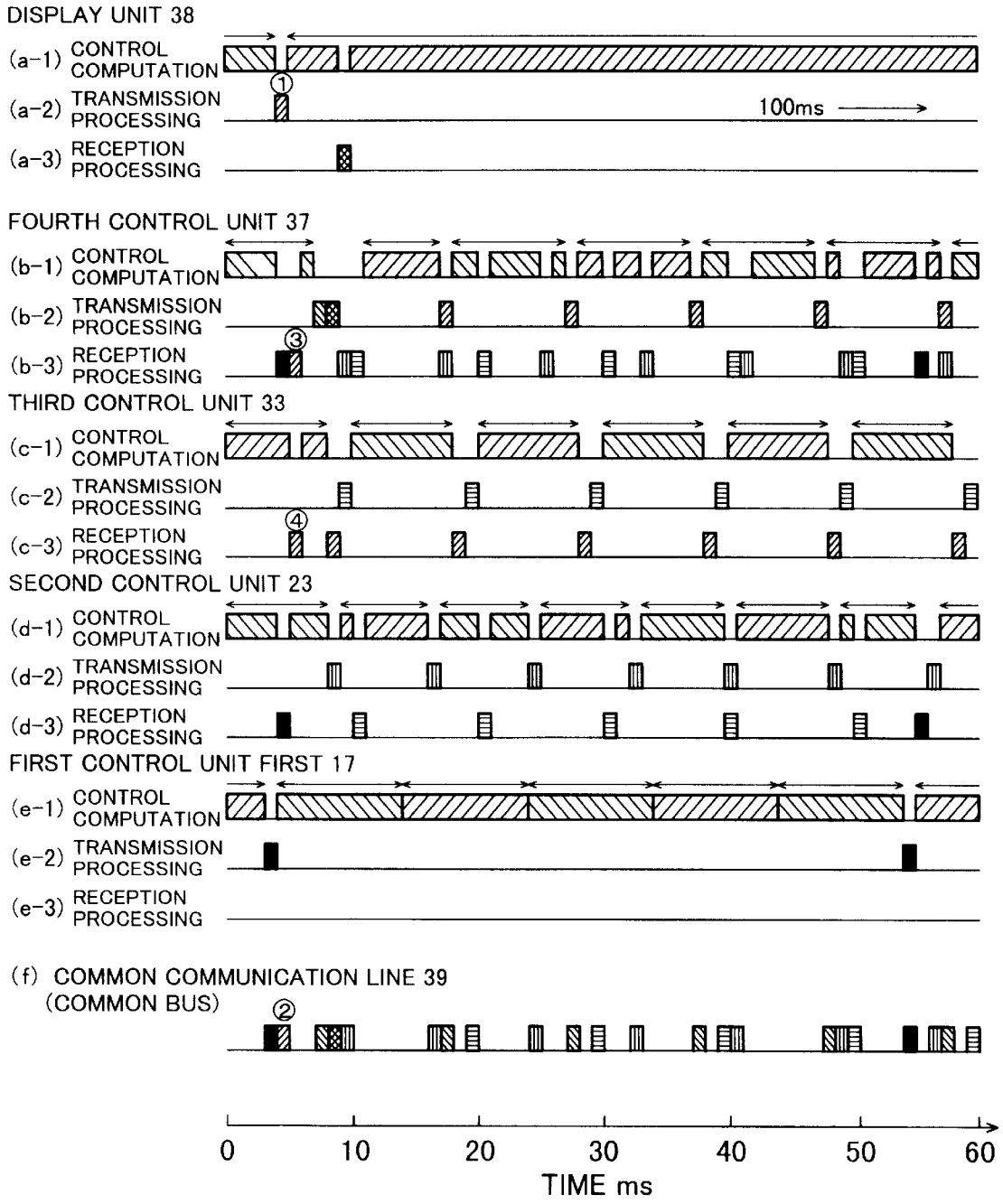
FIG. 29 is a time chart showing communication data flowing over a common communication line and status of control computation in the respective control units during a period in which control computational processing is performed by the first to fourth control units and the display unit.

FIG. 29 is a time chart showing communication data flowing over the common communication line 39 and status of control computation in the respective control units during a period in which control computational processing is performed by the first to fourth control units 17, 23, 33, 37 and the display unit 38 as described above. FIG. 30 is a table listing the relationships in transmission and reception of the communication data among those units, including transmission cycles.

In FIG. 29, (a-1) to (a-3) represent the timed relationship of processing in the display unit 38. Specifically, (a-1) represents the timing of the normal control computational processing, (a-2) represents the timing of the transmission processing, and (a-3) represents the timing of the reception processing. Likewise, (b-1 to -3) represent the timed relationship of processing in the fourth control unit, and (c-1 to -3) represent the timed relationship of processing in the third control unit. Also, (d-1 to -3) represent the timed relationship of processing in the third control unit, and (e-1 to -3) represent the timed relationship of processing in the first control unit. Further, (f) represents situations in flow of data on the common communication line 39 resulting from the transmission processing in the respective control units.

In FIG. 29, for example, $\hat{1}$ in (a-2) represents execution of the processing for transmitting the automatic operation command $C_{auto}$ and the target locus (target excavation depth) hr both created in the display unit 38. As a result, the data flows over the common communication line as indicated by $\hat{2}$ in (f). Correspondingly, the fourth control unit 37 performs the reception processing as indicated by $\hat{3}$, and the third control unit 33 performs the reception processing as indicated by $\hat{4}$. Whether data is to be received or not is determined by the communication device in each control unit, which identifies the ID number affixed to the data.

In this connection, the transmission cycle of each data is set depending on a varying speed of the data or the cycle required for the control unit on the receiving side, as described above, and the data is transmitted at the set transmission cycle while the transmission cycle is managed on the transmitting side. On the other hand, the receiving side identifies necessary items of various data flowing over the common communication line 39 based on the ID numbers, and receives only the necessary data. Therefore, each unit can receive only necessary information at a cycle required from the control point of view, and the amount of data flowing over the common communication line 39 can be held down to the least necessary level. As a result, the common communication line 39 can be utilized efficiently.

Advantages of this embodiment thus constructed will be described below.

(I) First, according to this embodiment, control functions of a hydraulic excavator are divided in units of least necessary function, i.e., a control system for the prime mover 14, a control system for the hydraulic pump 18, an operating system through the control levers 27, 28, 29, a control system for the excavating device 7, and a display system by the display unit 38. Control units, i.e., the first to fourth control units 17, 23, 33, 37 and the display unit 38, are provided in one-to-one relation to those systems, and the first to fourth control units 17, 23, 33, 37 and the display unit 38 are interconnected via the common communication line 39 for transmitting and receiving data. Further, a minimum processing means is provided in each of the second to fourth control units 23, 33, 37 and the display unit 38 which employ received data, so that the least necessary processing can be performed by the minimum processing means when no data is transmitted via the communication line. Such a feature provides advantages as follows.

1. When manufacturing machines that require different functions, it is just needed to change, add or cut the least necessary control unit. Therefore, a system can be changed with the least necessary development cost and the least necessary number of development steps. Also, since the control units are divided for each function, the system is more convenient from the viewpoint of management and the management cost can be reduced.

2. Since a communication section is not so changed, system change can be made with the least necessary development cost and the least necessary number of development steps. Also, troubles accompanying with the system change can be lessened.
3. In relation to above 1, when a system is changed by increasing or reducing the number of control units in one construction machine, change of software and replacement of the control unit(s) are no longer needed, and the development cost and the number of development steps can be held down to a minimum.
4. In relation to above 1. when changing control procedures of control units in one construction machine or when applying an electronic control system to a construction machine having another hydraulic system, replacement of the control unit(s) is reduced to the least necessary level, and the cost and the number of steps required for such a modification can be held down to a minimum.
5. Because of not including a control unit (master controller) which supervises a plurality of control units in a centralized manner, the possibility that a failure in any one of the control units or a trouble of the common communication line may totally disable the other control units can be reduced, and the construction machine can be avoided from stopping the operation even in such an event.

The advantages of above 1 and 3 will be described more concretely with reference to FIGS. 31 and 32.

Figure 31:
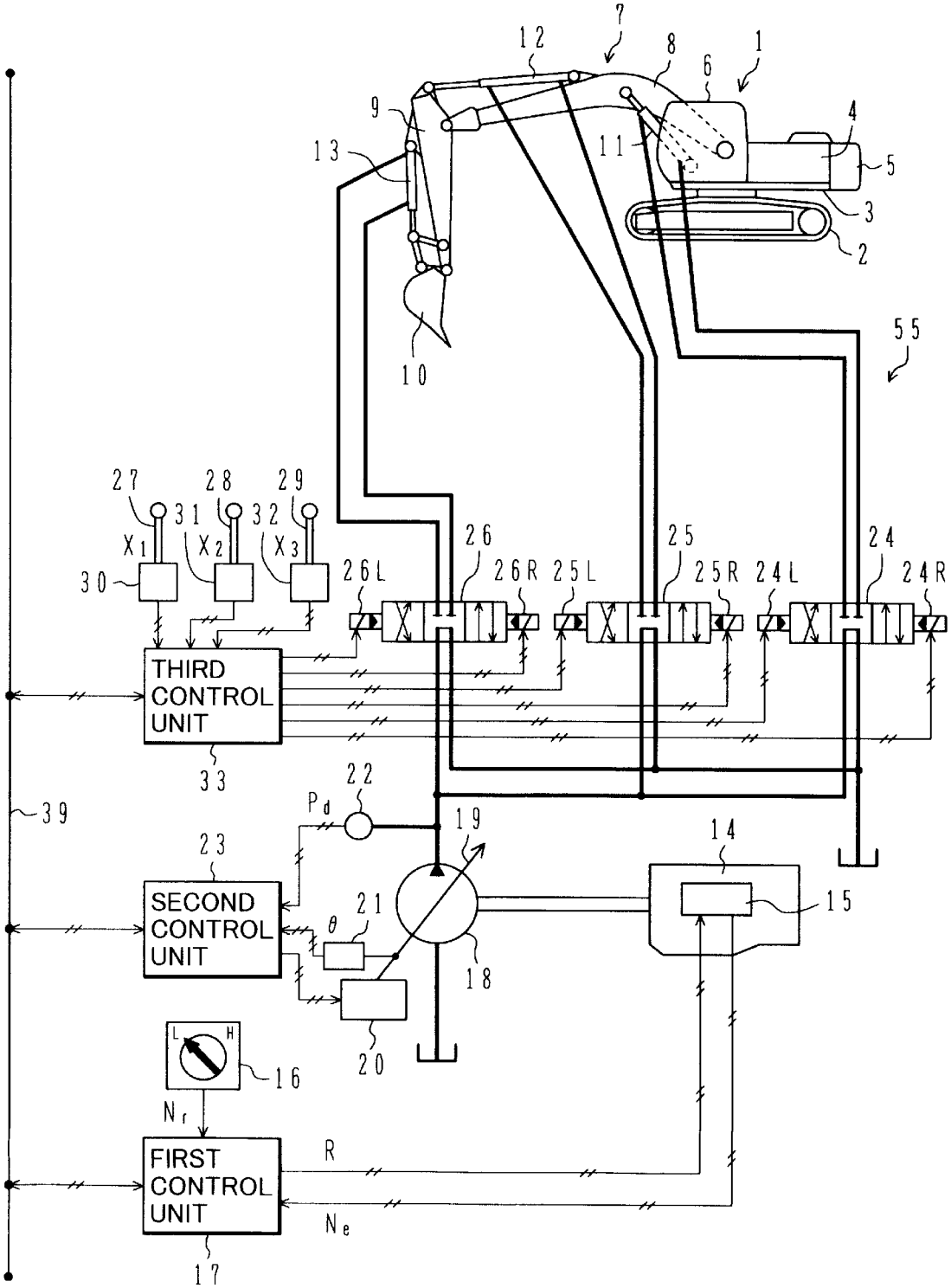
FIG. 31 is a diagram, similar to FIG. 1, showing a modified system in which control units are excluded from the electronic control system shown in FIG. 1.

FIG. 31 shows a modification of the electronic control system in which the fourth control unit 37 and the display unit 38 are excluded from the system of FIG. 1. In this modified system, the data $C_{auto}$, $Y\alpha$, $Y\beta$, $Y\gamma$ are not transmitted which are to be received by the third control unit 33 and used in computation performed therein. However, the third control unit 33 can, as described above, perform the computation using the initial values of those data and perform the least necessary processing.

Figure 32:
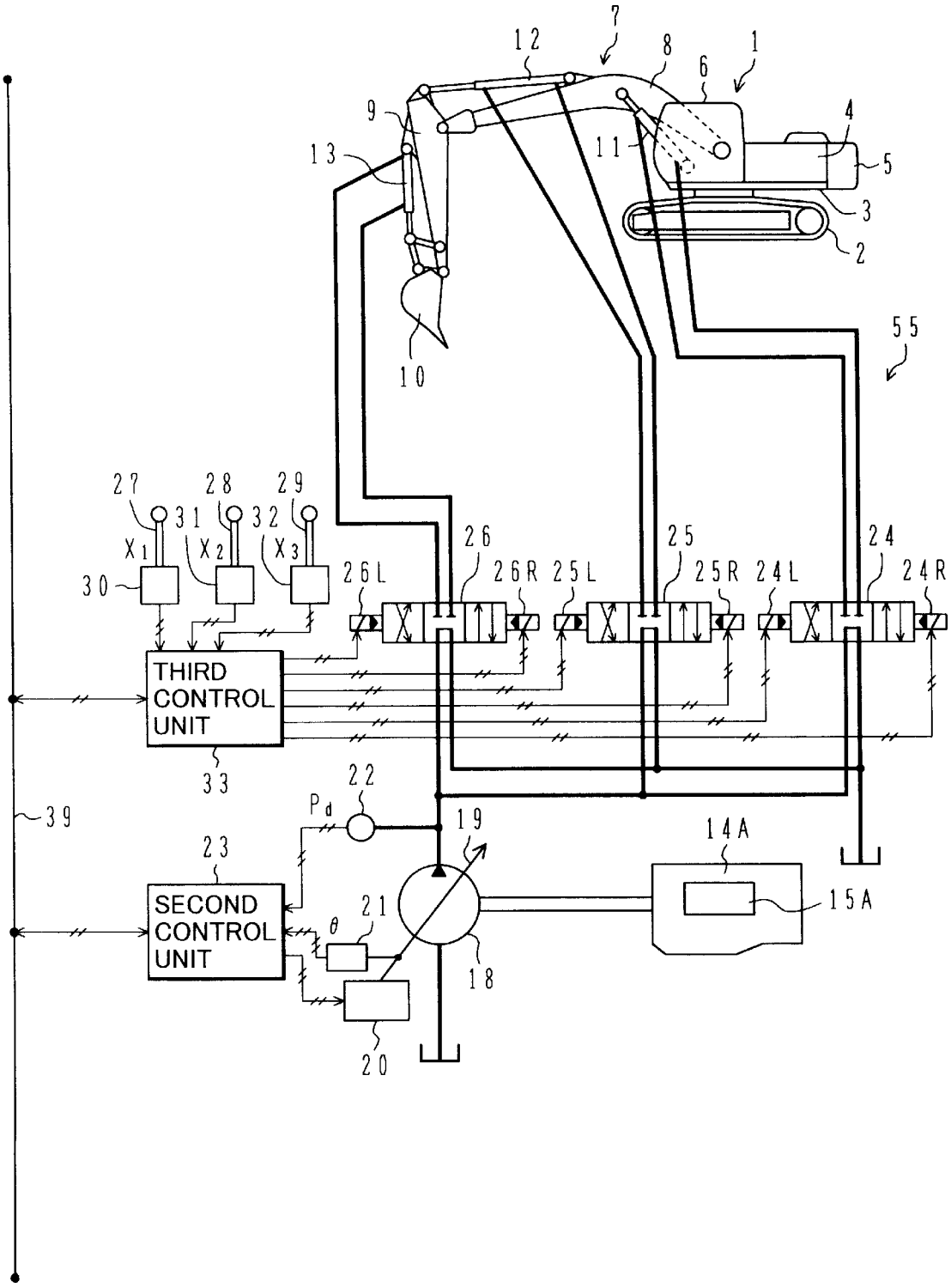
FIG. 32 is a diagram, similar to FIG. 1, showing a modified system in which more control units are excluded from the electronic control system shown in FIG. 1.

FIG. 32 shows a modification of the electronic control system in which the first control unit 17 is further excluded from the system of FIG. 31. In this modified system, the data Ne, Nr are also not transmitted which are to be received by the second control unit 23 and used in computation performed therein. However, the second control unit can, as described above, perform the computation using the initial values of those data and perform the least necessary processing.

In the case of changing (expanding) the system shown in FIG. 31 to the system shown in FIG. 1, just by connecting the fourth control unit 37 and the display unit 38 to the common communication line 39, the third control unit can perform the processing using the data transmitted from those added control units on condition that a program (software) in the third control unit 33 is configured beforehand, as described above, in anticipation of the expansion to the system of FIG. 1. Changing (expanding) the system shown in FIG. 32 to the system shown in FIG. 1 can also be made in a similar way.

Thus, according to this embodiment, since the minimum processing means is provided in each of the second to fourth control units 23, 33, 37 and the display unit 38 which employ received data, the least necessary processing can be performed by the minimum processing means when no data is transmitted via the communication line. Therefore, when a system is changed by increasing or reducing the number of control units, even change of software and replacement of the control unit(s) are no longer needed, and system change is very facilitated.

In relation to the advantages of above 1 and 4, when changing control procedures of control units in one construction machine, it is just needed to remove one or more of the control units (including the display unit), which are subjected to the change, from the common communication line 39 and connect one or more new control units to the communication line 39, while the other control units can be used as they are, as described later in a second embodiment of the present invention with reference to FIG. 33. Further, when applying the electronic control system to a hydraulic excavator having another hydraulic system, it is also just needed to remove only those control units which are associated with a changed section of the hydraulic system, while the other control units can be used as they are, as described later in third to fifth embodiments of the present invention with reference to FIGS. 34 to 36. Especially, even where a particular one of a plurality of control units executes processing using a received signal and a control unit transmitting the signal to be received by the particular control unit is excluded from the system as a result of replacement of one or more control units, the particular control unit is not required to be replaced and the other control units including the particular control unit can be all used as they are, as described later in the third embodiment of the present invention with reference to FIG. 34.

(II) Further, according to this embodiment, as described above, the transmission cycle of each data is set depending on a varying speed of the data or the cycle required for the control unit on the receiving side, and the data is transmitted at the set transmission cycle while the transmission cycle is managed on the transmitting side. Further, the receiving side identifies necessary items of various data flowing over the common communication line 39 based on the ID numbers, and receives only the necessary data. Therefore, each unit can receive only necessary information at a cycle required from the control point of view, and the amount of data flowing over the common communication line 39 can be held down to the least necessary level, thus enabling the common communication line 39 to be utilized efficiently. As a result, even with a plurality of control units connected to the common communication line 39, the control performance is avoided from being affected by a lowering of the communication efficiency. Also, even with an increase in the number of control units, the system is less susceptible to such a trouble as disabling communication due to excessive traffic on the common communication line 39.

Figure 33:
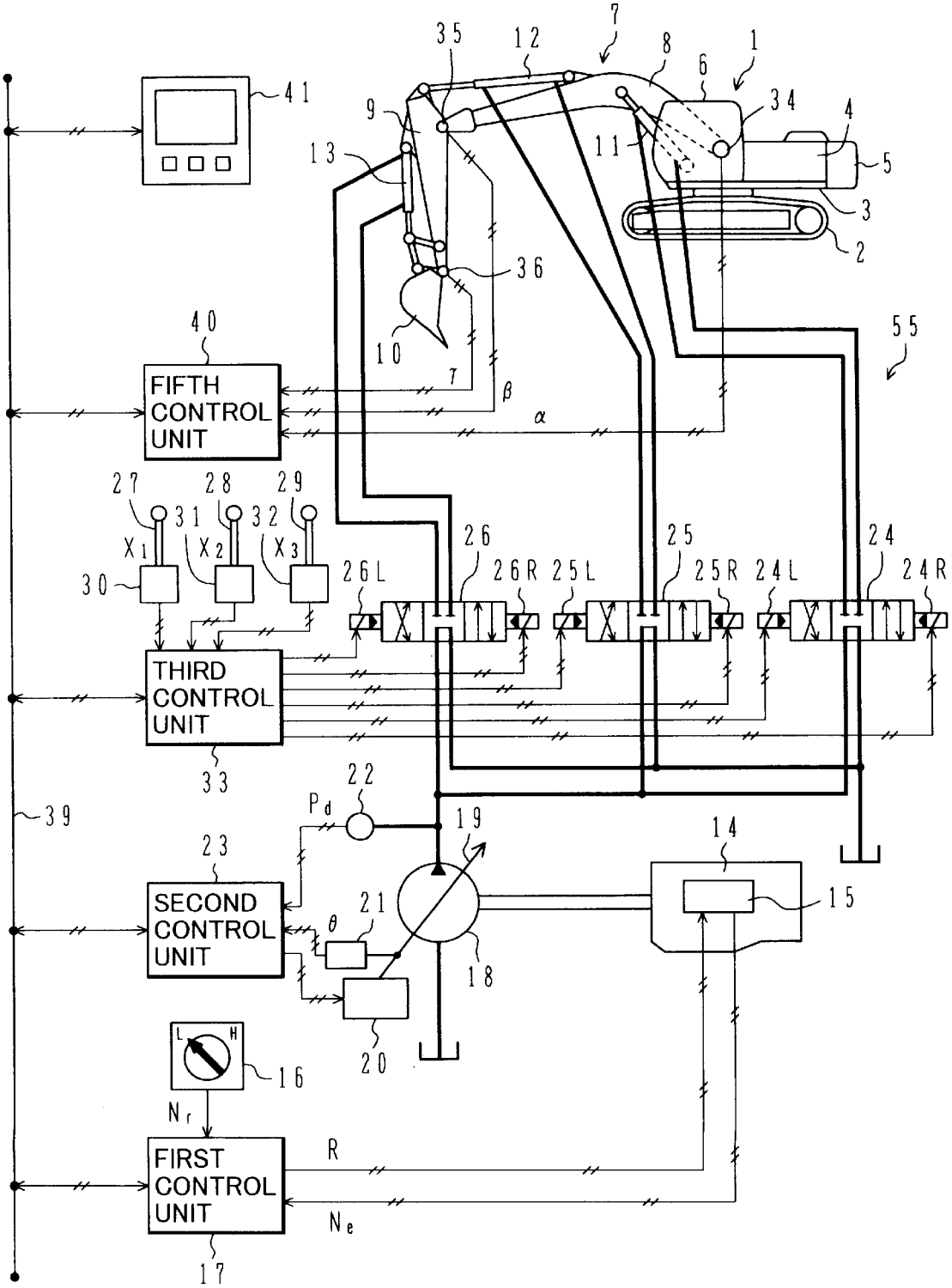
FIG. 33 is a diagram showing an electronic control system for a hydraulic excavator according to a second embodiment of the present invention, along with the hydraulic excavator and a hydraulic system thereof.

FIG. 33 shows, as a second embodiment of the present invention, an electronic control system wherein control procedures of a part of the above-described control units is changed from those in the embodiment shown in FIG. 1. In FIG. 33, the same numerals as those in FIG. 1 denote the same components.

Referring to FIG. 33, the electronic control system of this embodiment differs from the system of the embodiment shown in FIG. 1 in that a fifth control unit 40 for controlling an operating area of the excavating device 7 is provided in place of the fourth control unit 37, and the display unit 38 shown in FIG. 1 is replaced by a display unit 41 correspondingly. In this case, the first control unit 17, the second control unit 23 and the third control unit 33 are the same as those in the embodiment shown in FIG. 1.

In this embodiment, the fifth control unit 40 computes the control driving commands Yα, Yβ, Yγ and the actual excavation depth h for the excavating device 7 in accordance with operating area limiting control. The control driving commands Yα, Yβ, Yγ are transmitted to the third control unit 33, and the actual excavation depth h is transmitted to the display unit 41. Further, the third control unit 33 performs control computation using the received control driving commands Yα, Yβ, Yγ as with that shown in FIG. 1, whereby the operating area limiting control of the excavating device 7 can be performed. The display unit 41 displays the actual excavation depth h.

Thus, with this embodiment, system change from the system shown in FIG. 1 can be easily realized just by replacing the fifth control unit 40 and the display unit 41 without changing the common communication line 39.

In addition, since a communication device and a minimum processing means, which are similar to those in the first embodiment, are provided in each of the control units, this second embodiment can also provide similar advantages as with the first embodiment, such as easy addition and exclusion of one or more control units, appropriate setting of the transmission cycle, and efficient utilization of the common communication line 39 due to identification of received data using ID numbers.

Figure 34:
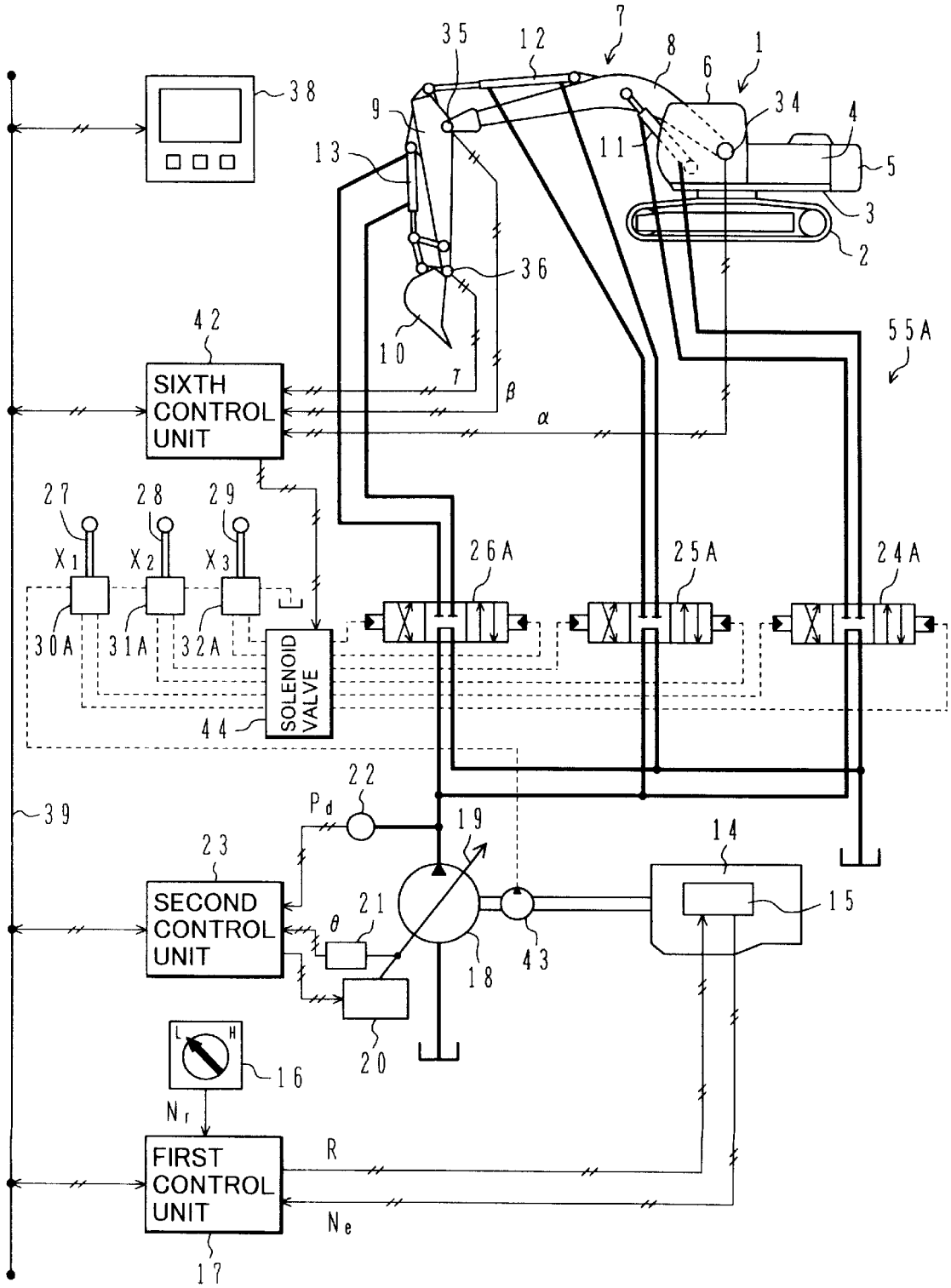
FIG. 34 is a diagram showing an electronic control system for a hydraulic excavator according to a third embodiment of the present Invention, along with the hydraulic excavator and a hydraulic system thereof.

FIG. 34 shows, as a third embodiment of the present invention, an electronic control system wherein a hydraulic system installed in a hydraulic excavator, to which the electronic control system is applied, is changed from the one in the embodiment shown in FIG. 1. In FIG. 34, the same numerals as those in FIG. 1 denote the same components.

Referring to FIG. 34, the electronic control system of this embodiment differs from the system of the embodiment shown in FIG. 1 in that the present invention is applied to a hydraulic excavator 1 including a hydraulic system 55A which comprises control valves 24A, 25A, 26A controlled respectively by hydraulic pilot-operated valves 30A, 31B, 32A. Between the hydraulic pilot-operated valves 30A, 31B, 32A and the control valves 24A, 25A, 26A, a proportional solenoid valve unit 44 is provided for adjusting pilot pressures produced by the hydraulic pilot-operated valves 30A, 31B, 32A with the pilot pressure from an auxiliary pump 43 used as a source pressure.

In the electronic control system of this embodiment which is applied to the hydraulic excavator including the hydraulic system 55A, the fourth control unit 37 for the excavating device 7, shown in FIG. 1, is replaced by a sixth control unit 42 for a hydraulic pilot-operating system, and the third control unit 33 for the operating system is excluded. The proportional solenoid valve unit 44 is controlled by a signal from the sixth control unit 42 to modify the pilot pressures from the hydraulic pilot-operated valves 30A, 31B, 32A, thereby performing the operation control of the excavating device 7. The first control unit 17, the second control unit 23 and the display unit 38 are the same as those in the embodiment shown in FIG. 1.

In this embodiment, the sixth control unit 42 computes the actual excavation depth h, and this data is transmitted to the display unit 38. The display unit 38 displays the actual excavation depth h.

Further, in this embodiment, since the third control unit 33 in the embodiment shown in FIG. 1 is excluded, the second control unit 23 cannot receive the operation signals X1, X2, X3 used in the computation performed therein. However, since a minimum processing means similar to that in the first embodiment is provided in each of the control units, the second control unit 23 can perform the computation using the initial values of the operation signals X1, X2, X3 which are data to be received. Accordingly, there is no need of replacing the second control unit 23.

Thus, even where the control unit 33 transmitting the operation signals X1, X2, X3, which are signals to be received by the second control unit 23 and used for the computation performed therein, is excluded as a result of replacing the fourth control unit 37 by the sixth control unit 42, system change can be easily realized from the electronic control system shown in FIG. 1 to that for the hydraulic system 55A including the hydraulic pilot-operated valves 30A, 31B, 32A, just by removing the third control unit 33 and replacing the fourth control unit 37 by the sixth control unit 42 without changing the common communication line 39.

In addition, since a communication device and a minimum processing means, which are similar to those in the first embodiment, are provided in each of the control units, this third embodiment can also provide similar advantages as with the first embodiment, such as easy addition and exclusion of one or more control units, appropriate setting of the transmission cycle, and efficient utilization of the common communication line 39 due to identification of received data using ID numbers.

Figure 35:
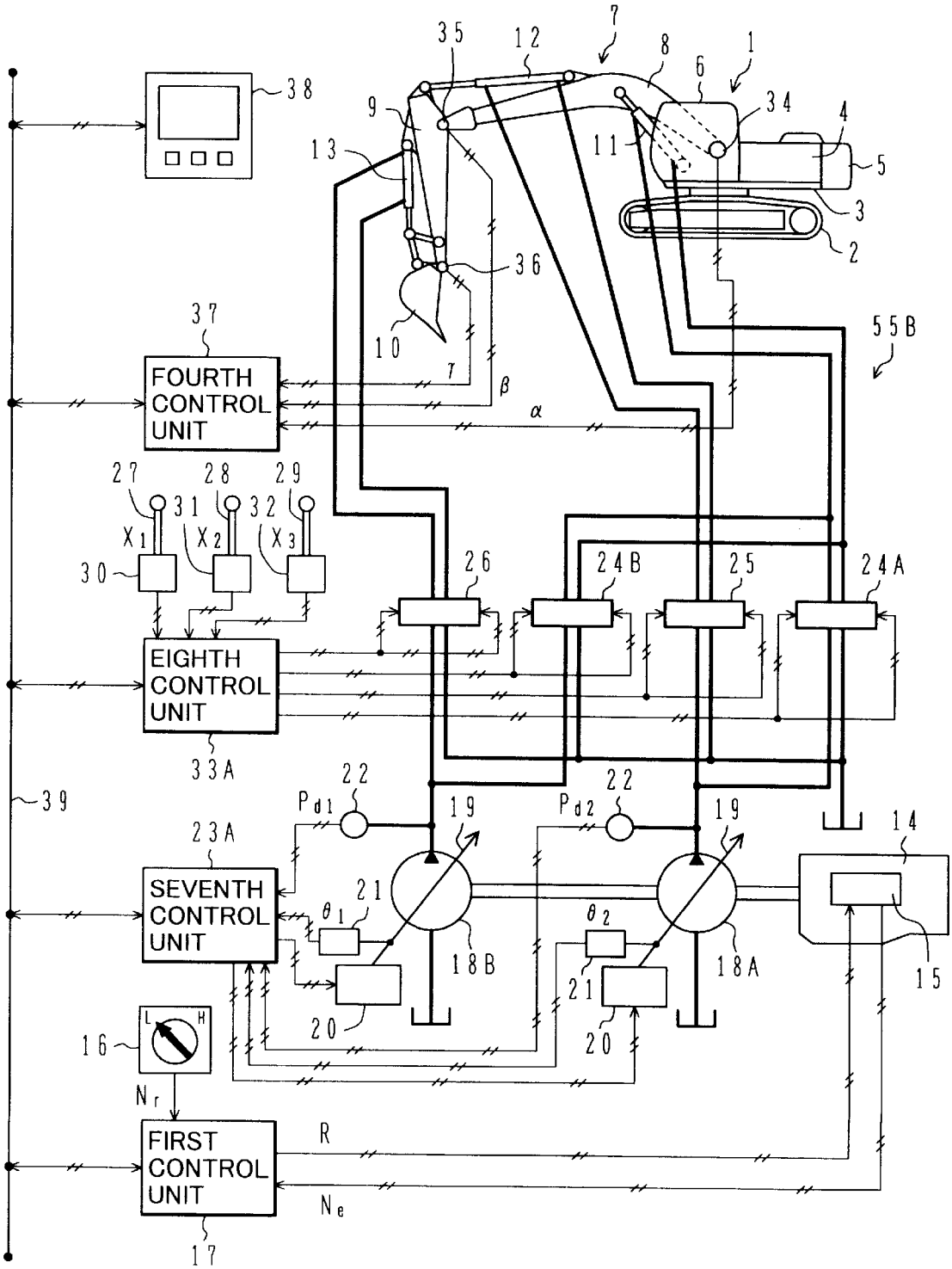
FIG. 35 is a diagram showing an electronic control system for a hydraulic excavator according to a fourth embodiment of the present invention, along with the hydraulic excavator and a hydraulic system thereof.

FIG. 35 shows, as a fourth embodiment of the present invention, another example of a electronic control system wherein a hydraulic system, to which the electronic control system is applied, is changed from the one in the embodiment shown in FIG. 1. In FIG. 35, the same numerals as those in FIG. 1 denote the same components.

Referring to FIG. 35, the electronic control system of this embodiment differs from the system of the embodiment shown in FIG. 1 in that the present invention is applied to a hydraulic excavator including a hydraulic system 55B which comprises two hydraulic pumps 18A, 18B and provides higher working efficiency. A hydraulic fluid delivered from the hydraulic pump 18A is supplied to the boom cylinder 11 and the arm cylinder 12 through control valves 24A, 25, respectively, and a hydraulic fluid delivered from the hydraulic pump 18B is supplied to the boom cylinder 11 and the bucket cylinder 13 through control valves 24B, 26, respectively. In other words, the hydraulic fluids delivered from the two hydraulic pumps 18A, 18B are supplied to the boom cylinder 11 in a joined way.

In the electronic control system of this embodiment which is applied to the hydraulic excavator including the hydraulic system 55B, the control unit 23 for the hydraulic pump 18, shown in FIG. 1, is replaced by a seventh control unit 23A which controls the two hydraulic pumps 18A, 18B, and the third control unit 33 for the control levers 27, 28, 29, shown in FIG. 1, is replaced by an eighth control unit 33A which controls the four control valves 24A, 24B, 25, 26. The seventh control unit 23A reads respective delivery pressures of the hydraulic pumps 18A, 18B as the pressure signal Pd to be read in step 312 of FIG. 25, and also reads respective swash-plate tilting angles of the hydraulic pumps 18A, 18B as the swash-plate position signal θ. The eighth control unit 33A computes shift amounts by which the control valves 24A, 24B are to be operated, respectively, based on the operation signal X1. The control units 17, 37 and the display unit 38 are the same as those shown in FIG. 1.

In this embodiment, the seventh control unit 23A controls the swash-plate positions of the two hydraulic pumps 18A, 18B by using the operation signals X1, X2, X3 which are data to be received from the eighth control unit 33A and the revolution speed signals Nr, Ne which are data to be received from the first control unit 17.

In a hydraulic excavator, it is often practiced to include a plurality of hydraulic pumps 18 to constitute a hydraulic system for improving operability of the excavating device 7 and enabling power to be utilized more effectively, to divide actuators into separate groups drive by the respective hydraulic pumps, and to employ hydraulic fluids from the hydraulic pumps 18 in a joined way. In such a case, it is often desired to control the plurality of hydraulic pumps by a single control unit from the functional point of view because a hydraulic power control system is required to be able to comprehensively control individual delivery rates of the plurality of hydraulic pumps. On that occasion, the desired function can be achieved with the construction of this embodiment by substituting only the control units 23A, 33A for the corresponding ones.

Thus, with this embodiment, system change can be easily realized from the electronic control system shown in FIG. 1 to that for the hydraulic system 55B including the two hydraulic pump 18A, 18B, just by removing the second control unit 23 and the third control unit 33 and providing the seventh control unit 23A and the eighth control unit 33A instead without changing the common communication line 39.

In addition, since a communication device and a minimum processing means, which are similar to those in the first embodiment, are provided in each of the control units, this fourth embodiment can also provide similar advantages as with the first embodiment, such as easy addition and exclusion of one or more control units, appropriate setting of the transmission cycle, and efficient utilization of the common communication line 39 due to identification of received data using ID numbers.

Figure 36:
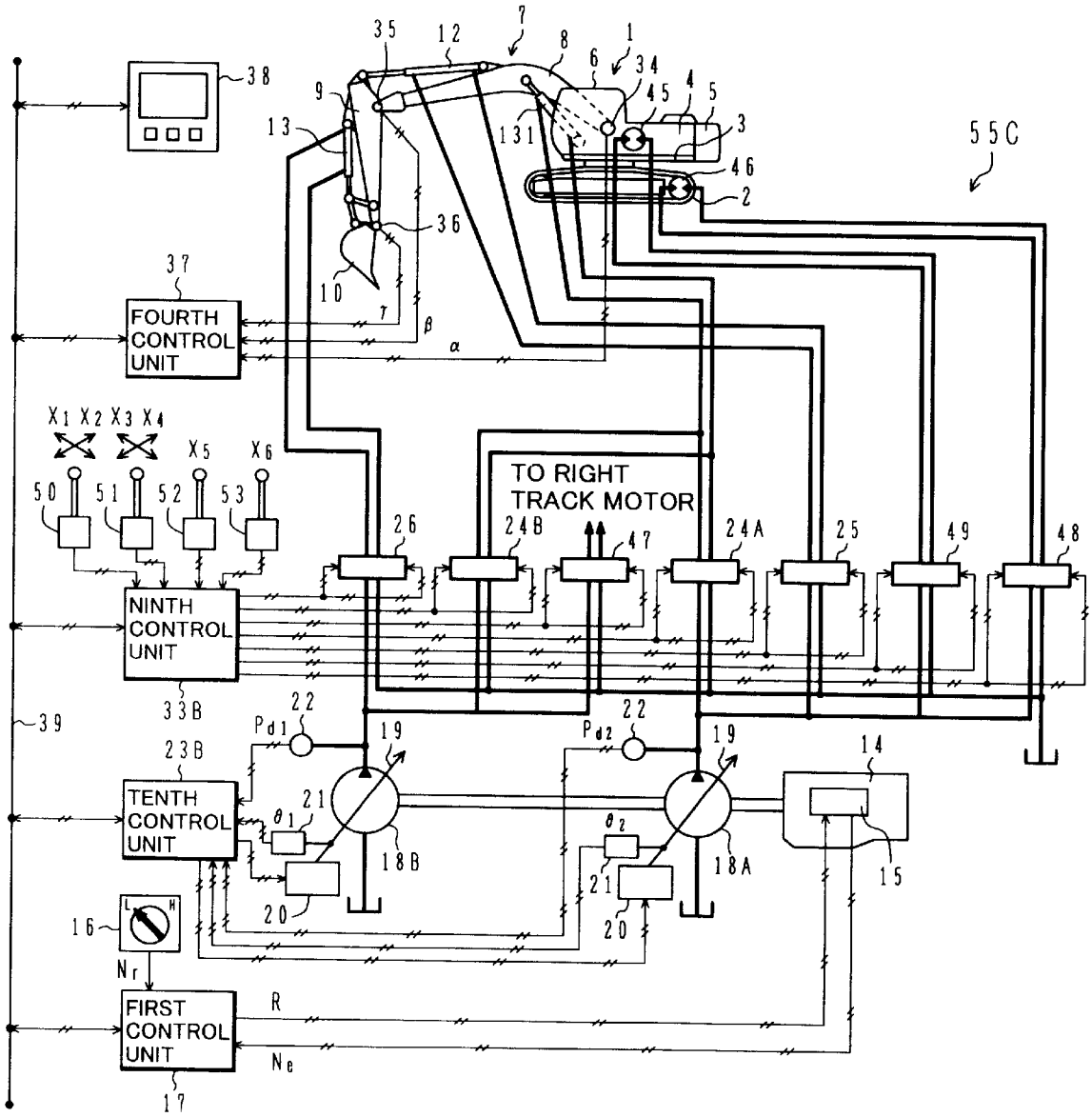
FIG. 36 is a diagram showing an electronic control system for a hydraulic excavator according to a fifth embodiment of the present invention, along with the hydraulic excavator and a hydraulic system thereof.

FIG. 36 shows, as a fifth embodiment of the present invention, another example of a electronic control system wherein a hydraulic system installed in a hydraulic excavator, to which the electronic control system is applied, is changed from the one in the embodiment shown in FIG. 1. In FIG. 36, the same numerals as those in FIGS. 1 and 35 denote the same components.

Referring to FIG. 36, the electronic control system of this embodiment differs from the system of the embodiment shown in FIG. 1 in that the present invention is applied to a hydraulic system which includes a hydraulic circuit for driving the swing body 3 to be able to swing and a hydraulic circuit for driving the track body 2 to be able to travel.

More specifically, a hydraulic system 55C in this embodiment comprises a swing motor 45 for driving the swing body 3; a right-hand track motor (not shown) for driving a right-hand track of the track body 2; a left-hand track motor 46 for driving a left-hand track of the track body 2; a control valve 47 for the right-hand track motor; a control valve 48 for the left-hand track motor 46; a control valve 49 for the swing motor 45; a control lever unit 50 for outputting an operation signal X1 for the boom 8 upon lever manipulation in one of crossed directions and outputting an operation signal X2 for the bucket 10 upon lever manipulation in the other of the crossed directions; a control lever unit 51 for outputting an operation signal X3 for the arm 9 upon lever manipulation in one of crossed directions and outputting an operation signal X4 for the swing body 3 upon lever manipulation in the other of the crossed directions; a control lever unit 52 for outputting an operation signal X5 for the left track; and a control lever unit 53 for outputting an operation signal X6 for the right track.

In the electronic control system of this embodiment which is applied to the hydraulic excavator including the hydraulic system 55C, the eighth control unit 33A for the operating system, shown in FIG. 35, is replaced by a ninth control unit 33B so that the control valves 24A, 24B, 25, 26, 47, 48, 49 are shifted in accordance with the operation signals from control lever units 50, 51, 52, 53. Also, corresponding to the replacement of the eighth control unit 33A, the seventh control unit 23A, which a control unit for the hydraulic pumps, is replaced by a tenth control unit 23B. The ninth control unit 33B transmits the operation signals X1–X6 to the common communication line 39, and the tenth control unit 23B computes a demanded flow rate using the transmitted operation signals X1–X6. The control units 17, 37 and the display unit 38 are the same as those shown in FIG. 35.

Thus, with this embodiment, system change can be easily realized from the electronic control system shown in FIG. 1 or 35 to that for the hydraulic system 55C including the hydraulic circuit for driving the swing body 3 to be able to swing and the hydraulic circuit for driving the track body 2 to be able to travel, just by substituting the ninth control unit 33B and the tenth control unit 23B for the corresponding control units without changing the common communication line 39.

Also, with this embodiment, since the actuator operating system is totally constructed in an electronic control manner, distribution of a flow rate of the hydraulic fluid to the respective actuators can be controlled comprehensively. Further, since data for distribution of a flow rate of the hydraulic fluid to the respective actuators can be processed by a single control unit, a processing and computing time for each actuator can be cut and the actuator control performance can be improved.

In addition, since a communication device and a minimum processing means, which are similar to those in the first embodiment, are provided in each of the control units, this fifth embodiment can also provide similar advantages as with the first embodiment, such as easy addition and exclusion of one or more control units, appropriate setting of the transmission cycle, and efficient utilization of the common communication line 39 due to identification of received data using ID numbers.

Additionally, the above embodiments have been described as implementing the minimum processing means by a method of appropriately setting an initial value. It is however as a matter of course that the minimum processing means may be implemented by any other method so long as each control unit can execute the least necessary processing by itself when no data is transmitted via the communication line.

Figure 37:
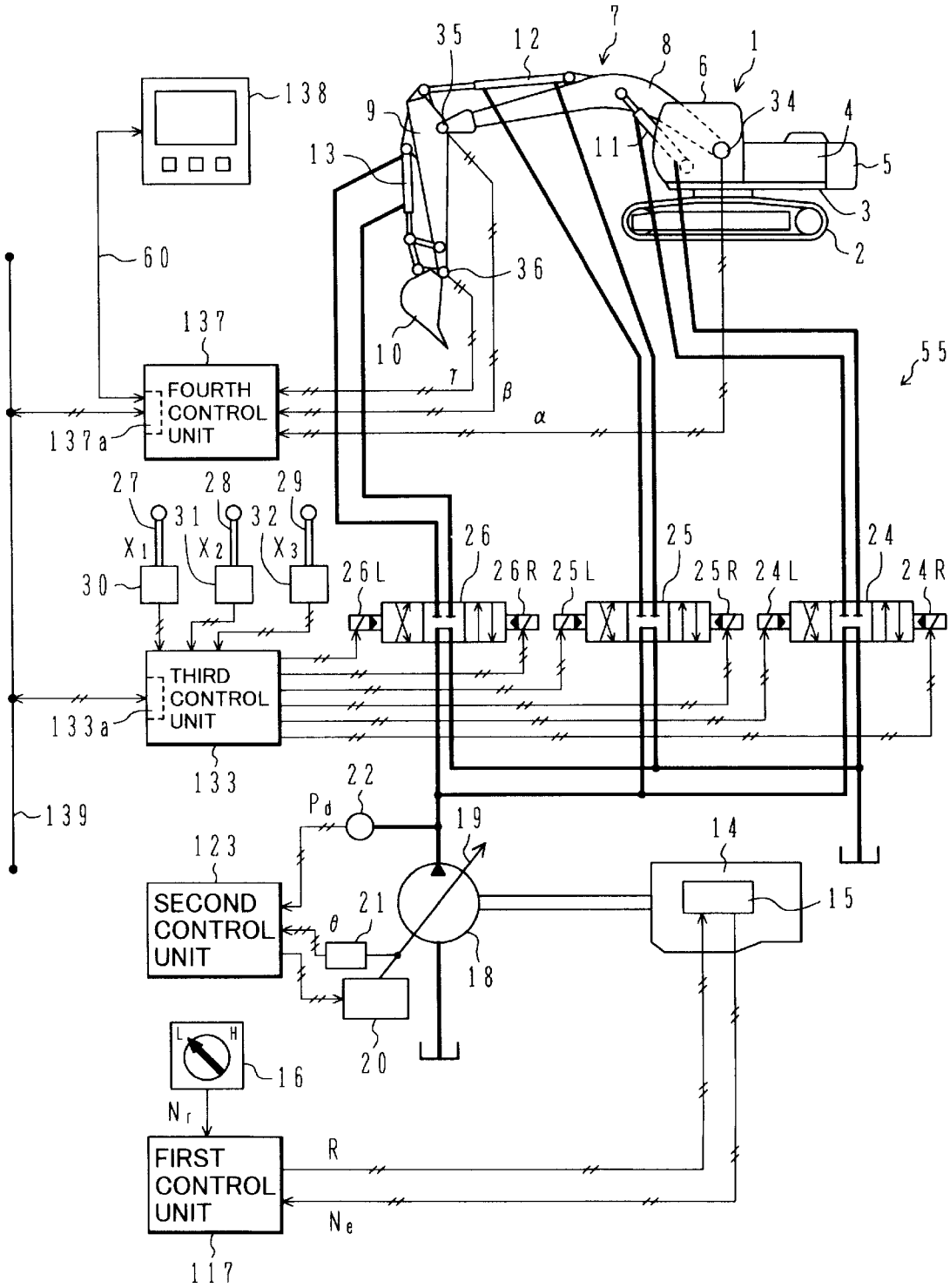
FIG. 37 is a diagram showing an electronic control system for a hydraulic excavator according to a sixth embodiment of the present invention, along with the hydraulic excavator and a hydraulic system thereof.

FIG. 37 shows an electronic control system for a hydraulic excavator according to a sixth embodiment of the present invention, along with the hydraulic excavator and a hydraulic system installed therein. In FIG. 37, the same numerals as those in FIG. 1 denote the same components.

Referring to FIG. 37, a first control unit 117, a second control unit 123, a third control unit 133 and a fourth control unit 137 are provided for the prime mover 14, the hydraulic pump 18, the control valves 24, 25, 26 and the excavating device 7, respectively, and a display/setting unit 138 is also provided.

The third control unit 133 and the fourth control unit 137 are interconnected by a common communication line 139 to transmit and receive data between them via the communication line 139. Also, the display/setting unit 138 is connected to the fourth control unit 137 by a serial communication line 60 to transmit and receive data between them via the serial communication line 60.

The hardware configurations of the third and fourth control units 133, 137 are essentially the same as those of the third and fourth control units 33, 37 in the first embodiment shown in FIGS. 4 and 5. For the sake of later description, communication devices in the third and fourth control units 133, 137 are denoted respectively by 133*a*, 137*a*. The configuration and functions of the communication devices 133*a*, 137*a* are also essentially the same as those of the communication devices in the first embodiment shown in FIGS. 8, 21 and 22. In this embodiment, however, a specific number is affixed to a message comprising a plurality of data grouped into a unit, and the communication devices 133*a*, 137*a* manage transmission and reception based on the message number (as described later).

In view of the case where work carried out by the hydraulic excavator 1 imposes a limitation in height or depth of the operating region of the excavating device 7, the hydraulic excavator has a function of keeping the excavating device 7 from entering an area set by the operator. Such a function will be referred to as area limiting control hereinafter. Taking as an example processing to realize the area limiting control, processing functions of the third and fourth control units 133, 137 will be described with reference to flowcharts shown in FIGS. 38 to 40.

Figure 38:
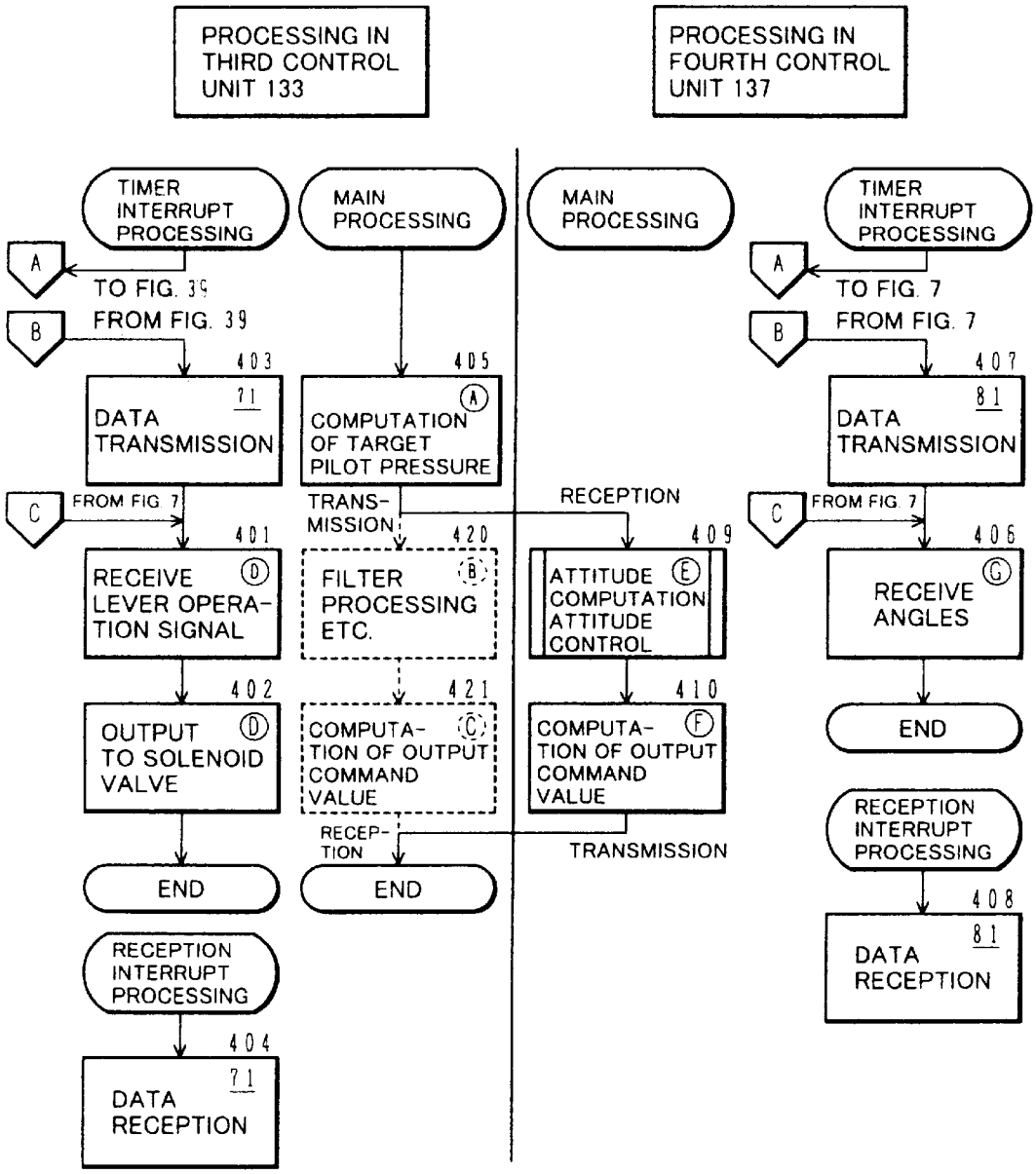
FIG. 38 is a flowchart showing a processing sequence in the third control unit, along with a processing sequence in the fourth control unit, when the fourth control unit is connected to the common communication line.
Figure 39:
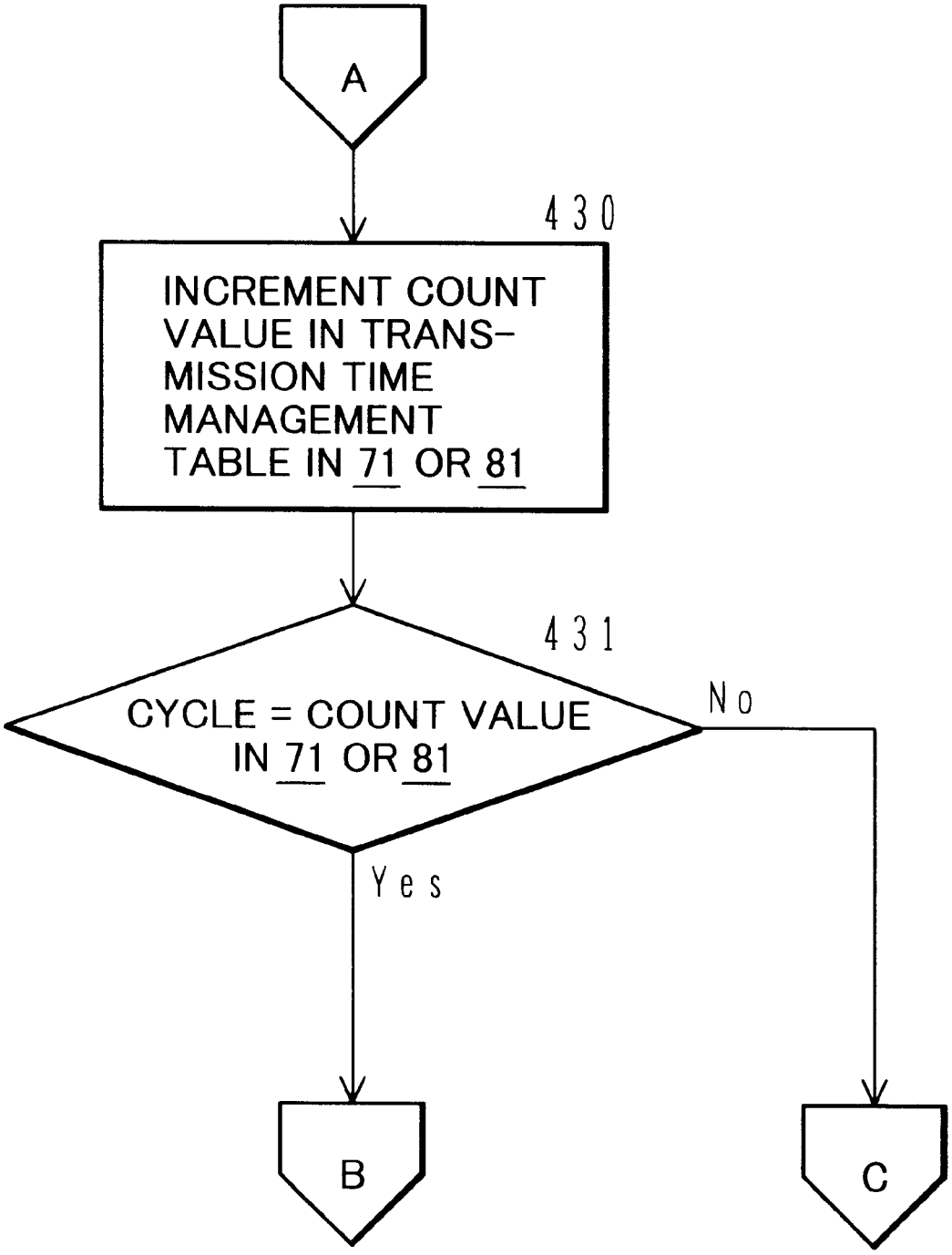
FIG. 39 is a flowchart showing processing to manage whether a predetermined transmission cycle is reached or not in data transmission processing as a part of the processing function of a communication management section.
Figure 40:
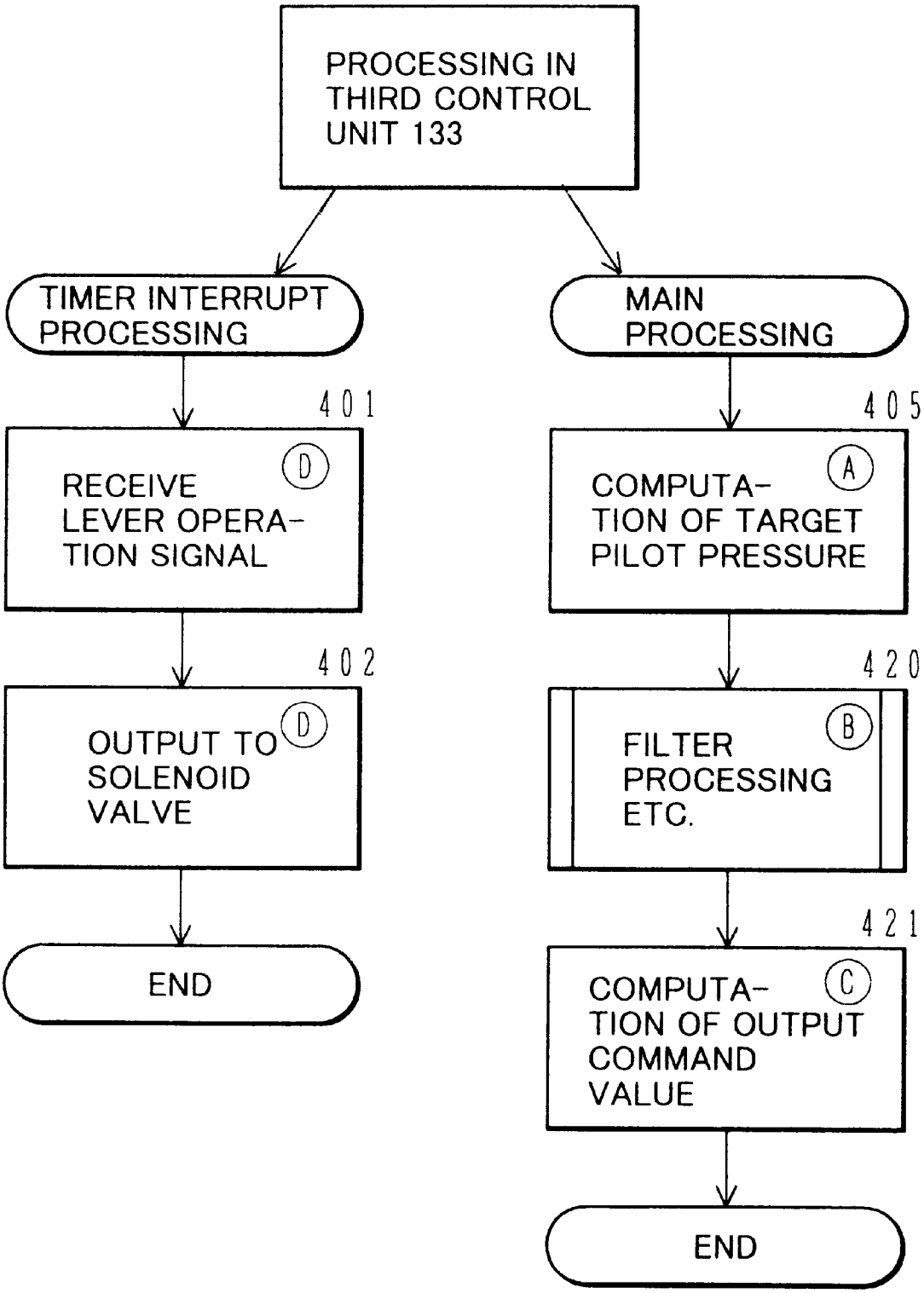
FIG. 40 is a flowchart showing an essential processing sequence in the third control unit when the fourth control unit is not connected to the common communication line.

FIGS. 38 and 39 show, in the form of a flowchart, processing sequences in the third control unit 133 and the fourth control unit 134 when the third control unit 133 and the fourth control unit 137 are both connected to the common communication line 139 as shown in FIG. 37. FIG. 40 shows, in the form of a flowchart, an essential processing sequence in the third control unit 133 when the fourth control unit 137 is not connected. Further, in FIG. 38, portions indicated by broken lines represent processing portions executed in the third control unit 133 when the fourth control unit 137 is not connected, and processing in those portions is not executed when the fourth control unit 137 is connected as shown in FIG. 37.

Referring to FIG. 38, when the fourth control unit 137 is connected to the common communication line 139, the processing executed in the third control unit 133 includes main processing, timer interrupt processing, and reception interrupt processing.

In the main processing, target pilot pressures to be supplied to the control valves 24, 25, 26 are computed in accordance with the received operation signals X1, X2, X3 (STEP 405).

In the timer interrupt processing, processing to take in the operation signals X1, X2, X3 from the lever operating units 30, 31, 32 associated with the control levers 27, 28, 29 (STEP 401) and processing to issue output command values received from the fourth control unit 137 to the shifting sectors 24L, 24R, 25L, 25R, 26L, 26R of the control valves 24, 25, 26 (STEP 402) are performed each time the timer interrupt processing is activated, i.e., at intervals of a certain time. Also, as shown in FIG. 39, a count value in a transmission time management table (described later) is incremented at intervals of a certain time (STEP 430), and the count value is compared with a cycle provided as a predetermined transmission set time (STEP 431). Then, if the count value has become equal to the cycle, the communication device 133*a* is activated to execute processing to transmit the target pilot pressures, which are computed in the main processing, as data (STEP 403).

In the reception interrupt processing, each time the communication device 133*a* receives the data (output command values to be issued to the shifting sectors 24L, 24R, 25L, 25R, 26L, 26R of the control valves 24, 25, 26) received from the fourth control unit 137 and a reception interrupt signal is transmitted to the microcomputer side, the reception interrupt processing is activated to store the data received by the communication device 133*a* (STEP 404).

The processing executed in the fourth control unit 137 also includes main processing, timer interrupt processing, and reception interrupt processing.

In the main processing, the end position of the excavating device 7 is computed from the received angle α, β, γ, and attitude control computation is performed based on the computed position data, the target pilot pressures received from the third control unit 133 and the setting data for area limiting control received from the display/setting unit 138 (STEP 409). Finally, output command values are computed based on the results of the control computation (STEP 410).

In the timer interrupt processing, the angle signals α, β, γ from the angle sensors 34, 35, 36, which are angle data of the excavating device 7, are received each time the timer interrupt processing is activated, i.e., at intervals of a certain time (STEP 406). Also, as described above in connection with FIG. 39, a count value in a transmission time management table (described later) is incremented at intervals of a certain time (STEP 430), and the count value is compared with a cycle provided as a predetermined transmission set time (STEP 431). Then, if the count value has become equal to the cycle, the communication device 137*a* is activated to execute processing to transmit the output command values for the solenoid valves, which are computed in the main processing, as data to the third control unit 133 (STEP 407).

In the reception interrupt processing, each time the communication device 137*a* receives the data (target pilot pressures) received from the third control unit 133 and a reception interrupt signal is transmitted to the microcomputer side, the reception interrupt processing is activated to store the data received by the communication device 137*a* (STEP 408).

When the fourth control unit 137 is not connected to the common communication line 139, processing 420, 421 indicated by broken lines in FIG. 38 are executed in the third control unit 133. Also, when the fourth control unit 137 is not connected, parts of the timer interrupt processing, i.e., the sequences of processing 430, 431 shown in FIG. 39 and the processing 403 shown in FIG. 38, are activated. However, because the fourth control unit 137 is not connected, the third control unit 133 is substantially in the same condition as when those sequences of processing are not activated. Further, when the fourth control unit 137 is not connected, the reception interrupt signal is not transmitted and therefore the reception interrupt processing 404 is in a standby state. Note that, of the timer interrupt processing, the data transmission processing 403 shown in FIG. 38 may be switched over to be not activated (executed) when the fourth control unit 137 is not connected.

FIG. 40 shows, in the form of a flowchart, essential processing in the third control unit 133 when the fourth control unit 137 is not connected. In this case, the processing includes main processing and timer interrupt processing.

In the main processing, target pilot pressures to be supplied to the control valves 24, 25, 26 are computed in accordance with the received operation signals X1, X2, X3 (STEP 405). Filtering and other processing are performed as required (STEP 420). Then, command values issued to the shifting sectors, i.e., the solenoid valves 24L, 24R, 25L, 25R, 26L, 26R, for providing the pilot pressures to be outputted are determined (STEP 421).

In the timer interrupt processing, processing to take in the operation signals X1, X2, X3 from the lever operating units 30, 31, 32 associated with the control levers 27, 28, 29 (STEP 401) and processing to issue the output command values determined in the main processing to the shifting sectors 24L, 24R, 25L, 25R, 26L, 26R of the control valves 24, 25, 26 (STEP 402) are performed each time the timer interrupt processing is activated, i.e., at intervals of a certain time.

The processing in the third control unit 133 is changed over depending on whether the fourth control unit 137 is connected to the common communication line 139. To that end, the third control unit 133 has the function of detecting whether the fourth control unit 137 is connected to the common communication line 139, and the processing changeover function of changing over the processing depending on a detected result. Those detecting function and processing changeover function will be described below with reference to FIGS. 41–46.

Figure 41:
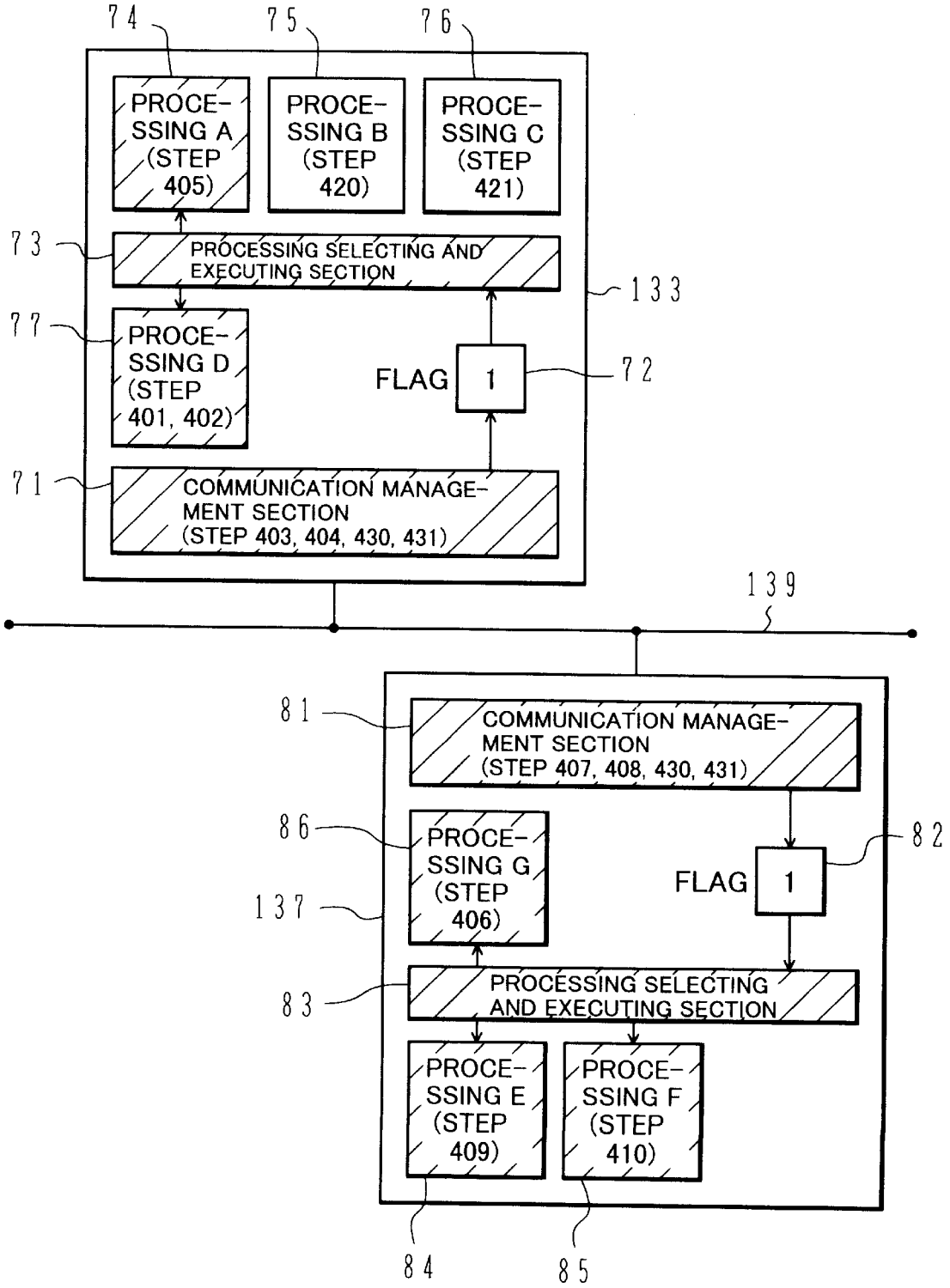
FIG. 41 is a functional block diagram showing overall processing functions of software in the third control unit and the fourth control unit.

FIG. 41 shows, in the form of a functional block diagram, overall processing functions of software installed in microcomputers of the third control unit 133 and the fourth control unit 137.

Referring to FIG. 41, the third control unit 133 comprises a communication management section 71, a flag setting section 72, a processing selecting/executing section 73, a processing section 74 for executing processing A, a processing section 75 for executing processing B, a processing section 76 for executing processing C, and a processing section 77 for executing processing D. Here, the processing A corresponds to the processing of STEP 405 shown in FIGS. 38 and 40. The processing B corresponds to the processing of STEP 420 shown in FIG. 38. The processing C corresponds to the processing of STEP 421 shown in FIG. 38. The processing D corresponds to the processing of STEP 401, 402 shown in FIGS. 38 and 40.

Also, the fourth control unit 137 comprises a communication management section 81, a flag setting section 82, a processing selecting/executing section 83, a processing section 84 for executing processing E, a processing section 85 for executing processing F, and a processing section 86 for executing processing G. Here, the processing E corresponds to the processing of STEP 409 shown in FIG. 40. The processing F corresponds to the processing of STEP 410 shown in FIG. 38. The processing G corresponds to the processing of STEP 406 shown in FIG. 38.

The communication management section 71 of the third control unit 133 has the function of transmitting data at intervals of a certain time in STEP 403 and STEP 430, 431 of the timer interrupt processing shown in FIGS. 38 and 39, and the function of STEP 404 of the reception interrupt processing shown in FIGS. 38. The communication management section 81 of the fourth control unit 137 has the function of transmitting data at intervals of a certain time in STEP 407 and STEP 430, 431 of the timer interrupt processing shown in FIGS. 38 and 39, and the function of STEP 408 of the reception interrupt processing shown in FIGS. 38. Further, the communication management sections 71, 81 each have, as a part of the reception interrupt processing, the function of detecting based on reception of data whether another control unit is connected.

The processing selecting/executing section 73 of the third control unit 133 and the processing selecting/executing section 83 of the fourth control unit 137 are each constituted as a program for selecting and executing the sequences of processing A–D or E–G at intervals of a required time by using the timer function (not shown) incorporated in the microcomputer.

The function of transmitting data at intervals of a certain time in the timer interrupt processing in each of the communication management sections 71, 81 will be first described more concretely with reference to FIGS. 42–46. FIGS. 42–46 show various transmission/reception management tables created and used in the communication management sections 71, 81.

FIG. 42 shows one example of a data definition table usable in common to the respective control units. Each data is assigned with a specific ID. For example, a data ID "1" represents a boom-raising operation signal from the boom control lever 27, and indicates the fact that the data having such an ID is data expressed by 2 bytes (16 bits).

FIG. 43 shows one example of a message definition table stored in the ROM of the fourth control unit 137. Here, a "message" comprises a plurality of data grouped into a unit, and a specific number is affixed to each message. For example, a message number "1" represents a data group of boom-and-arm operation signals having data IDs 1, 2, 3 and 4 in the data definition table shown in FIG. 42. Further, data is transmitted and received in units of message. The item "transmission/reception" represents whether the message is to be transmitted and received, and the item "transmission cycle" represents a cyclic interval for transmission of messages. Since the table of FIG. 43 is incorporated in the fourth control unit 137, the data is computed in the fourth control unit 137. A message 3 given as a data group of the output command values, which are issued to the shifting sectors (solenoid valves) 24L, 24R, 25L, 25R, 26L, 26R of the control valves 24, 25, 26, has a transmission attribute, while messages 1 and 2 given as data groups of the operation signals received from the third control unit 133 have a reception attribute.

FIG. 44 shows one example of a transmission time management table created in the RAM of the fourth control unit 137. For example, the message number 3 has a transmission cycle of 5 ms, and a count value counted by a timer incorporated in the fourth control unit 137 is entered in the item "counter".

FIG. 45 shows one example of a message definition table stored in the ROM of the third control unit 133. In this table, the messages 1 and 2 given as data groups of the operation signals from the control levers, which are computed in the third control unit 133, have a transmission attribute, while the message 3 given as a data group of the output command values transmitted from the fourth control unit 137 have a reception attribute.

FIG. 46 shows one example of a transmission time management table created in the RAM of the third control unit 133. For example, the message numbers 1 and 3 each have a transmission cycle of 5 ms, and a count value counted by a timer incorporated in the third control unit 133 is entered in the term "counter".

For data transmission, the communication management section 71 of the third control unit 133 performs the above-described processing of STEP 430, 431 (FIG. 39) and STEP 403 (FIG. 38) in the timer interrupt processing of FIGS. 38 and 39. More specifically, in STEP 430, 431 of FIG. 39, the following processing is performed using the transmission time management table shown in FIG. 46. A count value in the transmission time management table is incremented at intervals of a certain time (STEP 430), and the count value is compared with a cycle provided as a predetermined transmission set time (STEP 431). Then, if the count value has become equal to the cycle, the communication device 133*a* is activated to execute the processing to transmit the target pilot pressures, which are computed in the main processing, as data in STEP 393 of FIG. 38.

For data transmission, the communication management section 81 of the fourth control unit 137 performs the above-described processing of STEP 430, 431 (FIG. 30) and STEP 397 (FIG. 38) in the timer interrupt processing of FIGS. 38 and 39. More specifically, in STEP 430, 431 of FIG. 39, the following processing is performed using the transmission time management table shown in FIG. 44. A count value in the transmission time management table is incremented at intervals of a certain time (STEP 430), and the count value is compared with a cycle provided as a predetermined transmission set time (STEP 431). Then, if the count value has become equal to the cycle, the communication device 137*a* is activated to execute the processing to transmit the output command values for the solenoid valves, which are computed in the main processing, as data to the third control unit 133 in STEP 397.

Next, a description is made of the function of detecting whether another control unit is connected, the function being performed by each of the communication management sections 71, 81 based on reception of data.

Figure 47:
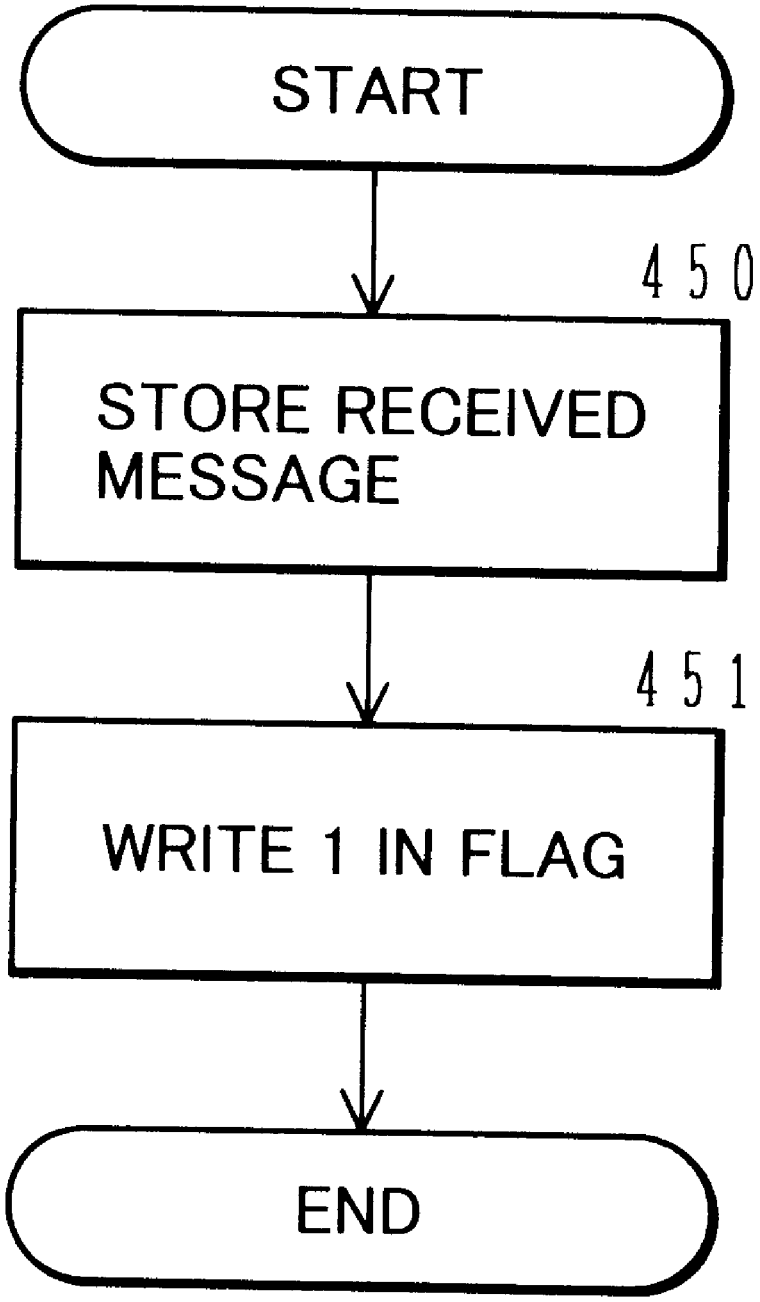
FIG. 47 is a flowchart showing reception interrupt processing performed by the communication management section in each of the third and fourth control units.

FIG. 47 is a flowchart showing details of the above-described reception interrupt processing in STEP 404, 408 of FIG. 38.

First, the communication devices 133*a*, 137*a* each have such a function that when the communication device receives a message comprising a plurality of data grouped into a unit, as described above, via the common communication line 138, it determines whether the received message is necessary for the associated control unit, by using as an identifier the message number affixed to the message, and that if the received message is necessary, it sends a reception interrupt signal to the microcomputer side. Upon receiving the reception interrupt signal, each of the communication management sections 71, 81 on the microcomputer side activates the reception interrupt processing and performs the following processing.

Referring to FIG. 47, each communication management section stores, in the RAM, the message comprising a plurality of data grouped into a unit, which has been received by the communication device 133*a*, 137*a* via the common communication line 139 (STEP 450). Then, the communication management section writes "1" in a flag in the flag setting section 72 or 82 (STEP 451), thereby ending the processing.

Here, the flag in the flag setting section 72 or 82 is initialized immediately after power-on of the control unit 133, 137, and an initial value of "0" is written in the flag. Accordingly, the fact that the reception interrupt processing is activated as shown in FIG. 38 and "1" is written in the flag in STEP 451 of FIG. 47 is equivalent to detection of such a condition that another control unit from which data is to be received (i.e., the fourth control unit 137 when the processing is performed in the third control unit 133) is connected to the common communication line 139. Depending on a detection result, the processing selecting/executing section 73, 83 changes over the processing to be performed in the control unit.

The processing performed by the processing selecting/executing section 73 of the third control unit 133 will be described with reference to a flowchart shown in FIG. 48.

Figure 48:
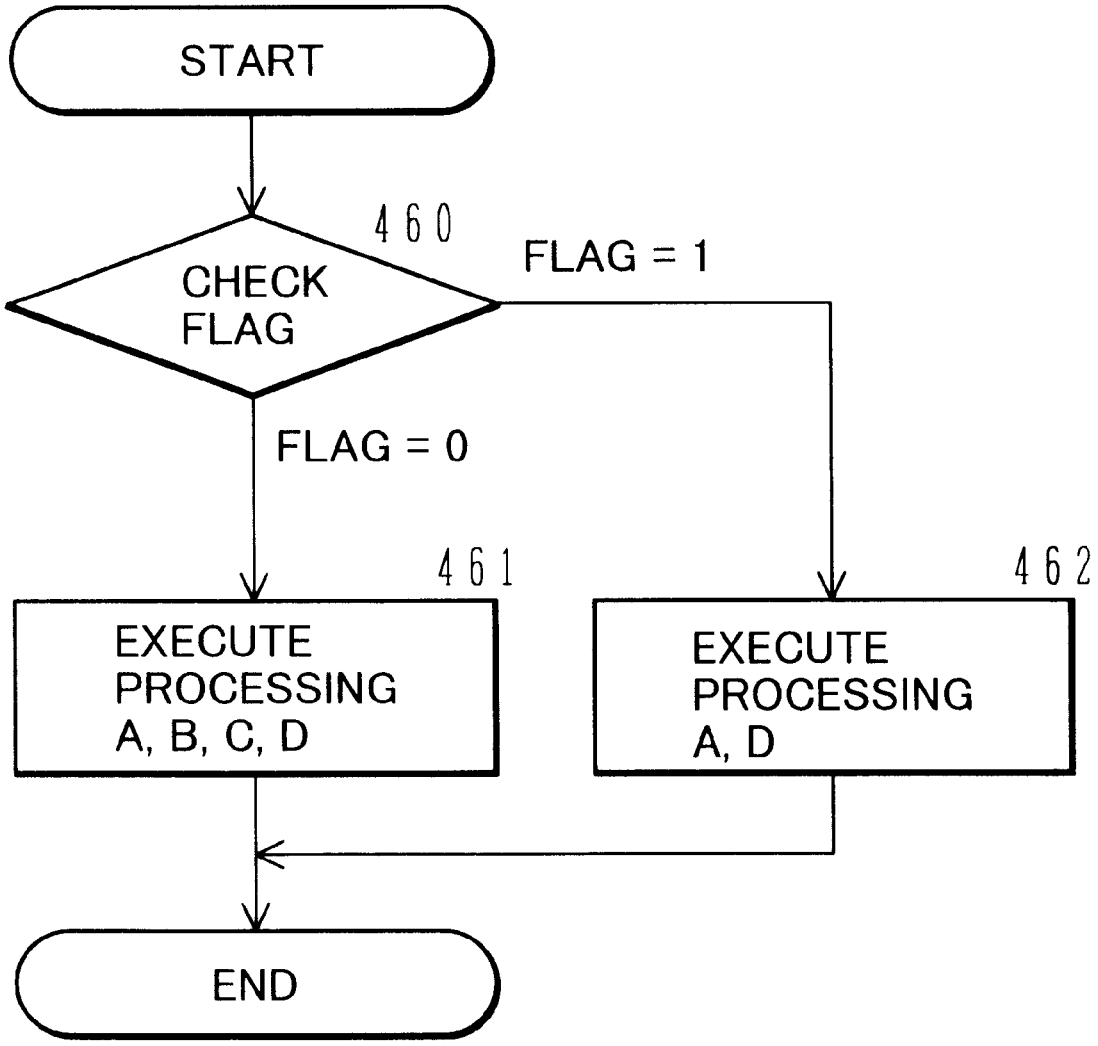
FIG. 48 is a flowchart showing selection and execution processing performed by a processing selecting and executing section of the third control unit.

Referring to FIG. 48, the processing selecting/executing section 73 checks the status of the flag in the flag setting section 72 (STEP 460), and if the flag is "0", it executes the processing A, B, C, D (STEP 461), thereby ending the processing. If the flag is "1", it executes the processing A, D (STEP 462), thereby ending the processing.

The processing performed by the processing selecting/executing section 83 of the fourth control unit 137 will be described with reference to a flowchart shown in FIG. 49.

Figure 49:
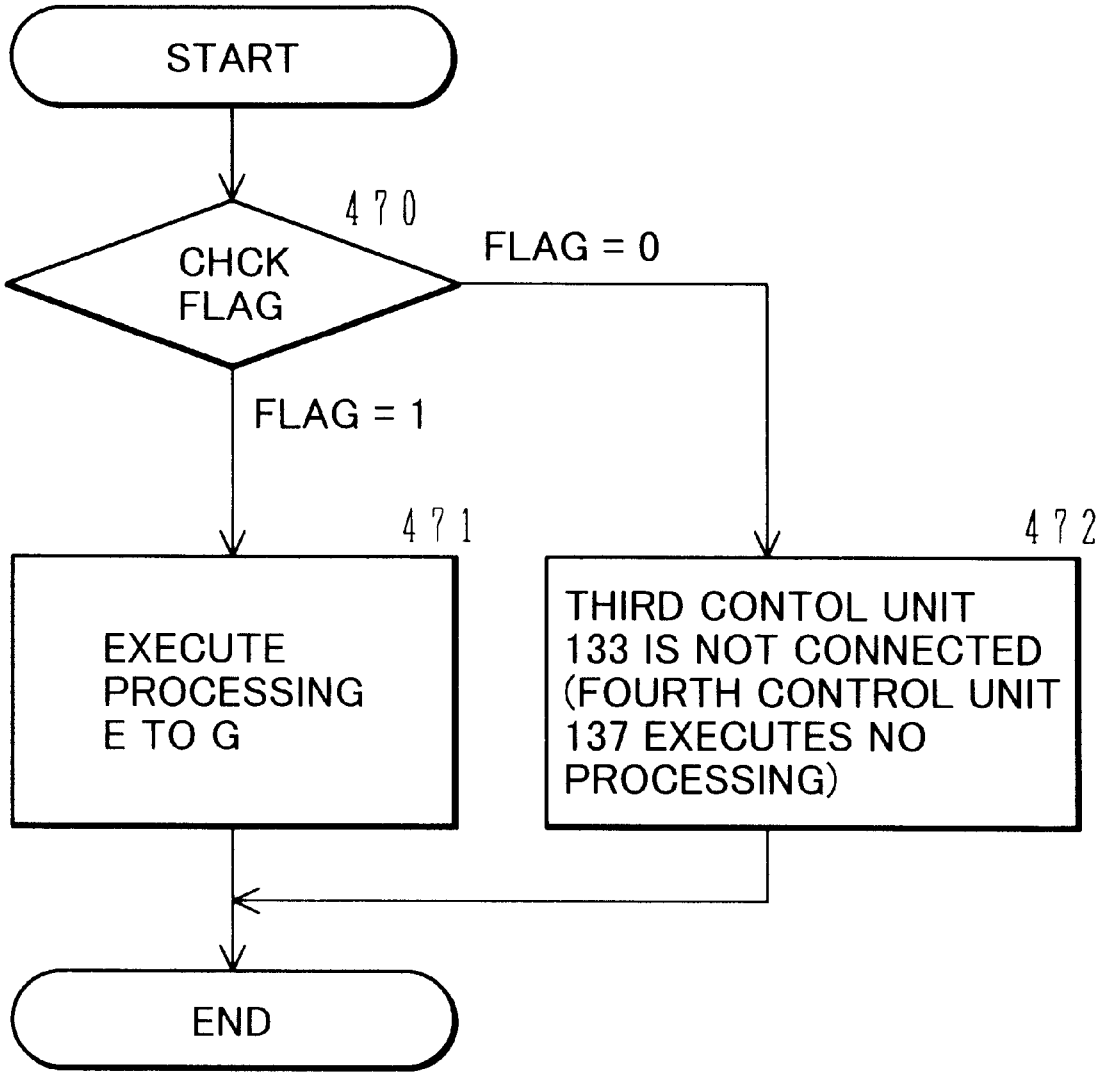
FIG. 49 is a flowchart showing selection and execution processing performed by a processing selecting and executing section of the fourth control unit.

Referring to FIG. 49, the processing selecting/executing section 83 checks the status of the flag in the flag setting section 82 (STEP 470), and if the flag is "1", it executes the processing E–G (STEP 471), thereby ending the processing. If the flag is "0", it executes nothing and ends the processing (STEP 472).

Figure 50:
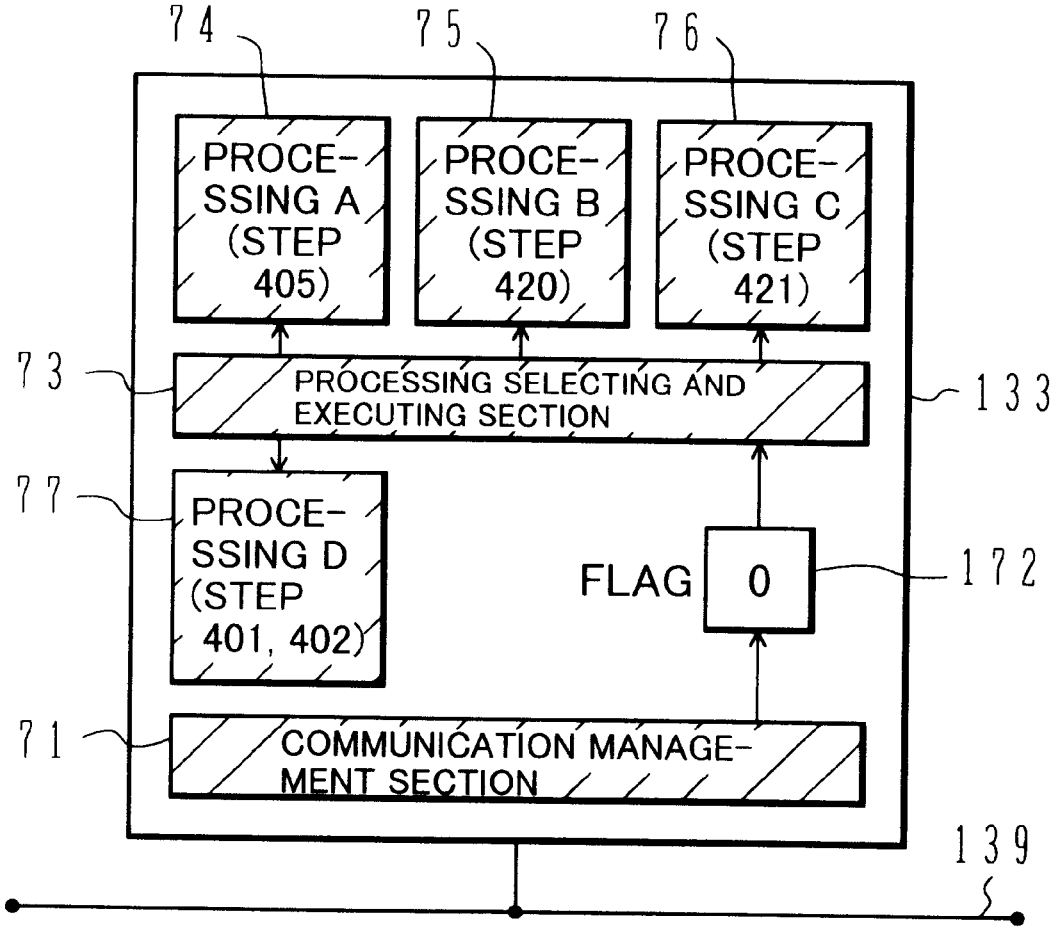
FIG. 50 is a flowchart showing status of the processing function of the third control unit when only the third control unit is connected to the common communication line.

With this embodiment thus constructed, when the fourth control unit 137 is not connected to the common communication line 139 as shown in FIG. 50, the third control unit 133 operates, as described above, such that the reception interrupt processing in the communication management section 71 is not activated, the flag remains at the initial value "0", and the processing selecting/executing section 73 selects and activates the processing A–D. In FIG. 50, processing blocks under activation are indicated by hatching. Therefore, the processing shown in FIG. 38 is executed and ordinary work using the operation signals from the control levers can be performed.

On the other hand, when the fourth control unit 137 is additionally connected to the common communication line 139 as shown in FIGS. 37 and 41, the third control unit 133 operates, as described above, such that the communication management section 71 writes "1" in the flag and the processing selecting/executing section 73 selects and activates the processing A, D. Also, the fourth control unit 137 operates, as described above, such that the communication management section 81 writes "1" in the flag and the processing selecting/executing section 83 selects and activates the processing E–G. In FIG. 41, processing blocks under activation are indicated by hatching. Therefore, the processing shown in FIG. 38 is executed and the area limiting control using the fourth control unit 137 can be performed.

Accordingly, even in the case of making system change from the electronic control system not including the fourth control unit 137, shown in FIG. 50, to the electronic control system including the fourth control unit 137, shown in FIG. 37, for adding an function of the hydraulic excavator, i.e., for the purpose of upgrading the machine, the system change can be realized just by additionally connecting the fourth control unit 137 to the common communication line 139. There is no need of changing the program in the third control unit 133 or replacing the third control unit 133 itself.

Also, in the case of making system change from the electronic control system shown in FIG. 37 to the electronic control system shown in FIG. 50 for simplifying the functions of the hydraulic excavator, the system change can be realized just by disconnecting the fourth control unit 137 from the common communication line 139. There is no need of changing the program in the third control unit 133 or replacing the third control unit 133 itself.

Thus, the control unit 137 can be additionally connected to the common communication line 139 or can be disconnected from the common communication line 139 without changing the program in the existing third control unit 133 or replacing the third control unit 133 itself. It is hence possible to easily realize system change including addition, exclusion and replacement of the control unit, and to hold down an increase of the development cost.

Another advantage is that the functions of a hydraulic excavator can be upgraded just by adding the control unit 137 having a new function incorporated therein to the existing control unit 133, and the number of steps to be carried out by a worker for maintenance can be reduced.

A seventh embodiment of the present invention will be described with reference to FIGS. 51–63. In FIGS. 51–63, equivalent components to those in FIGS. 37–50 are denoted by the same numerals. This embodiment is based on the concept of the sixth embodiment and is adapted for a system including three or more control units connected to a common communication line.

Figure 51:
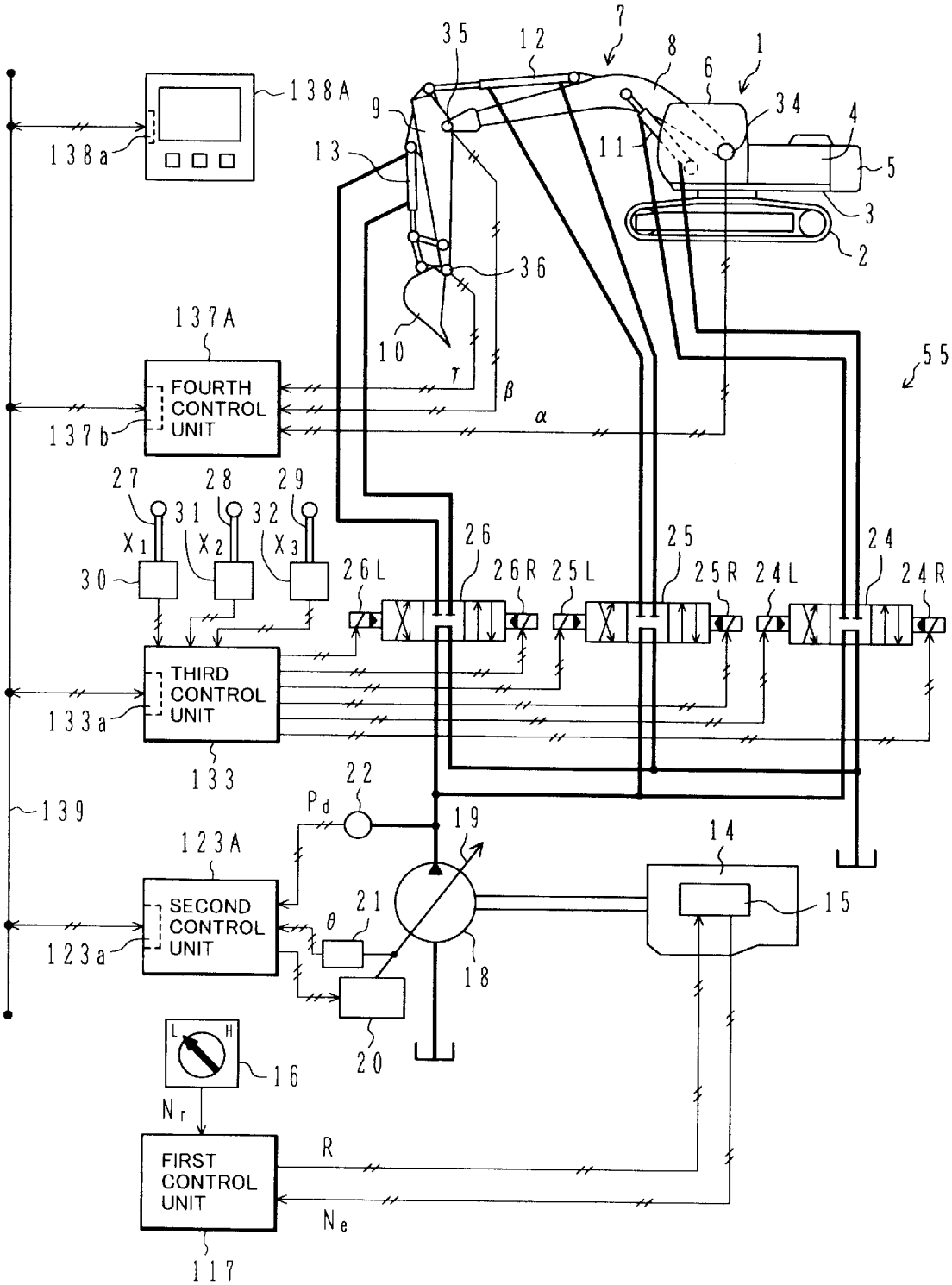
FIG. 51 is a diagram showing an electronic control system for a hydraulic excavator according to a seventh embodiment of the present invention, along with the hydraulic excavator and a hydraulic system thereof.

FIG. 51 shows the overall configuration of an electronic control system of this embodiment. In FIG. 51, numerals 123A, 137A, 138 denote respectively a second control unit, a fourth control unit, and a display/setting unit, which constitutes a fifth control unit, according to this embodiment. The second control unit 123A, the third control unit 133, the fourth control unit 137A, and the display/setting unit 138A are connected to the common communication line 139 to transmit and receive data among them via the communication line 139.

The hardware configurations of the second and fourth control units 123A, 137A and the display/setting unit 138A are substantially the same as those of the second and fourth control units 23, 37 and the display unit 38 in the first embodiment shown in FIGS. 3, 5 and 6. Communication devices of the second and fourth control units 123A, 137A and the display/setting unit 138A are denoted by 123*a*, 137*b*, 138*a* in FIG. 51. The configurations and functions of the communication devices 123*a*, 137*b*, 138*a* are also substantially the same as those in the first embodiment shown in FIGS. 8, 21 and 22 except that transmission and reception are managed using message numbers.

Figure 52:
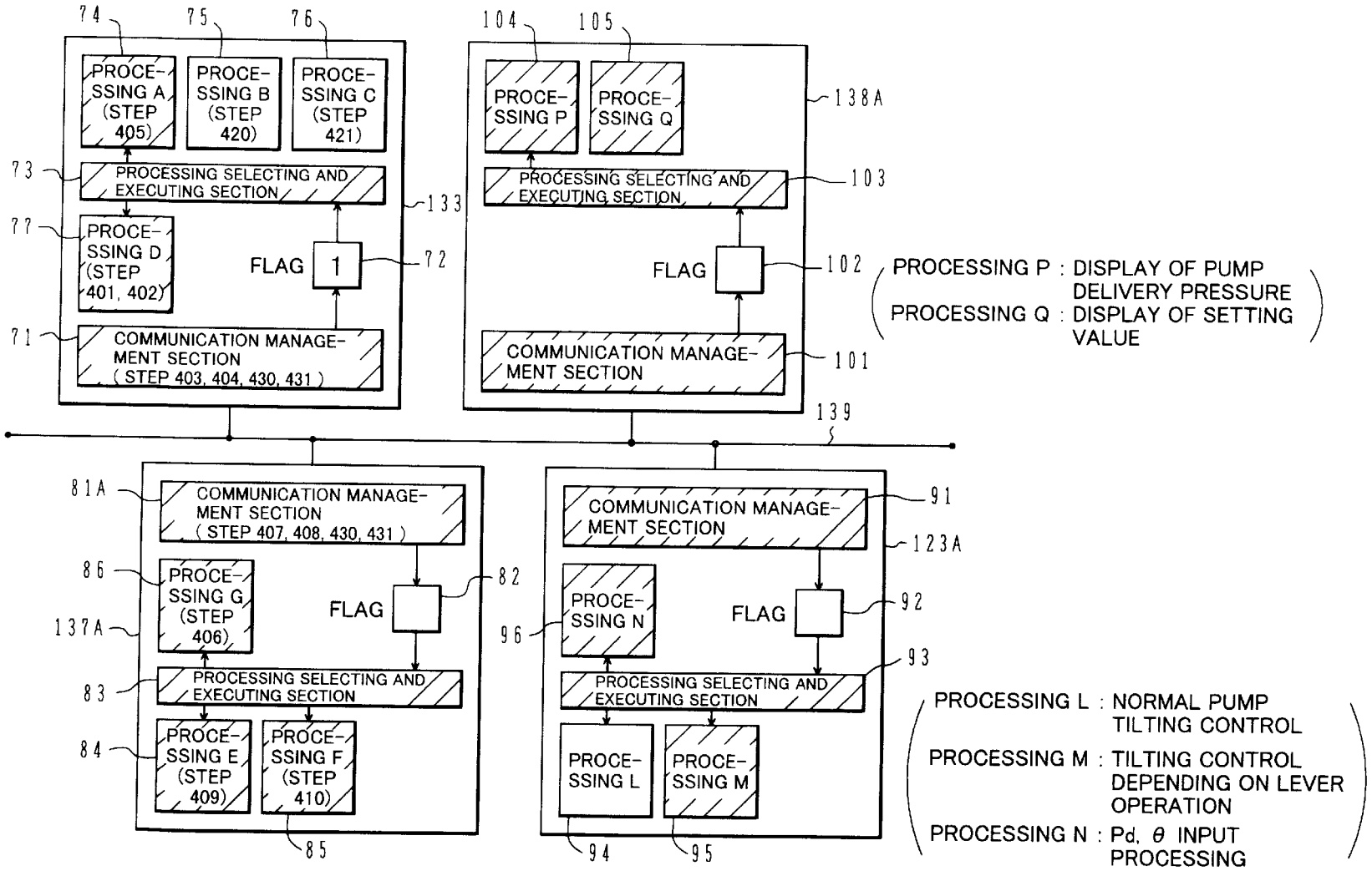
FIG. 52 is a functional block diagram showing overall processing functions of software in the second control unit, the third control unit, the fourth control unit and the display/setting unit.

FIG. 52 shows, in the form of a functional block diagram, overall processing functions of software installed in microcomputers of the second control unit 123A, the third control unit 133, the fourth control unit 137A, and the display/setting unit 138A In FIG. 52, the processing function of the third control unit 133 is substantially the same as that in the sixth embodiment shown in FIG. 41.

The processing function of the fourth control unit 137A is substantially the same as that in the sixth embodiment shown in FIG. 41 except for the following point.

In the fourth control unit 137A, when performing the function of transmitting data at intervals of a certain time in STEP 397 of the timer interrupt processing shown in FIG. 38, a communication management section 81A instructs the communication device 137*b* to perform processing to transmit, as data, not only the output command values issued to the shifting sectors (solenoid valves) 24L, 24R, 25L, 25R, 26L, 26R of the control valves 24, 25, 26, but also the angle signal $\alpha$ from the boom rotational angle sensor 34 and the angle signal $\beta$ from the arm rotational angle sensors 35.

FIG. 53 shows one example of a message definition table serving as a transmission/reception management table which is created and used in the communication management section 81A of the fourth control unit 137A. FIG. 54 shows one example of a transmission time management table similarly created and used in the fourth control unit. In the communication management section 81A, as shown in FIG. 53, a message 4 given as a data group of the boom angle signal $\alpha$ and the arm angle signal $\beta$ also has a transmission attribute in addition to the above-mentioned message 3 given as a data group of the output command values supplied to the solenoid valves. Further, as shown in FIG. 54, the message numbers 3 and 4 each have a transmission cycle of 5 ms, and a count value counted by a timer incorporated in the fourth control unit 137A is entered in the item "counter".

In FIG. 52, the second control unit 123A comprises a communication management section 91, a flag setting section 92, a processing selecting/executing section 93, a processing section 94 for executing processing L, a processing section 95 for executing processing M, and a processing section 96 for executing processing N. Here, the processing L is processing to perform ordinary pump tilting control, the processing M is processing to perform pump tilting control in accordance with the operation signals from the control levers, and the processing N is processing to receive the pressure signal Pd and the swash-plate position signal $\theta$.

The display/setting unit 138A comprises a communication management section 101, a flag setting section 102, a processing selecting/executing section 103, a processing section 104 for executing processing P, and a processing section 105 for executing processing Q. Here, the processing P is processing to display the pump delivery pressure, and the processing Q is processing to display a setting value entered by the operator.

The communication management section 91 of the second control unit 123A and the communication management section 101 of the display/setting unit 138A has, as with those of the third and fourth control units 133, 134, the function of transmitting data at intervals of a certain time in the timer interrupt processing and the function of storing received data in the reception interrupt processing. Also, the communication management sections 91, 101 each have, as a part of the reception interrupt processing, the function of detecting based on reception of data whether another control unit is connected.

The processing selecting/executing section 93 of the second control unit 123A and the processing selecting/executing section 103 of the display/setting unit 138A are each constituted as a program for selecting and executing the sequences of processing A–D or P, Q at intervals of a required time by using the timer function (not shown) incorporated in the microcomputer.

The function of transmitting data at intervals of a certain time in each of the communication management sections 91, 101 will be described more concretely with reference to FIGS. 55–58. FIGS. 55–58 show various transmission/reception management tables created and used in the communication management sections 91, 101.

FIG. 55 shows one example of a message definition table stored in the ROM of the second control unit 123A, and FIG. 56 shows one example of a transmission time management table created in the RAM of the second control unit 123A. Referring to FIG. 55, in the communication management section 91, a message 5 given as data of the pump delivery pressure used in the display/setting unit 138A has a transmission attribute, while messages 1 and 2 given as data groups of the operation signals received from the third control unit 133, and a message 3 given as a data group of the output command values and a message 4 given as a data group of the angle signals, which are received from the fourth control unit 137A, have a reception attribute.

FIG. 57 shows one example of a message definition table stored in the ROM of the display/setting unit 138A, and FIG. 58 shows one example of a transmission time management table created in the RAM of the display/setting unit 138A. Referring to FIG. 57, in the communication management section 101, a message 6 given as data of the setting value used in the fourth control unit 137A has a transmission attribute, while the messages 1 and 2 given as data groups of the operation signals received from the third control unit 133, the message 3 given as a data group of the output command values and the message 4 given as a data group of the angle signals, which are received from the fourth control unit 137A, and the message 5 given as data of the pump delivery pressure received from the second control unit 123A have a reception attribute. In FIG. 58, for example, the message number 6 has a transmission cycle of 5 ms, and a count value counted by a timer incorporated in the display/setting unit 138A is entered in the item "counter".

For data transmission, the communication management section 91 of the second control unit 123A and the communication management section 101 of the display/setting unit 138A each perform the processing to transmit data similarly to STEP 430, 431 (FIG. 39) and STEP 403 or 407 (FIG. 38) in the timer interrupt processing of FIGS. 38 and 39, which have been described above in the first embodiment, by using the transmission time management tables shown in FIGS. 56 and 58.

Next, a description is made of the reception interrupt functions of the communication management section 91 of the second control unit 123A and the communication management section 101 of the display/setting unit 138A, as well as of the function of detecting whether another control unit is connected, this detecting function being performed as a part of the reception interrupt function based on reception of data.

Figure 59A:
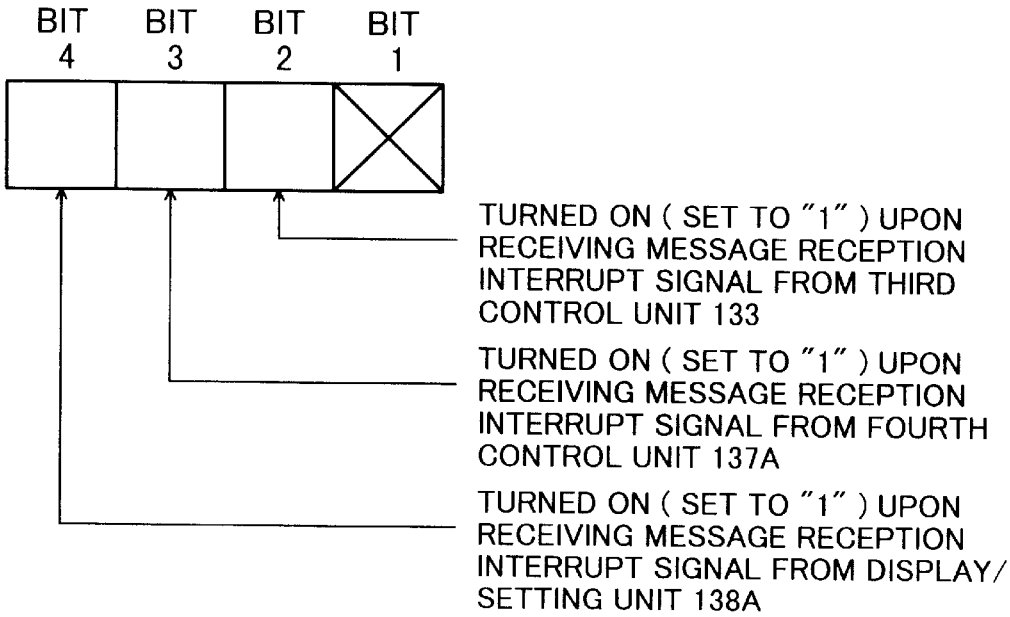
FIG. 59A shows the flag configuration in a flag setting section of the second control unit.
Figure 59B:
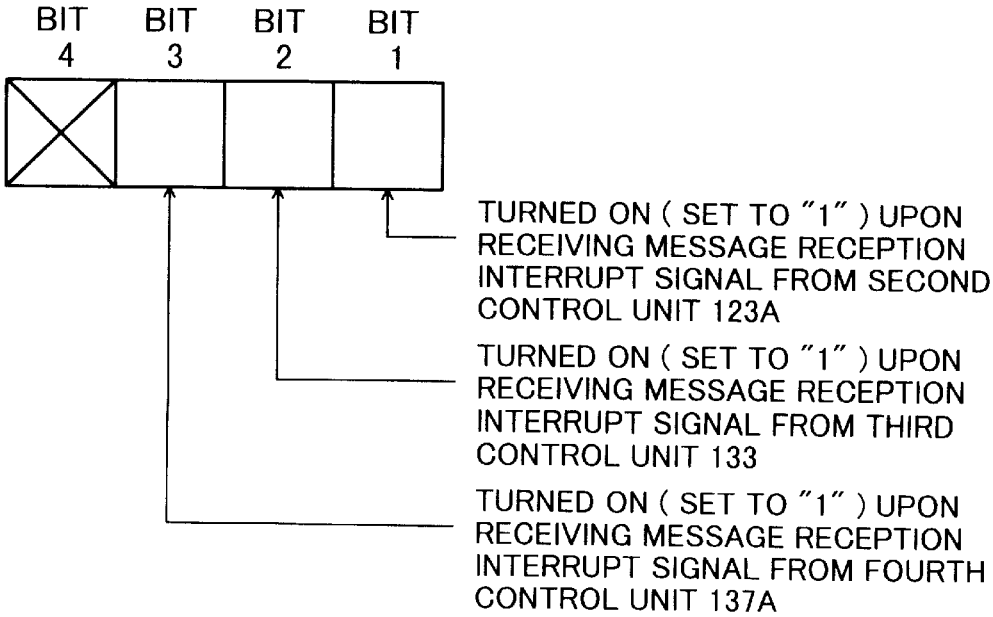
FIG. 59B shows the flag configuration in a flag setting section of the display/setting unit.

Prior to describing those functions, FIGS. 59A and 59B show respectively the flag configuration in the flag setting section 92 of the second control unit 123A and the flag setting section 102 of the display/setting unit 138A. The flag configuration in each flag setting section consists of four bits as shown. A bit 1 is assigned to reception of a message from the second control unit 123A. A bit 2 is assigned to reception of a message from the third control unit 133. A bit 3 is assigned to reception of a message from the fourth control unit 137A. A bit 4 is assigned to reception of a message from the display/setting unit 138A. Each bit is turned on (written to "1") by a corresponding reception interrupt signal.

Figure 60:
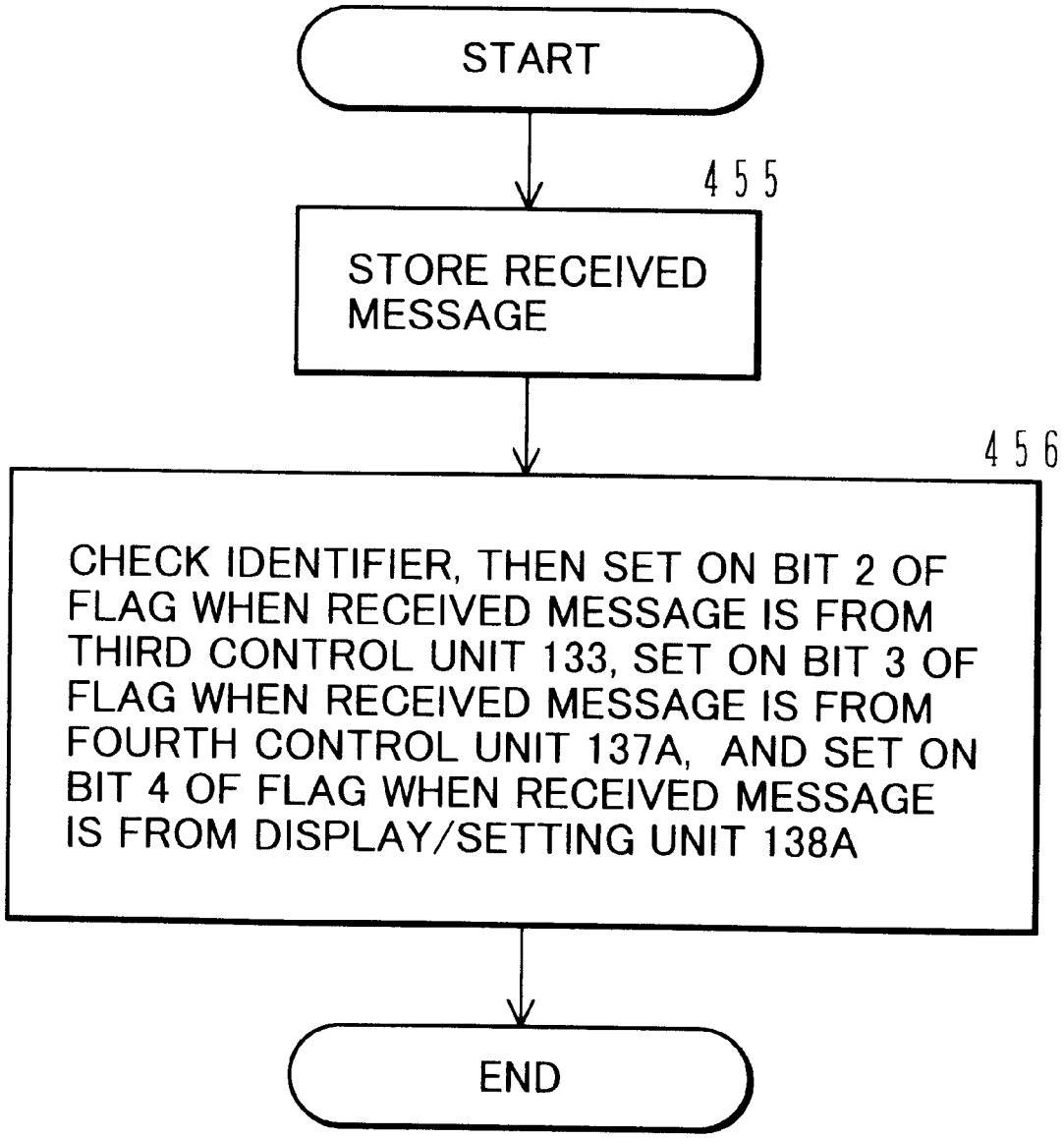
FIG. 60 is a flowchart showing reception interrupt processing performed by the communication management section of the second control unit.

FIG. 60 is a flowchart showing the reception interrupt processing performed by the communication management section 91 of the second control unit 123A.

First, the communication device 123*a* of the second control unit 123A has such a function that when the communication device receives a message comprising a plurality of data grouped into a unit, as described above, via the common communication line 139, it determines whether the received message is necessary for the second control unit 123A, by using as an identifier the message number affixed to the message, and that if the received message is necessary, it sends a reception interrupt signal to the microcomputer side. Upon receiving the reception interrupt signal, the communication management section 91 on the microcomputer side activates the reception interrupt processing and performs the following processing.

Referring to FIG. 60, the communication management section 91 stores, in the RAM, the message comprising a plurality of data grouped into a unit, which has been received by the communication device 123*a* via the common communication line 139 (STEP 455). Then, the communication management section 91 determines from which control unit the message has been transmitted, by using as an identifier the message number affixed to the message. It turns on (writes "1" in) the bit 2 of the flag if the message is from the third control unit 133, turns on (writes "1" in) the bit 3 of the flag if the message is from the fourth control unit 137A, and turns on (writes "1" in) the bit 4 of the flag if the message is from the display/setting unit 138A (STEP 451), thereby ending the processing.

Here, each bit of the flag in the flag setting section 92 is initialized immediately after power-on of the second control unit 123A, and an initial value of "0" is written in the bit. Accordingly, the fact that the reception interrupt processing shown in FIG. 60 is activated and "1" is written in each bit of the flag in STEP 456 is equivalent to detection of such a condition that another control unit from which data is to be received (i.e., the third control unit 133, the fourth control unit 137A or the display/setting unit 138A when the processing is performed in the second control unit 123A) is connected to the common communication line 139. Depending on a detection result, the processing selecting/executing section 93 changes over the processing to be performed in the second control unit 123A.

The processing performed by the processing selecting/executing section 93 will be described with reference to a flowchart shown in FIG. 61.

Figure 61:
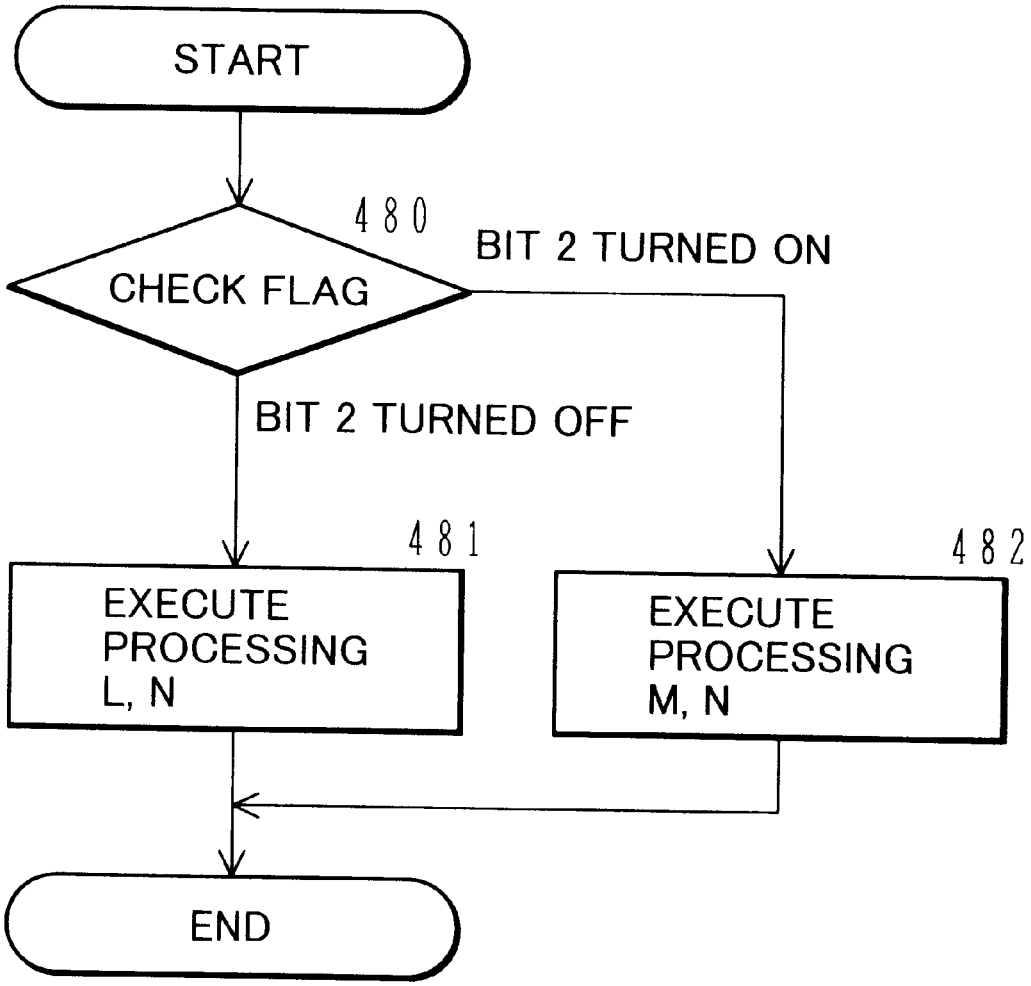
FIG. 61 is a flowchart showing selection and execution processing performed by a processing selecting and executing section of the second control unit.

Referring to FIG. 61, the processing selecting/executing section 93 checks the status of bit 2 of the flag in the flag setting section 92 (STEP 480), and if the bit 2 is turned off ("0"), it executes the processing L, N (STEP 481), thereby ending the processing. If the bit 2 is "1", it executes the processing M, N (STEP 482), thereby ending the processing.

Consequently, in the second control unit 123A, when connection of the third control unit 133 is detected upon receiving the message having the message number 1 or 2, the processing M, N are selected to perform computation of an output value to the swash-plate position regulator 20 of the hydraulic pump 18 by employing the operation signals from the control levers. When no data is received from the third control unit 133 and connection of the third control unit 133 is not detected, the processing L, N are selected to perform computation of an output value to the swash-plate position regulator 20 without employing data of the operation signals. Though not shown, the hydraulic pump 18 may be controlled by checking the on/off status of the bit 3 or 4 and selecting the processing to perform the pump tilting control using the output command values for control of the solenoid valves which are given as a message received from the fourth control unit 137A, or using the setting value which is given as a message received from the display/setting unit 138A.

Figure 62:
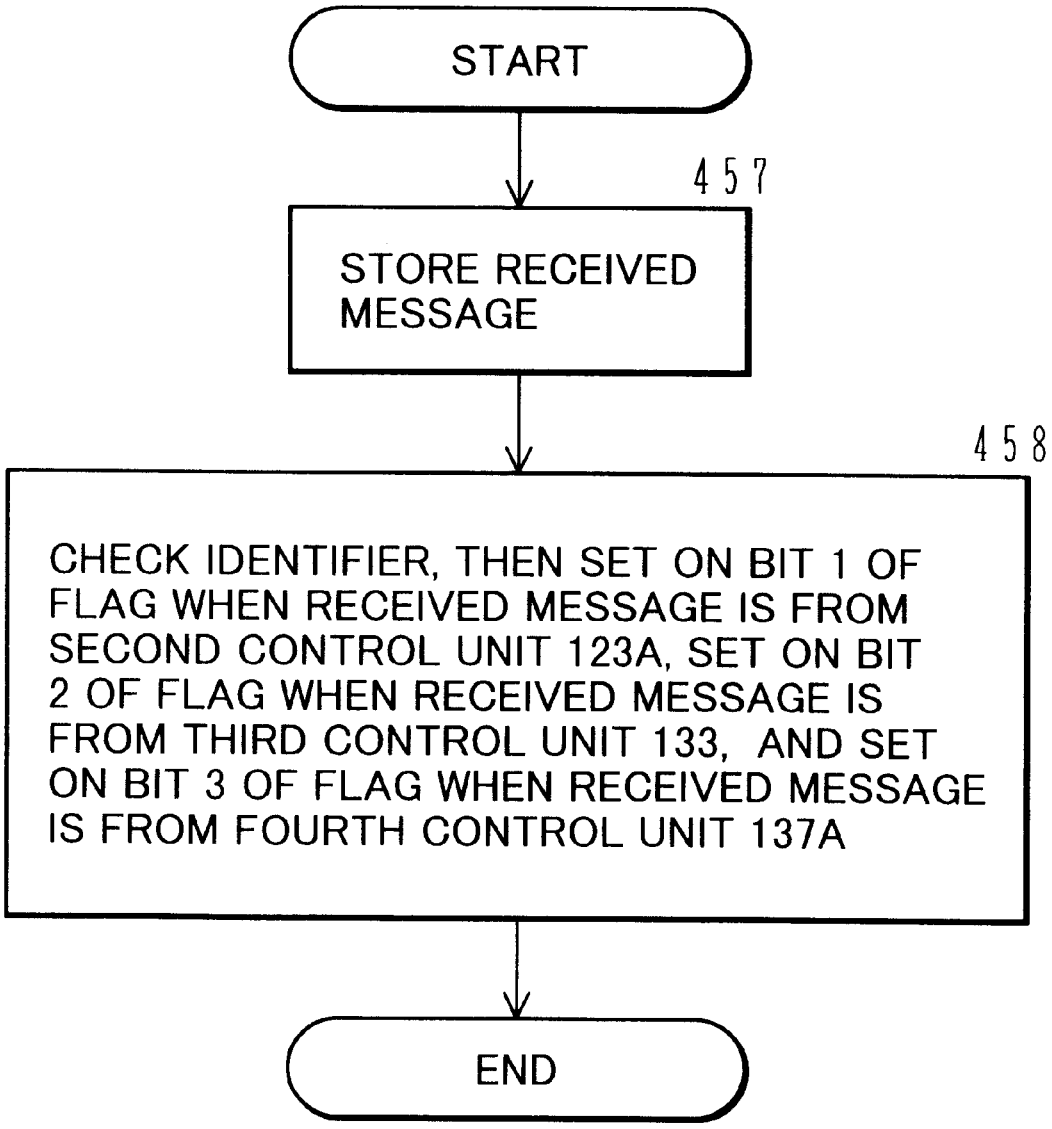
FIG. 62 is a flowchart showing reception interrupt processing performed by the communication management section of the display/setting unit.

FIG. 62 is a flowchart showing the reception interrupt processing performed by the communication management section 101 of the display/setting unit 138A.

First, the communication device 138*a* of the display/setting unit 138A has such a function that when the communication device receives a message comprising a plurality of data grouped into a unit, as described above, via the common communication line 139, it determines whether the received message is necessary for the display/setting unit 138A, by using as an identifier the message number affixed to the message, and that if the received message is necessary, it sends a reception interrupt signal to the microcomputer side. Upon receiving the reception interrupt signal, the communication management section 101 on the microcomputer side activates the reception interrupt processing and performs the following processing.

Referring to FIG. 62, the communication management section 101 stores, in the RAM, the message comprising a plurality of data grouped into a unit, which has been received by the communication device 138*a* via the common communication line 139 (STEP 457). Then, the communication management section 101 determines from which control unit the message has been transmitted, by using as an identifier the message number affixed to the message. It turns on (writes "1" in) the bit 1 of the flag if the message is from the second control unit 123A, turns on (writes "1" in) the bit 2 of the flag if the message is from the third control unit 133, and turns on (writes "1" in) the bit 3 of the flag if the message is from the fourth control unit 137A (STEP 458), thereby ending the processing.

Here, each bit of the flag in the flag setting section 102 is initialized immediately after power-on of the display/setting unit 138A, and an initial value of "0" is written in the bit. Accordingly, the fact that the reception interrupt processing shown in FIG. 62 is activated and "1" is written in each bit of the flag in STEP 458 is equivalent to detection of such a condition that another control unit from which data is to be received (i.e., the second control unit 123A, the third control unit 133 or the fourth control unit 137A when the processing is performed in the display/setting unit 138A) is connected to the common communication line 139. Depending on a detection result, the processing selecting/executing section 103 changes over the processing to be performed in the display/setting unit 138A.

The processing performed by the processing selecting/executing section 103 will be described with reference to a flowchart shown in FIG. 63.

Figure 63:
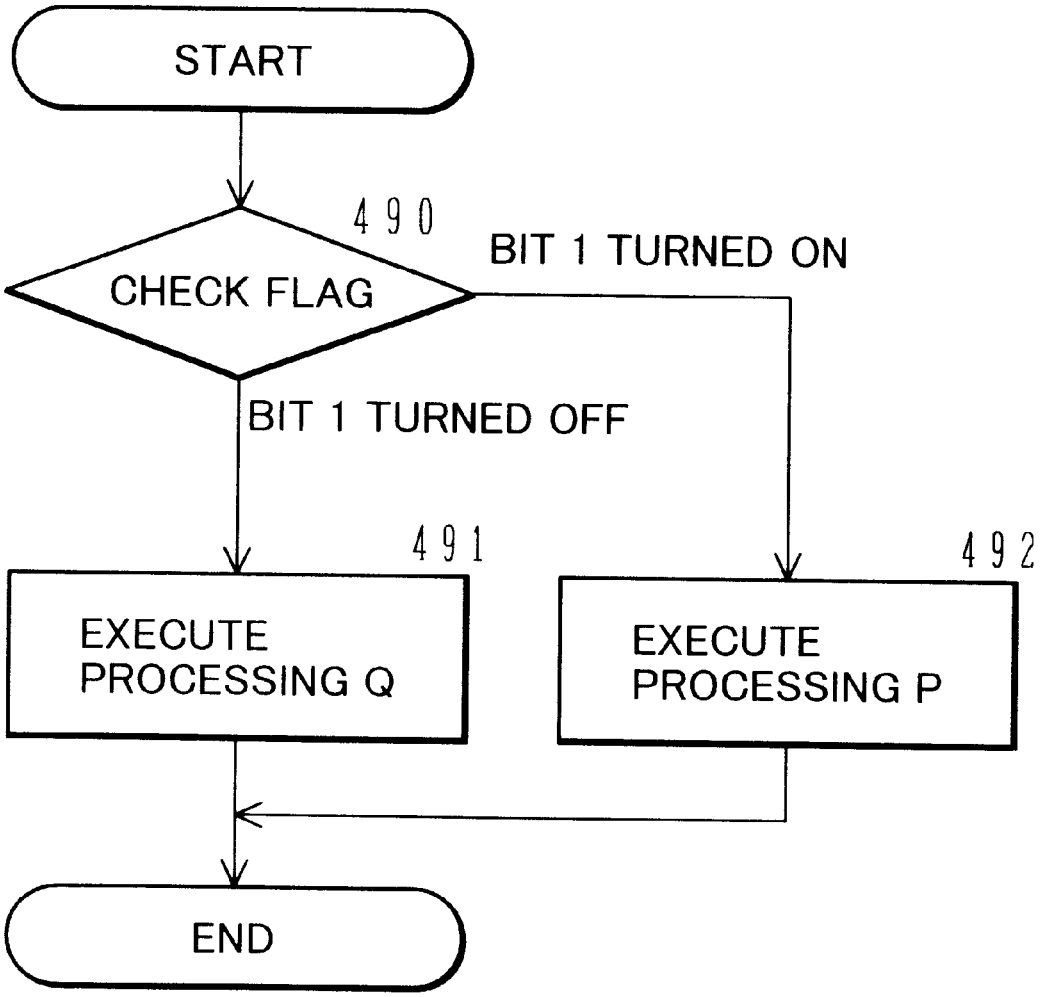
FIG. 63 is a flowchart showing selection and execution processing performed by a processing selecting and executing section of the display/setting unit.

Referring to FIG. 63, the processing selecting/executing section 103 checks the status of bit 1 of the flag in the flag setting section 102 (STEP 490), and if the bit 1 is turned off ("0"), it executes the processing Q (STEP 491), thereby ending the processing. If the bit 1 is "1", it executes the processing P (STEP 492), the reby ending the processing.

Consequently, the display/setting unit 138A displays the pump delivery pressure Pd based on the message 5 transmitted from the second control unit 123A in accordance with an operator's demand. Though not shown, necessary data may be displayed by checking the on/off status of the bit 2 or 3 and selecting the processing to display the operation signals of the control levers based on the messages having the message numbers 1, 2 transmitted from the third control unit 133, or selecting the processing to display the angles α, β of the excavating device based on the message having the message number 3 transmitted from the fourth control unit 137A.

In this embodiment thus constructed, the third control unit 133 and the fourth control unit 137A function in a like manner to those in the first embodiment.

When the third control unit 133 is not connected to the common communication line 139 on the contrary to the electronic control system shown in FIG. 51, the second control unit 123A operates, as described above, such that the bit 2 of the flag remains turned off (at the initial value "0") during the reception interrupt processing in the communication management section 91, and the processing selecting/executing section 93 selects and activates the processing L, N. As a result, the second control unit 123A performs computation of an output value to the swash-plate position regulator 20 without employing data of the operation signals, thereby controlling the delivery rate of the hydraulic pump.

On the other hand, when the third control unit 133 is additionally connected to the common communication. line 139 as shown in FIG. 51, the second control unit 123A operates, as described above, such that the communication management section 91 turns on (writes "1" in) the bit 2 of the flag in the reception interrupt processing and the processing selecting/executing section 93 selects and activates the processing M, N. As a result, the second control unit 123A performs computation of an output value to the swash-plate position regulator 20 for the hydraulic pump 18 by employing the operation signals from the control levers, thereby controlling the delivery rate of the hydraulic pump 18 in accordance with the input amounts by which the control levers are operated.

Also, when the second control unit 123A is not connected to the common communication line 139 on the contrary to the electronic control system shown in FIG. 51, the display/setting unit 138A operates, as described above, such that the bit 1 of the flag remains turned off (at the initial value "0") during the reception interrupt processing in the communication management section 101, and the processing selecting/executing section 103 selects and activates the processing Q. As a result, the display/setting unit 138A displays the setting value entered by the operator.

On the other hand, when the second control unit 123A is additionally connected to the common communication line 139 as shown in FIG. 51, the display/setting unit 138A operates, as described above, such that the communication management section 101 turns on (writes "1") in the bit 1 of the flag in the reception interrupt processing and the processing selecting/executing section 103 selects and activates the processing P. As a result, the display/setting unit 138A displays the pump delivery pressure Pd based on the message 5 transmitted from the second control unit 123A in accordance with an operator's demand.

Accordingly, with this embodiment, even in the case where a system includes a plurality of control units receiving data, such as the second control unit 123A and the display/setting unit 138A, and the processing sections 94–96 or the processing sections 104, 105 perform computational processing using data transmitted from the plurality of control units, the communication management sections 91, 101 detect whether the plurality of control units are connected, by checking the on/off status of the flag bit for each control unit, and renders the processing selecting/executing sections 93, 103 to appropriately change over the computational processing so as to execute the selected computational processing. Therefore, the control unit 133 or 123A can be additionally connected to the common communication line 139 or can be disconnected from the common communication line 139 without changing the software in the existing control unit 123A or 138A or replacing the control unit 123A or 138A itself. It Is hence possible to easily realize system change Including addition, exclusion and replacement of the control unit, and to hold down an increase of the development cost.

Another advantage is that the functions of a hydraulic excavator can be upgraded just by adding the control unit 133 or 123A having a new function incorporated therein to the existing control unit 123A or 128A, and the number of steps to be carried out by a worker for maintenance can be reduced.

It is to be noted that the above embodiments have been described in connection with a hydraulic excavator as a typical example of construction machines, the present invention is also similarly applicable to any type of construction machines so long as the machine includes a plurality of control systems or operating systems provided with respective control units, such as a working device and a control system thereof, hydraulic equipment and a control system or an operating system thereof, etc.

INDUSTRIAL APPLICABILITY

According to the present invention, in an electronic control system for a construction machine which includes a plurality of control units interconnected via a common communication line, one or more control units can be additionally connected to the common communication line or can be disconnected from the common communication line without changing software in the existing control units or replacing the control units themselves. Also, system change including addition, exclusion and replacement of the control unit can be easily realized. As a result, a variety of electronic control systems adapted for different customer-demanded functions can be provided inexpensively.

Also, according to the present invention, since the control unit on the transmitting side sets a transmission time interval required for each transmitted data, the common communication line can be utilized efficiently and the control performance is avoided from being affected by a lowering of the communication efficiency. In addition, even with an increase in the number of control units, the system is less susceptible to such a trouble as disabling communication due to excessive traffic on the common communication line.

Further, according to the present invention, since each control unit identifies and receives only necessary one of data flowing over the communication line based on a specific ID assigned to each data, the control unit can receiver only the data necessary for itself in spite of various data flowing over the communication line.

What is claimed is:

1. An electronic control system for a construction machine comprising a prime mover, a working device, and a hydraulic system for generating liquid pressure power by said prime mover and driving said working device, said construction machine further comprising a plurality of control units, said plurality of control units being interconnected via a common communication line to transmit and receive data, wherein at least one of said plurality of control units includes minimum processing means capable of executing least necessary processing by itself when no data is transmitted via said communication line.

2. An electronic control system for a construction machine according to claim 1, wherein said minimum processing means has an initial value set therein for each data to be received via said communication line for fulfilling the least necessary function of each control unit, and performs computational processing by using the initial value when no data is transmitted via said communication line.

3. An electronic control system for a construction machine according to claim 1, wherein said plurality of control units each have an optimum transmission time interval set therein for each data to be transmitted to another control unit via said communication line, and transmits the data at the set time interval.

4. An electronic control system for a construction machine according to claim 3, wherein the transmission time interval preset for each data to be transmitted is set depending on a frequency of variation of the data to be transmitted or the cycle required for the control unit receiving the data.

5. An electronic control system for a construction machine according to claim 1, wherein said plurality of control units each set a specific ID for each data to be transmitted or received via said communication line, and each include communication means for transmitting data, which is to be transmitted via said communication line, with a specific ID assigned thereto, and for receiving only necessary item of data received via said communication line by identifying the necessary data based on a specific ID assigned thereto.

6. An electronic control system for a construction machine comprising a prime mover, a working device, a hydraulic pump rotationally driven by said prime mover, actuators for driving said working device, control valves for controlling a hydraulic fluid supplied from said hydraulic pump to said actuators, and operating means for operating said control valves, said construction machine further comprising a plurality of control units, said plurality of control units being interconnected via a common communication line to transmit and receive data, wherein at least one of said plurality of control units includes minimum processing means capable of executing least necessary processing by itself when no data is transmitted via said communication line.

7. An electronic control system for a construction machine according to claim 6, wherein said plurality of control units include at least two of a control unit for controlling said prime mover, a control unit for controlling said working device, a control unit for controlling said hydraulic pump, a control unit for operating said control valves through said operating means, and a control unit for performing at least one of display and input in relation to said control units.

8. A control unit for a construction machine comprising a prime mover, a working device, and a hydraulic system for generating liquid pressure power by said prime mover and driving said working device, said control unit being provided in said construction machine and connected to another control unit via a common communication line to transmit and receive data, wherein said control unit includes minimum processing means capable of executing least necessary processing by itself when no data is transmitted via said communication line.

9. A control unit for a construction machine according to claim 8, wherein said minimum processing means has an initial value set therein for each data to be received via said communication line, and performs computational processing by using the initial value when no data is transmitted via said communication line.

10. An electronic control system for a construction machine comprising a prime mover, a working device, and a hydraulic system for generating liquid pressure power by said prime mover and driving said working device, said construction machine further comprising a plurality of control units, said plurality of control units being interconnected via a common communication line to transmit and receive data, wherein at least one of said plurality of control units comprises first processing means for performing computational processing without using data transmitted from another control unit, second processing means for performing computational processing by using data transmitted from said another control unit, detecting means for detecting whether or not said another control unit is connected to said common communication line, and processing changeover means for executing the computational processing in said first processing means when connection of said another control unit is not detected by said detecting means, and for executing the computational processing in said second processing means when connection of said another control unit is detected by said detecting means.

11. An electronic control system for a construction machine according to claim 10, wherein said detecting means detects whether or not said another control unit is connected, depending on whether or not data is received from said another control unit.

12. An electronic control system for a construction machine according to claim 10, wherein said detecting means changes the status of a flag depending on whether or not data is received from said another control unit, and said processing changeover means determines based on the status of the flag whether or not said another control unit is connected, and changes over the computational processing to be executed.

13. An electronic control system for a construction machine according to claim 10, wherein said plurality of control units includes a plurality of other control units and each data transmitted from said plurality of other control units is assigned with specific identifiers, and said detecting means detects whether or not said plurality of other control units are connected, depending on whether or not data is received from said plurality of other control units, and also detects based on the identifier of received data which one of said plurality of other control units is connected.

14. An electronic control system for a construction machine comprising a prime mover, a working device, a hydraulic pump rotationally driven by said prime mover, actuators for driving said working device, control valves for controlling a hydraulic fluid supplied from said hydraulic pump to said actuators, and operating means for operating said control valves, said construction machine further comprising a plurality of control units, said plurality of control units being interconnected via a common communication line to transmit and receive data, wherein at least one of said plurality of control units comprises first processing means for performing computational processing without using data transmitted from another control unit, second processing means for performing computational processing by using data transmitted from said another control unit, detecting means for detecting whether or not said another control unit is connected to said common communication line, and processing changeover means for executing the computational processing in said first processing means when connection of said another control unit is not detected by said detecting means, and for executing the computational processing in said second processing means when connection of said another control unit is detected by said detecting means.

15. An electronic control system for a construction machine according to claim 14, wherein said plurality of control units include at least two of a control unit for controlling said prime mover, a control unit for controlling said working device, a control unit for controlling said hydraulic pump, a control unit for operating said control valves through said operating means, and a control unit for performing at least one of display and input in relation to said control units.

16. A control unit for a construction machine comprising a prime mover, a working device, and a hydraulic system for generating liquid pressure power by said prime mover and driving said working device, said control unit being provided in said construction machine and connected to another control unit via a common communication line to transmit data and receive transmitted data, wherein said control unit comprises first processing means for performing computational processing without using the transmitted data, second processing means for performing computational processing by using the transmitted data, detecting means for detecting whether or not said another control unit is connected to said common communication line, and processing changeover means for executing the computational processing in said first processing means when connection of said another control unit is not detected by said detecting means, and for executing the computational processing in said second processing means when connection of said another control unit is detected by said detecting means.

17. A control unit for a construction machine according to claim 16, wherein said detecting means detects whether or not said another control unit is connected, depending on whether or not data is received from said another control unit.

* * * * *

UNITED STATES PATENT AND TRADEMARK OFFICE

CERTIFICATE OF CORRECTION

PATENT NO. : 6,336,067 B1
DATED : January 1, 2002
INVENTOR(S) : H. Watanabe et al.

It is certified that error appears in the above-identified patent and that said Letters Patent is hereby corrected as shown below:

Title page,
Please add the following:

-- [22] PCT Filed: Aug. 11, 1999
[86] PCT No.: PCT/JP99/04342
§371 Date: Aug. 11, 1999

Signed and Sealed this

Seventeenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,336,067 B1
DATED : January 1, 2002
INVENTOR(S) : H. Watanabe et al.

It is certified that error appears in the above-identified patent and that said Letters Patent is hereby corrected as shown below:

Title page,
Please add the following:

-- [22] PCT Filed: August 11, 1999
[86] PCT No.: PCT/JP99/04342
§371 Date: April 3, 2000
§102(e) Date: April 3, 2000
[87] PCT Pub. No: WO 00/09820
PCT Pub. Date: Feb. 24, 2000 --

This certificate supersedes Certificate of Correction issued September 17, 2002.

Signed and Sealed this

First Day of April, 2003

JAMES E. ROGAN
*Director of the United States Patent and Trademark Office*